US009765949B2

(12) United States Patent
Shen et al.

(10) Patent No.: US 9,765,949 B2
(45) Date of Patent: Sep. 19, 2017

(54) SHAPED MICROSTRUCTURE-BASED OPTICAL DIFFUSERS FOR CREATING BATWING AND OTHER LIGHTING PATTERNS

(71) Applicant: Bright View Technologies Corporation, Richmond, VA (US)

(72) Inventors: Bing Shen, Cary, NC (US); Ken G. Purchase, Morrisville, NC (US); Thomas A. Rinehart, Durham, NC (US); Christopher B. McLaurin, Cary, NC (US)

(73) Assignee: Bright View Technologies Corporation, Richmond, VA (US)

( * ) Notice: Subject to any disclaimer, the term of this patent is extended or adjusted under 35 U.S.C. 154(b) by 502 days.

(21) Appl. No.: 14/341,125

(22) Filed: Jul. 25, 2014

(65) Prior Publication Data

US 2015/0029717 A1 Jan. 29, 2015

Related U.S. Application Data

(60) Provisional application No. 61/858,916, filed on Jul. 26, 2013.

(51) Int. Cl.
*F21V 13/04* (2006.01)
*F21V 5/02* (2006.01)
(Continued)

(52) U.S. Cl.
CPC ..... *F21V 13/04* (2013.01); *F21K 9/65* (2016.08); *F21V 3/049* (2013.01); *F21V 5/005* (2013.01);
(Continued)

(58) Field of Classification Search
CPC ..... F21V 13/04; F21V 3/049; F21V 5/005; F21V 5/02; F21V 9/65; F21K 9/65; F21Y 2103/10; F21Y 2115/10; F21Y 2101/00
See application file for complete search history.

(56) References Cited

U.S. PATENT DOCUMENTS 586,211 A 7/1897 Basquin
821,307 A 5/1906 Mygatt
(Continued)

FOREIGN PATENT DOCUMENTS

CN 102016395 4/2011
CN 102252222 11/2011
(Continued)

OTHER PUBLICATIONS

International Preliminary Report on Patentability corresponding to International Application No. PCT/US14/48161; Date of Mailing: Feb. 4, 2016; 11 Pages.
(Continued)

*Primary Examiner* — Stephen F Husar
(74) *Attorney, Agent, or Firm* — Myers Bigel, P.A.

(57) ABSTRACT

A light distribution device includes a light transmissive substrate having first and second opposing faces and a plurality of substantially parallel linear prisms on the second face that extend in a longitudinal direction of the substrate. The light distribution device is configured to connect to a light assembly including a linear light source with the first face of the substrate facing the light source, with the linear prisms substantially parallel to a light source longitudinal axis and with and the substrate having a non-planar cross-sectional shape such that at least a major portion of the substrate is concave relative to the light source. When connected, the light distribution device is configured to receive light from the light source and distribute the light emerging from the second face of the substrate in a batwing
(Continued)

distribution pattern in a plane perpendicular to the light source longitudinal axis.

38 Claims, 48 Drawing Sheets

(51) Int. Cl.
*F21V 5/00* (2015.01)
*F21K 9/65* (2016.01)
*F21V 3/04* (2006.01)
*F21Y 103/10* (2016.01)
*F21Y 115/10* (2016.01)

(52) U.S. Cl.
CPC ..... *F21V 5/02* (2013.01); *F21Y 2103/10* (2016.08); *F21Y 2115/10* (2016.08)

(56) References Cited

U.S. PATENT DOCUMENTS 2,394,992 A 2/1946 Franck
3,288,990 A 11/1966 Stahlhut
3,329,812 A 7/1967 Harling
3,647,148 A 3/1972 Wince
3,721,818 A 3/1973 Stahlhut
3,725,697 A 4/1973 Wince
3,829,680 A 8/1974 Jones
3,866,036 A 2/1975 Taltavull
3,978,332 A 8/1976 Goytisolo Taltavull
4,161,015 A 7/1979 Dey et al.
4,233,651 A 11/1980 Fabbri
4,300,185 A 11/1981 Wakamatsu
4,428,673 A 1/1984 Yoshida
4,542,449 A 9/1985 Whitehead
4,615,579 A 10/1986 Whitehead
4,698,734 A * 10/1987 Ngai ..... F21V 5/02 362/225
4,750,798 A 6/1988 Whitehead
4,791,540 A 12/1988 Dreyer, Jr. et al.
4,805,984 A 2/1989 Cobb, Jr.
4,834,495 A 5/1989 Whitehead et al.
4,850,665 A 7/1989 Whitehead
4,906,070 A 3/1990 Cobb, Jr.
4,969,075 A 11/1990 Helm et al.
4,984,144 A 1/1991 Cobb, Jr. et al.
5,105,345 A 4/1992 Katoh et al.
5,149,191 A 9/1992 Lewin et al.
5,186,530 A 2/1993 Whitehead
5,193,899 A 3/1993 Oe et al.
5,243,506 A 9/1993 Whitehead
5,309,544 A 5/1994 Saxe
5,339,382 A 8/1994 Whitehead
5,475,785 A 12/1995 Johanson
5,483,119 A 1/1996 Johanson
5,715,347 A 2/1998 Whitehead
5,745,632 A 4/1998 Dreyer
5,845,037 A 12/1998 Miekis
5,997,156 A 12/1999 Perlo et al.
6,280,052 B1 8/2001 White
6,285,814 B1 * 9/2001 Pojar ..... G02B 6/0096 385/133
6,568,822 B2 5/2003 Boyd et al.
6,612,723 B2 9/2003 Futhey et al.
6,698,908 B2 3/2004 Sitzema, Jr. et al.
6,863,420 B1 3/2005 Schütz
7,190,387 B2 3/2007 Rinehart et al.
7,192,692 B2 3/2007 Wood et al.
7,229,192 B2 6/2007 Mayfield, III et al.
7,261,435 B2 8/2007 Gould et al.
7,273,299 B2 9/2007 Parkyn et al.
7,422,347 B2 9/2008 Miyairi et al.
7,537,374 B2 5/2009 Schardt et al.
7,559,672 B1 7/2009 Parkyn et al.
7,565,050 B2 * 7/2009 Lee ..... G02B 6/0096 362/551
7,658,513 B2 2/2010 Peck
7,658,514 B2 2/2010 Lee et al.
7,660,039 B2 2/2010 Santoro et al.
7,674,018 B2 3/2010 Holder et al.
7,731,395 B2 6/2010 Parkyn et al.
7,815,355 B2 10/2010 Thompson et al.
7,837,361 B2 11/2010 Santoro et al.
7,867,695 B2 1/2011 Freese et al.
7,942,559 B2 5/2011 Holder et al.
7,993,036 B2 8/2011 Holder et al.
8,047,673 B2 11/2011 Santoro
8,128,257 B2 3/2012 Wood
8,210,722 B2 7/2012 Holder et al.
8,263,318 B2 9/2012 Freese et al.
8,338,199 B2 12/2012 Lerman et al.
8,339,716 B2 12/2012 Premysler
2002/0034012 A1 3/2002 Santoro et al.
2005/0105880 A1 5/2005 Randall
2005/0201103 A1 9/2005 Saccomanno et al.
2007/0201225 A1 8/2007 Holder et al.
2008/0247170 A1 10/2008 Peck
2009/0225543 A1 9/2009 Jacobson et al.
2009/0296401 A1 12/2009 Gutierrez, Jr.
2010/0128489 A1 5/2010 Holder et al.
2010/0165625 A1 7/2010 Holder et al.
2011/0141734 A1 6/2011 Li et al.
2011/0216537 A1 9/2011 Holder et al.
2011/0216544 A1 9/2011 Holder et al.
2012/0268934 A1 10/2012 Holder et al.
2012/0275150 A1 11/2012 Yokotani et al.
2013/0039090 A1 2/2013 Dau et al.
2013/0042510 A1 2/2013 Nall et al.
2013/0044476 A1 2/2013 Bretschneider et al.
2013/0063925 A1 3/2013 Boonekamp et al.
2015/0330605 A1 * 11/2015 Pijlman ..... F21S 8/085 362/309

FOREIGN PATENT DOCUMENTS

CN 102760823 10/2012
CN 102 788 282 A 11/2012
CN 102954406 3/2013
DE 10 2009 044387 A1 5/2011
EP 0 855 044 A1 7/1998
EP 1 311 879 A2 5/2003
EP 1 925 878 A1 5/2008
EP 1 994 389 A2 11/2008
EP 2 112 426 A2 10/2009
EP 2 142 849 A1 1/2010
EP 2 263 036 A1 12/2010
EP 2 270 557 A1 1/2011
EP 2 383 560 A1 11/2011
EP 2 383 561 A1 11/2011
EP 2 383 562 A1 11/2011
EP 2 515 031 A1 10/2012
EP 2 518 395 A2 10/2012
EP 2 560 155 A2 2/2013
WO WO 02/08799 A2 1/2002
WO WO 2007/100837 A2 9/2007
WO WO 2008/140884 A1 11/2008
WO WO 2009/096685 A2 8/2009
WO WO 2009/110976 A1 9/2009
WO WO 2012/109141 A1 8/2012
WO WO 2012/141899 A1 10/2012
WO WO 2013/045253 A1 4/2013

OTHER PUBLICATIONS

International Search Report and Written Opinion Corresponding to International Application No. PCT/US14/48161; Date of Mailing: Dec. 12, 2014; 13 Pages.
European Search Report Corresponding to Application No. 14 83 0242; Dated: Dec. 8, 2016; 8 Pages.

* cited by examiner

SHAPED MICROSTRUCTURE-BASED OPTICAL DIFFUSERS FOR CREATING BATWING AND OTHER LIGHTING PATTERNS

RELATED APPLICATION

This application claims priority from U.S. Provisional Application No. 61/858,916, filed Jul. 26, 2013, the disclosure of which is hereby incorporated herein in its entirety.

BACKGROUND

Various embodiments described herein relate to light sources, particularly luminaires, for providing special lighting patterns. These embodiments have particular, but not exclusive, usefulness in providing what is known in the art as "batwing" lighting patterns.

In many illumination systems, targeted areas to be illuminated are much larger than an emitting area of the light sources. Many artificial light sources emit light in an approximately Lambertian distribution. When illuminated from above by such a source, flat targeted areas such as roads, floors, or a work surface cannot be illuminated uniformly without modifying the intensity distribution of the light source. When a light source with Lambertian intensity distribution illuminates a flat surface from above, the intensity on that surface will be greatest directly under the light source, and will decrease monotonically for points on the surface farther away. A "batwing" distribution, conversely, reduces the intensity at nadir (directly under the light source) and increases the intensity at angles up to some maximum angle, such that the surface is illuminated substantially uniformly for angles less than the maximum angle. Batwing radiation patterns or light distributions can exist in several forms: one-dimensional (1D) batwings have a batwing shape only to the sides (e.g. East-West direction) and are often used with linear lighting. Two-dimensional (2D) circular batwing distributions create a batwing "cone" of light, illuminating evenly in all radial directions to achieve a disc-shaped area of uniform illumination on a flat surface. 2D square or rectangular batwings create a batwing "pyramid" of light, illuminating evenly in both North-South and East-West directions to achieve a square- or rectangular-shaped area of uniform illumination on a surface, substantially filling in dark corners between luminaires arrayed in a square or rectangular array on a ceiling. Frequently luminaires with batwing distributions can provide the desired uniformity of illumination at a greater luminaire-to-luminaire spacing than with Lambertian luminaires, meaning that fewer luminaires are necessary to illuminate the desired area, saving cost. In addition, the nadir suppression involved in a batwing distribution means minimum lighting levels can be met across the surface without far exceeding that minimum level at the nadir, which would unnecessarily waste energy.

A downward-facing light source with Lambertian light distribution has luminous intensity that is proportional to the cosine of the angle from nadir (the downward-facing direction). A Lambertian light distribution is represented in polar coordinates in FIG. 1. When a flat surface such as a floor is illuminated by a Lambertian light distribution, the illuminance on the floor is greatest at nadir (directly under the fixture) and decreases monotonically for points on the floor away from nadir. The central brightness is often referred to as a "hot spot" in the lighting industry, and is generally undesirable. By definition, the Full Width at Half Maximum (FWHM) of a Lambertian distribution is 120 degrees. In the lighting industry, the term "Lambertian" is also frequently used to refer to light distributions with similar quality but of different widths. That is, distributions that have a peak at nadir, and monotonically decrease at higher angles are often called Lambertian. In one example, a Gaussian distribution with FWHM of 80 degrees will often be called "Lambertian" in the lighting industry. Lambertian distributions are not batwing distributions.

For a single ceiling luminaire, which is small compared to the ceiling-to-floor distance, to uniformly illuminate a specified width across a flat surface such as a floor, it generally must emit light in a batwing distribution whose luminous intensity is inversely proportional to the cube of the cosine of the angle from nadir for angles less than the maximum angle. This theoretical distribution can be represented by the solid curve in FIG. 2, in which no light extends beyond the maximum angle. In practice, multiple luminaires are generally used to illuminate a surface such as a room, warehouse, or roadway, and it is desirable to have some overlap, or crossfade, between the light distributions emitted by each light source. Thus a practical batwing light distribution often has some light extending beyond the maximum angle, as illustrated in the dashed curve of FIG. 2. The sharp "peaks" of the light distribution in the solid curve are also disadvantageous because they can be noticeable to a viewer, and are hard to create in practice. The dashed curve of FIG. 2 shows more practical rounded peaks in the light distribution.

In practice, it is acceptable to have some level of variation of the illuminance on a surface. For various lighting applications, an illuminance variation of about 50%, 20%, 10%, 5%, or less may be acceptable across the surface of interest when illuminated by an array of luminaires. Because the specified level of variation allows for some deviation from ideal conditions, the batwing diffuser is allowed to have a light distribution that doesn't exactly follow the $1/\cos^3$ distribution. This imperfection is illustrated in central portion of the dashed curve in FIG. 2.

Real-world lighting situations often include extra light, reflected from floors, ceilings, and/or other objects in the illuminated space. These reflections may be random in nature, and thus may increase the uniformity on the flat surface beyond the uniformity provided by the array of luminaires alone. This may also allow the luminaire's light distribution to deviate further from the ideal $1/\cos^3$ distribution and still achieve a desired level of uniformity on the flat surface.

In lighting, batwing light distributions different from the typical inverse cosine cubed shape are also used. These may be desired, for example, in a library or store, in which it may be desired to illuminate vertical surfaces of shelves holding books or items. For these and other lighting applications, a degree of nadir suppression may be desirable that is greater or less than the typical inverse cosine cubed shape.

Other non-Lambertian lighting distributions are also beneficial for specific applications in lighting. Wall-grazer and wall-wash distributions seek to evenly illuminate a wall from a lighting fixture placed above and some distance from the wall. Narrow, collimated, or spot distributions seek to confine light in a narrow angular spread to provide very localized illumination. Asymmetric distributions may provide more light to one side of a fixture than the other side, for example to evenly illuminate a floor from a wall-mounted fixture.

Some lighting distributions seek to reduce glare, or light emitted at high angles, usually in the range of 65-90 degrees from nadir. Such light can reflect from computer monitors and reduce visibility. For office environments in the United States, ANSI/IESNA RP-1-04 suggests limits on light emission into these angles.

High-efficiency LED lighting is being increasingly adopted. Typical LED light sources emit light into a Lambertian distribution with a Full Width Half Max (FWHM) of approximately 120 degrees. Although LEDs with many other light distributions are available, many cost-effective LEDs sold for general lighting are of the 120 degree Lambertian variety. In many luminaires, a simple planar diffuser (such as a microstructured, holographic, or volumetric diffuser) is used to diffuse the LEDs, hiding their appearance from viewers and smoothing the surface appearance of the luminaire. These diffusers may not produce batwing distributions. Rather, they typically give Lambertian distributions of various widths (most typically about 80 to 120 degrees).

Conventional diffusers known in the art come in many varieties including volumetric, microstructured, holographic, and kinoform diffusers. Conventional diffusers can range in their diffusion strength from very light (in which an object viewed through the diffuser may be blurred but recognizable to very heavy (in which the diffuser may appear milky white and translucent, and objects may not be recognizable when viewed through the diffuser). The strength of the diffuser is sometimes characterized by illuminating one surface of the diffuser with a collimated light source such as a laser from a direction normal to the diffuser's surface, and goniometrically measuring the light output from the opposite surface. The diffuser is then defined by the Full Width at Half Maximum (FWHM) of the angular spread of light emitted from said opposite surface. Thus a 30-degree conventional diffuser when illuminated by a laser will produce a diffuse beam with substantially 30 degree FWHM. Conventional diffusers often have a symmetric, having the FWHM in all azimuthal orientations, while some diffusers may have an elliptical light distribution pattern, having one FWHM in a first azimuthal orientation, and a substantially different FWHM in a second azimuthal orientation substantially perpendicular to the first. Many other diffusion patterns are also known in the art.

SUMMARY

Light distribution devices according to various embodiments described herein are for use with a light assembly including a linear light source having a light source longitudinal axis. The light distribution device includes a light transmissive substrate including first and second opposing faces and a plurality of substantially parallel linear prisms on the second face that extend in a longitudinal direction of the substrate. A respective prism has a generally triangular cross section in a plane transverse to the longitudinal direction of the substrate. The light distribution device is configured to connect to the light assembly in a connected position with the first face of the substrate facing the light source, with the linear prisms substantially parallel to the light source longitudinal axis and with and the substrate having a non-planar cross-sectional shape in a plane transverse to the longitudinal direction of the substrate such that at least a major portion of the substrate is concave relative to the light source. When connected in the connected position, the light distribution device is configured to receive light from the light source and distribute the light emerging from the second face of the substrate in a batwing distribution pattern in a plane perpendicular to the light source longitudinal axis.

In some embodiments, the non-planar cross-sectional shape is an arc of a circle. A center of a circle including the arc of the circle may be spaced-apart from the light source longitudinal axis.

In some embodiments, the non-planar cross-sectional shape is an arc of an ellipse. A center of an ellipse including the arc of the ellipse may be spaced-apart from the light source longitudinal axis.

In some embodiments, the non-planar cross-sectional shape is a pointed arch.

In some embodiments, the light distribution device includes first and second reflectors. The reflector spans from the light assembly to a first longitudinal edge of the substrate, and the second reflector spans from the light assembly to a second longitudinal edge of the substrate that is opposite the first longitudinal edge of the substrate. The first and second reflectors may be specular reflectors.

The first and second reflectors may be diffuse reflectors. The first and second reflectors may define a reflector angle at the light assembly that is at least about 60 degrees to distribute the light emerging from the second face in a wide batwing distribution pattern in a plane perpendicular to the light source longitudinal axis. The first and second reflectors may define a reflector angle at the light assembly that is between about 30 and 60 degrees to distribute the light emerging from the second face in a narrow batwing distribution pattern in a plane perpendicular to the light source longitudinal axis. In some embodiments, the first reflector spans from the light assembly past the first longitudinal edge of the substrate and the second reflector spans from the light source assembly past the second longitudinal edge of the substrate.

In some embodiments, a respective prism has an internal angle of about 90 degrees. In some embodiments, a respective prism has an internal angle of about 60 degrees. In some embodiments, a respective prism has an internal angle of between about 45 and 90 degrees.

In some embodiments, the substrate has a refractive index of about 1.49 or less.

In some embodiments, a respective prism comprises a base at the second face of the substrate, and substantially none of the prisms have a base that directly faces the light source.

In some embodiments, the non-planar cross-sectional shape includes a raised central point with two outwardly-bending curves extending in opposite directions therefrom, and the two outwardly-bending curves are concave relative to the light source. The light distribution device may include a second substrate, a third substrate, a first reflector and a second reflector. The second substrate may have first and second opposing faces with a plurality of substantially parallel linear prisms on the second face, with the second substrate being concave relative to the light source, and with a first longitudinal edge of the second substrate positioned at a first longitudinal edge of the first substrate. The third substrate may have first and second opposing faces with a plurality of substantially parallel linear prisms on the second face, with the third substrate being concave relative to the light source, and with a first longitudinal edge of the third substrate positioned at a second longitudinal edge of the first substrate that is opposite the first longitudinal edge of the first substrate. The first reflector may span from the light assembly to a second longitudinal edge of the second substrate that is opposite the first longitudinal edge of the second substrate. The second reflector may span from the light assembly to a second longitudinal edge of the third substrate that is opposite the first longitudinal edge of the third substrate.

In some embodiments, a first longitudinal edge of the substrate is connected to the light assembly on one side of the light source and a second longitudinal edge of the substrate that is opposite the first longitudinal edge of the substrate is connected to the light assembly on an opposite side of the light source.

In some embodiments, the light distribution device includes first and second end caps, with the first end cap at a first transverse edge of the substrate and the second end cap at a second transverse edge of the substrate that is opposite the first transverse edge of the substrate.

In some embodiments, the plurality of substantially parallel linear prisms are on a central longitudinal portion of the substrate, and the light distribution device further includes a first outer longitudinal light-blocking portion of the substrate and a second outer longitudinal light-blocking portion of the substrate that is opposite the first outer longitudinal light-blocking portion.

In some embodiments, the plurality of substantially parallel linear prisms are substantially uniformly distributed on the second face of the substrate.

In some embodiments, the substrate is a monolithic member. In some embodiments, the substrate includes a film comprising the plurality of substantially parallel linear prisms on a rigid or semi-rigid translucent or transparent member. The film may have a thickness of about 0.2 mm or less.

In some embodiments, a respective prism has a pitch of about 100 microns or less.

In some embodiments, the light distribution device includes a microstructure or holographic diffuser on the first face of the substrate.

In some embodiments, the light distribution device includes at least one diffusion feature, with the at least one diffusion feature including: surface roughness on at least some of the prisms; rounding of at least some of the peaks of the prisms; rounding of at least some valleys that are between adjacent prisms; a light scattering agent in at least some of the prisms and/or the substrate; and/or a diffusive coating on at least some of the prisms.

In some embodiments, the substrate is configured to be curved and/or bent to form the non-planar cross-sectional shape.

In some embodiments, the light distribution device is in combination with the light assembly including the linear light source. The linear light source may include an array of spaced-apart LEDs. The linear light source may include a fluorescent lamp.

Light distribution devices according to various embodiments described herein are for use with first and second light assemblies, with the first light assembly including a first linear light source having a first light source longitudinal axis, and with the second light assembly including a second linear light source having a second light source longitudinal axis. The light distribution device includes a first light transmissive substrate having first and second opposing faces with a plurality of substantially parallel linear prisms on the second face that extend in a longitudinal direction of the first substrate. The light distribution device includes a second light transmissive substrate having first and second opposing faces with a plurality of substantially parallel linear prisms on the second face that extend in a longitudinal direction of the second substrate. The first light transmissive substrate is configured to connect to the first light assembly in a connected position with the first face of the first substrate facing the first light source, with the linear prisms substantially parallel to the first light source longitudinal axis and with the first substrate concave relative to the first light source. The second light transmissive substrate is configured to connect to the second light assembly in a connected position with the first face of the second substrate facing the second light source, with the linear prisms substantially parallel to the second light source longitudinal axis and with the second substrate concave relative to the second light source. When connected in the connected position, the first light transmissive substrate is configured to receive light from the first light source and distribute the light emerging from the second face of the first substrate in a first one-sided distribution pattern in a plane perpendicular to the first light source longitudinal axis. When connected in the connected position, the second light transmissive substrate is configured to receive light from the second light source and distribute the light emerging from the second face of the second substrate in a second one-sided distribution pattern in a plane perpendicular to the second light source longitudinal axis. The first and second one-sided distributions patterns combine to form a batwing distribution pattern in a plane perpendicular to the first and second light source longitudinal axes.

In some embodiments, the light distribution device includes: a first reflector spanning from the first light assembly to a first longitudinal edge of the first substrate; a second reflector spanning from the first light assembly to a second longitudinal edge of the first substrate that is opposite the first longitudinal edge of the first substrate; a third reflector spanning from the second light assembly to a first longitudinal edge of the second substrate; and a fourth reflector spanning from the second light assembly to a second longitudinal edge of the second substrate that is opposite the first longitudinal edge of the second substrate.

In some embodiments, the light distribution device includes: a first reflector spanning from the first light assembly to a first longitudinal edge of the first substrate; a second reflector spanning from the second light assembly to a first longitudinal edge of the second substrate; and a third reflector spanning from the first light assembly to the second light assembly. The third reflector may be positioned and configured such that the first light source does not directly illuminate the second substrate and such that the second light source does not directly illuminate the first substrate. In some embodiments, the light distribution device includes a diffuser spanning from a second longitudinal edge of the first substrate that is opposite the first longitudinal edge of the first substrate to a second longitudinal edge of the second substrate that is opposite the first longitudinal edge of the second substrate.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION

For collimated light, beam shaping is well known in the art. Refractive and diffractive elements exist that can form a (collimated) laser beam into a specific shape. Such elements are available commercially, for example, from Jenoptik, Jena, Germany (http://wvvw.jenoptik.com/en-microoptics-refractive-optical-elements-ROEs). These elements can shape a laser beam into a line, crosshair, square, circle, and even images (such as corporate logos) to project on a surface, and are commonly used in machine-vision applications. Beam shapers generally require substantially collimated light, and generally have a planar (flat) form.

Figure 3A:
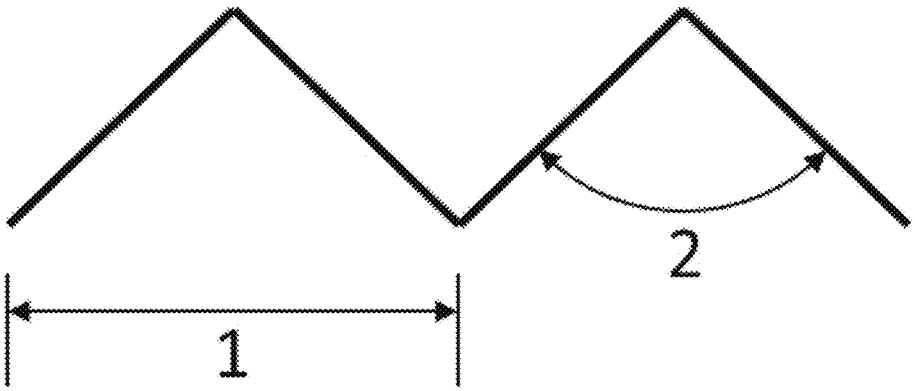
FIG. 3A is a schematic diagram illustrating a prism cross section.

A prism cross-section, taken in the plane perpendicular to the substrate and perpendicular to the major orientation of the prisms is shown in FIG. 3A. The prism pitch 1 is the distance between successive prisms, and the prism internal angle 2 is the angle subtended by the peak of the prism in this cross-sectional plane. A prism film with prism internal angle 2 of 90 degrees is defined as a "90-degree prism" herein.

Prism films are used widely in the display industry (in the brightness-enhancing configuration, planar, with prisms facing away from the light source). Commercial prism films typically consist of 90-degree linear prisms formed of polymer on the surface of polymer films, often 50-250 microns in thickness. The prisms typically have a refractive index near 1.6, and a pitch ranging from 20-50 microns. They are available from a variety of manufacturers. One commercial example is BEF manufactured by 3M.

A 90-degree linear prism optic has one smooth surface and the other one is textured by an array of linear prisms with substantially 45-degree sidewalls, as shown in U.S. Pat. No. 3,288,990 and U.S. Pat. No. 4,542,449, in which one or two layers of prism optics are used to increase brightness directly under a luminaire, and reduce high-angle brightness. A film with the same properties is described in U.S. Pat. No. 4,906,070. A common application of such a prism optic is for brightness enhancement of the back light unit inside a display system, in which the prism optic is used flat over an extended, non-collimated light source, such as an array of LEDs, array of cold-cathode fluorescent lamps (CCFLs), or a side-illuminated light guide plate (LGP). In both lighting and display, a brightness-enhancing prism optic is used with the light entering smooth surface of the optic, and thus the prisms facing away from the light source. The prism optic is substantially planar or flat, with peak light emission substantially parallel to its surface. Rays incident perpendicular to the surface of the film will encounter total internal reflections (TIR) from the prisms. Those light rays are generally reflected back into the backlight, which is generally configured with high reflectivity to recirculate those rays back toward the prism optic (sometimes repeatedly), until they enter the prism optic at larger incident angle and are allowed to pass to the viewer of display. Rays incident at larger angles are at least in part refracted through the prisms, and on average over all angles, the average exit angles are smaller than the average entrance angles, when measured relative to the normal to the prism optic. The angle bending and recirculation process creates a narrower FWHM light distribution (approx. 70-95 degrees) when illuminated by approx. 120 degree Lambertian distribution, and also provides on-axis brightness enhancement, also called gain. Said another way, a planar 90-degree linear prism optic illuminated by a wide light distribution upon its flat surface and with appropriate recirculation will increase intensity at the nadir, while reducing the FWHM, and thus does not create a batwing distribution.

Figure 3B:
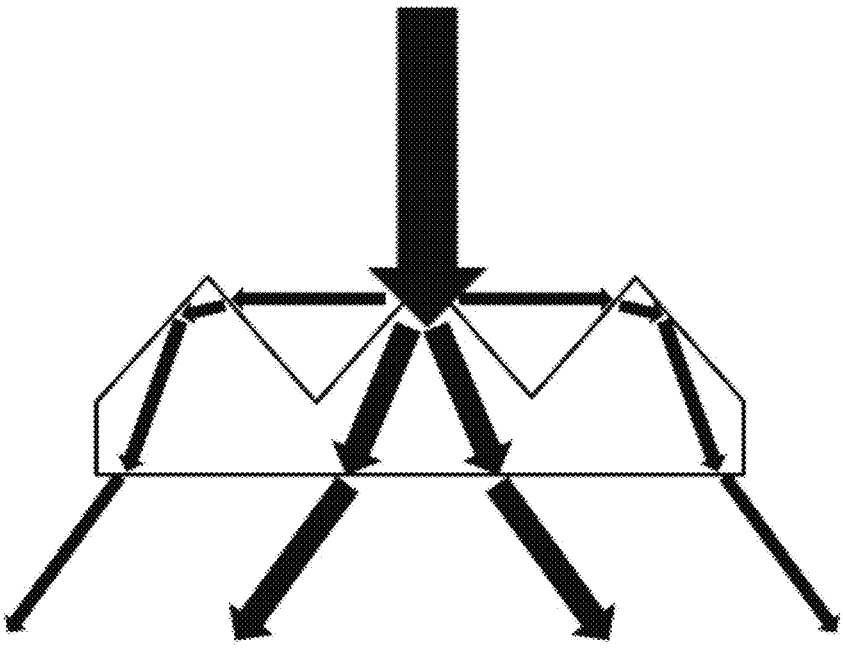
FIG. 3B is a schematic diagram illustrating prism film light refraction properties with prisms oriented toward a light source.
Figure 3C:
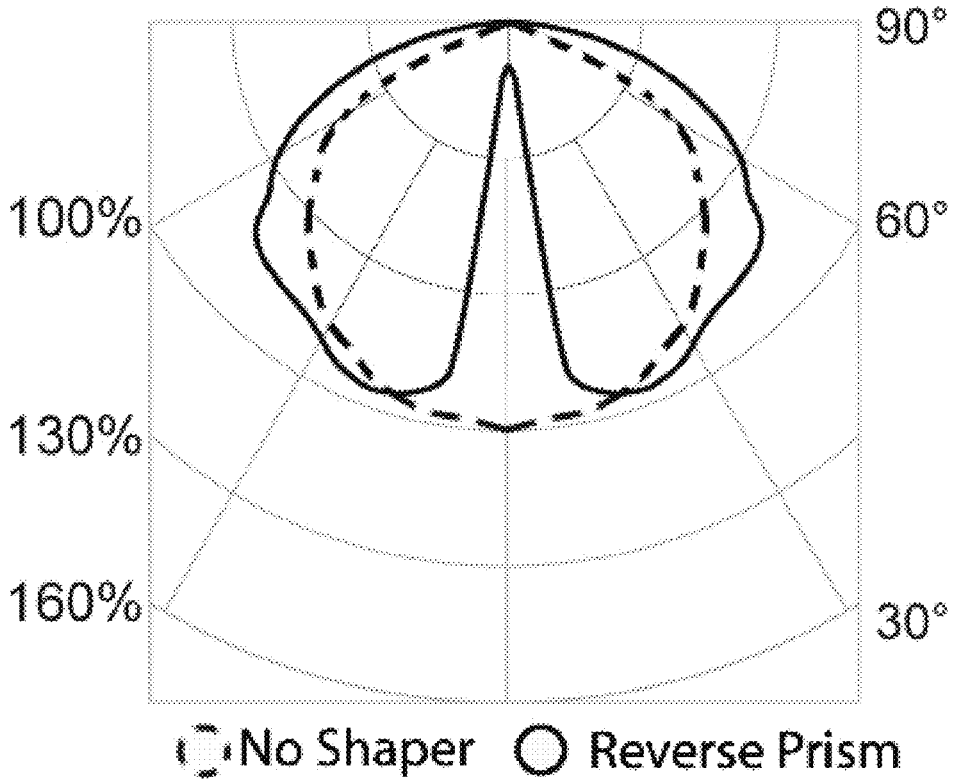
FIG. 3C is a chart illustrating light distribution after passing through a commercially-available prism film.

In contrast, it is known that if the light enters the prism side (rather than the smooth side) of a planar 90-degree linear prism film or optic, it will exit in two lobes, similar to a 1D batwing shape (as mentioned in U.S. Pat. No. 4,300,185 or U.S. Pat. No. 4,233,651). FIG. 3B illustrates how collimated light will be divided (refracted) into two branches by prism structures. The angular deviation of this refraction is determined by the refractive index of the material, and the sidewall angle of the prisms. Typical refractive indices for prism films are in the range of 1.45 to 1.6. Greater prism angle or greater refractive index will result in larger refraction angles. Even Lambertian light impinging onto the prism side of a prism film will exit that film in a split distribution, in which light is approximately a batwing shape. This use of a prism is referenced on the Fusion Optix website at http://fusionoptix.com/lighting/components/light-shapers.htm (as of May 17, 2013), a diagram adapted from which is shown in FIG. 3C. The reduction of light intensity at theta (θ)=0 degrees (straight down in the image) is called "nadir suppression."

In some artificially-illuminated environments, linear luminaires are used, in suspended, surface-mount, or recessed configurations. Such luminaires usually involve multiple lighting fixtures arrayed in a line parallel to their long axes with or without extra space between the fixtures, or can comprise single continuous lighting fixtures with a long axis. We define the vertical plane parallel to the long axis of the luminaire as the phi=0 plane, and the vertical plane perpendicular to the long axis as the phi=90 degrees plane. In linear lighting, the continuous or quasi-continuous nature of the light emission in the phi=0 plane parallel to the long axes usually provides uniform illumination of a floor or flat surface along the phi=0 plane. As such, a batwing distribution may not be needed in the phi=0 plane. For linear fixtures, it may be desirable to have a batwing distribution in the phi=90 degrees plane to provide uniform illumination in the phi=90 plane on the flat surface. For linear fixtures, a batwing distribution in the phi=0 plane may be less useful than a batwing distribution in the phi=90 degrees plane.

Many 1D and 2D batwing distributions exist in the art.

Batwing distributions are known in the art, and are usually created using specific focusing optics (e.g. lenses and/or reflectors), and/or specific features in the geometry of a light source, such as lamp placement, and placement of internal or external baffles, louvers, openings, and placement of ordinary diffusers. Examples include US Patent Application Publication 20050201103 A1, US Patent Application Publication 20130044476 A1, U.S. Pat. No. 4,218,727 A, U.S. Pat. No. 5,105,345 A, U.S. Pat. No. 6,698,908 B2, U.S. Pat. No. 3,329,812, EP Publication 1925878 A1, U.S. Pat. No. 3,725,697, U.S. Pat. No. 7,273,299, U.S. Pat. No. 5,149,191, EP Publication 2112426 A2. In many cases the focusing optics, baffles, etc., increase the cost of a luminaire. These designs are generally strongly dependent on the placement of the light source, and generally require alignment of the reflectors, baffles, etc. with the light source. Designing these luminaires with 1D or 2D circular or rectangular batwing distributions is generally difficult and slow, requiring either advanced computer modeling or trial-and-error testing, which can be too costly for some smaller lighting manufacturers. In particular, rectangular and square batwing distributions are the most difficult to create, due to the lack of a radial symmetry.

In U.S. Pat. No. 3,721,818, Stahlhut describes an article capable of controlling light distributions, such as reducing glare and creating 1D and 2D batwing distributions. The article involves shaped surfaces on one or both sides of a planar substrate, with additional "light reducing areas" (e.g. paint) which can be opaque, reflective or absorbing. Undesirably, the need for these light reducing areas may both increase cost and decrease efficiency of the light fixture. In some embodiments, the need to create structures on both sides of the surface that are aligned to each other may also add expense and complexity.

In U.S. Pat. No. 3,866,036, Taltavull describes a planar substrate with prism-like structures including prisms or linear lenses with truncated tips upon which thick opaque structures are formed. These may create effective batwing light distributions but may be expensive and difficult to create, and the opaque structures may incur additional losses of light, reducing overall fixture efficiency. In addition, the lack of diffusion in these structures means that from certain viewing angles, the light source(s) may be visible as undesirable bright spots on the surface of the luminaire.

In U.S. Pat. No. 3,978,332, Taltavull describes a planar substrate with a ring-shaped structure including concentric prisms or linear lenses with truncated tips upon which are created opaque structures. These can create effective 2D batwing light distributions but may be expensive and difficult to create, and the opaque structures may incur additional losses of light, reducing overall fixture efficiency. Taltavull additionally uses the exact placement of lenses and a carefully designed reflector, all of which elements together combine to create the desired 2D batwing light distribution, which may add further expense.

In U.S. Pat. No. 4,161,015, Dey et. al., describe a luminaire with batwing distribution created by selective reflectivity from a multilayer interference filter with reflectivity and transmissivity that vary with angle of incidence. Unfortunately such an interference filter may be expensive to create, and may generally be wavelength-sensitive. In addition, when viewed from certain angles, there is undesirably no obscuring of the light sources.

In US Patent Application Publication 20090296401 A1 Gutierrez describes a system that uses a moving resonant mirror to create a desired light distribution, including batwing distribution. Such a system may suffer from excess power consumption, noise created by the mechanical motion, flicker, and possibly reliability issues associated with moving parts.

In U.S. Pat. No. 4,059,755 A, Brabson describes the use of three different prism optics in two layers to create a 1D batwing distribution. This system may undesirably need to be aligned to a linear source. Undesirably, the two layers of custom prism optics may be expensive, and may incur a reduction of efficiency associated with reflections from multiple optical interfaces.

In many other examples, including US Patent Application Publication 20090225543, US Patent Application Publication 20120275150, PCT Publication WO2012109141 A1, U.S. Pat. No. 7,658,513, US Patent Application Publication 20130042510, U.S. Pat. No. 8,339,716 B2, US Patent Application Publication 20130039090 A1, U.S. Pat. No. 7,273,299 B2, U.S. Pat. No. 7,731,395 B2, US Patent Application Publication 2009096685 A2, US Patent Application Publication 20110141734 A1, U.S. Pat. No. 7,942,559 B2, U.S. Pat. No. 7,993,036 B2, U.S. Pat. No. 6,568,822, individual light sources (typically LEDs or collections of LEDs) are modified using lenses, reflectors, light pipes, or the LED package, in close proximity to light sources. Many light distributions can be created this way (as known in the art), including 1D and 2D batwing distributions. In many general lighting applications, large numbers of LEDs (typically tens or hundreds) are used over the area of the luminaire, and the use of lensed LEDs with non-Lambertian distributions can be costly. Also, individual LEDs can be piercingly bright when unobscured, even if focused using localized lenses. To achieve desirable smooth appearance of a luminaire and obscure the light sources, additional diffusers may be required, incurring higher costs. Further, such diffusers may in some cases not be able to sufficiently homogenize the surface appearance of the luminaire without degrading the distribution created by the LEDs.

In U.S. Pat. No. 5,997,156 A, Perlo et. al. describe creating rectangular or square light distributions using rippled lenticular lenses or TIR prism lenses on planar substrates in conjunction with a collimated light source (in the example provided, using a parabolic reflector). However, the techniques mentioned may not work with Lambertian light sources.

In U.S. Pat. No. 5,243,506 A, a light-pipe architecture illuminated by a single source at the end of the light pipe uses prisms to couple light out of the light pipe at a point and in a direction substantially perpendicular to the surface of the light pipe at that point. By using metal masking in selective locations to determine where light can strike the prisms and escape the light pipe, 1D light distributions including 1D batwing distributions can be sculpted.

First-pass transmission is the fraction of incident light directly from the light source that is emitted through a diffuser in a luminaire. Light that is not emitted in the first pass may either be absorbed or reflected back into the luminaire. Such reflected light may be further absorbed or reflected by surfaces inside the luminaire, and some of such reflected light may thus have another chance to exit the diffuser on the second or later passes. High first-pass transmission may desirably result in high luminaire efficiency.

The use of prisms for retro-reflection is well known in the art. A prism film employing outward-facing prisms bent into a closed tube with an appropriate cross-sectional shape can serve as a light-pipe, accepting light that is transmitted into one or both ends of the tube, and guiding the light along the length of the tube using reflections from the prism film. In some light pipe designs, a scattering element is included inside the light pipe, specifically designed to scatter light out of the light pipe where it can provide useful illumination. Light Pipes are illuminated at one or both ends and do not contain a linear light source within the light pipe. Light Pipes have not been widely adopted, for a variety of reasons. Prism-based light pipes may leak a significant amount of light along their length, the leaked light often being leaked into all angles. Leaked light striking the light housing or ceiling may be partially absorbed leading to lower illumination on the desired illumination area. It can be difficult to efficiently couple light into a light pipe, as only certain numerical apertures or light ray angles may be guided. In many cases, higher numerical aperture light from the source may spill out near the source, with lower numerical aperture light being transmitted further, resulting in a light pipe that is undesirably brighter at the light-source ends than in the middle. This may also result in different brightness near the source versus in the middle when viewed from different viewing angles. Also because of the limited acceptance angles of light pipes, light sources may need to be somewhat collimated such as by using parabolic reflectors in order to efficiently couple light into the light pipe, disadvantageously adding cost and complexity. Light pipes are generally designed to have low first-pass transmission due to the need to convey light somewhat evenly across the luminaire's length, and may suffer undesirable low efficiency due to absorption internal to the light pipe or at its ends. Light pipes made from prisms may also be difficult to construct, as apparatus for forming and holding the prism film into the desired shape may be complex and may have to interact with the light pipe in some way, causing undesirable loss of light. Designs that include a light scattering element inside the light pipe may suffer from further difficulties in affixing the light scattering element in the desired location. Examples of light-pipe designs include U.S. Pat. No. 4,260,220, U.S. Pat. No. 4,542,449, U.S. Pat. No. 4,615,579, U.S. Pat. No. 4,750,798, U.S. Pat. No. 4,787,708, U.S. Pat. No. 4,791,540, U.S. Pat. No. 4,805,984, U.S. Pat. No. 4,834,495, U.S. Pat. No. 4,850,665, U.S. Pat. No. 4,906,070, U.S. Pat. No. 5,186,530, U.S. Pat. No. 5,309,544, U.S. Pat. No. 5,339,382, U.S. Pat. No. 5,475,785, U.S. Pat. No. 5,483,119, U.S. Pat. No. 5,715,347, U.S. Pat. No. 5,845,037, EP 0855044, U.S. Pat. No. 5,745,632, U.S. Pat. No. 7,658,514.

In U.S. Pat. No. 5,309,544 Saxe illuminates a prism-based light pipe from the side and employs a diffusely reflective light extractor along its interior to scatter light out of angles that will be guided by the light pipe toward a first side of the light pipe. The geometry of the surface is carefully planned such that the direction of travel of light reflected by the extractor will have a projection in the plane perpendicular to the optical axis that makes a fixed predetermined angle with the smooth interior surface of said first side. This requirement to maintain a constant input angle on the inner surface of the prism film is said to maximize efficiency of transmission through said first side. Light that is scattered to any of the other sides of the light pipe will be retroreflected, and must strike the sides and reflector one or more additional times before having another chance to be directed toward said first side. This may result in undesirable reduction of efficiency. The shape is not designed to produce a batwing light distribution, although in some cases it produces a "highly directed" beam of light, defined therein as a beam of light with a larger percentage of the light output in a small angular region. Saxe uses a substantially right-angle (90-degree) prism film.

In U.S. Pat. No. 6,863,420, Schutz describes and outward-facing prism film used to control glare. The light distribution produced is not a batwing, but may be substantially uniform over non-glaring angles, as illustrated by angles $\epsilon_{g1}$ through $\epsilon_{g2}$ in FIG. 11 of the '420 patent. The configuration of the '420 patent creates many reflected rays, as illustrated by label 14 in FIG. 11 of the '420 patent. Such reflected rays may result in low first-pass transmission and reduced efficiency of the luminaire.

In 20130063925, Boonekamp describes the use of a continuously-curved convex 90-degree prism for reduction of glare. The luminaire does not create a batwing distribution. Disadvantageously, the use of 90-degree prisms, a significant portion of which are oriented with bases perpendicular to the light source and hence having a high degree of retroreflection, may cause the luminaire to have low first-pass transmission and poor efficiency.

Additional References

In U.S. Pat. Nos. 7,660,039 and 7,837,361, Santoro et al. disclose diffusers that (a) reduce luminance at high viewing angles (known as glare), and/or (b) produce a 1D or 2D batwing luminous intensity distribution. Santoro uses non-prismatic microstructures, termed "kinoform diffusers," that do not have retroreflection properties like prisms do. These kinoform diffusers have specific angle-bending properties for light rays such that when they are used in specific appropriate configurations, batwing distributions can be created from linear and/or point light sources. In some embodiments of the patents, non-planar and/or curved arrangements of diffusers produce batwing distributions. Kinoform diffusers are discussed in the '039 and '361 patents, and disadvantageously may require complex holographic methods of fabrication. Such methods may be expensive and difficult to control.

In the embodiments of FIG. 25A of the '039 patent and FIG. 25A of the '361 patent, an outwardly-folded diffuser is provided that creates a batwing distribution. The batwing distribution is in all planes, but is predominant in the phi=0 degree plane, parallel to the linear light source. Batwing distributions in the phi=0 plane may be less desirable than batwing distributions in the phi=90 degree plane for linear luminaires. The elongated surface structures of the kinoform diffuser are oriented perpendicular to the light source, and thus the "plane of diffusion" as defined in these patents is parallel to the light source. The embodiment does not use prisms.

In the embodiments of FIG. 27 of the '039 patent and FIG. 27 of the '361 patent, a diffuser comprising two curved sections is provided around a linear light source with opaque light shields on either side and creates a batwing light distribution. The batwing distribution is in all planes, but is predominant in the phi=0 degree plane, parallel to the linear light source. Batwing distributions in the phi=0 plane may be less desirable than batwing distributions in the phi=90 degree plane for linear luminaires. The elongated surface structures of the kinoform diffuser are on the inside surface of the diffuser facing the light source, and are oriented perpendicular to the light source, and thus the "plane of diffusion" is parallel to the light source. The embodiment does not use prisms.

Figure 29:
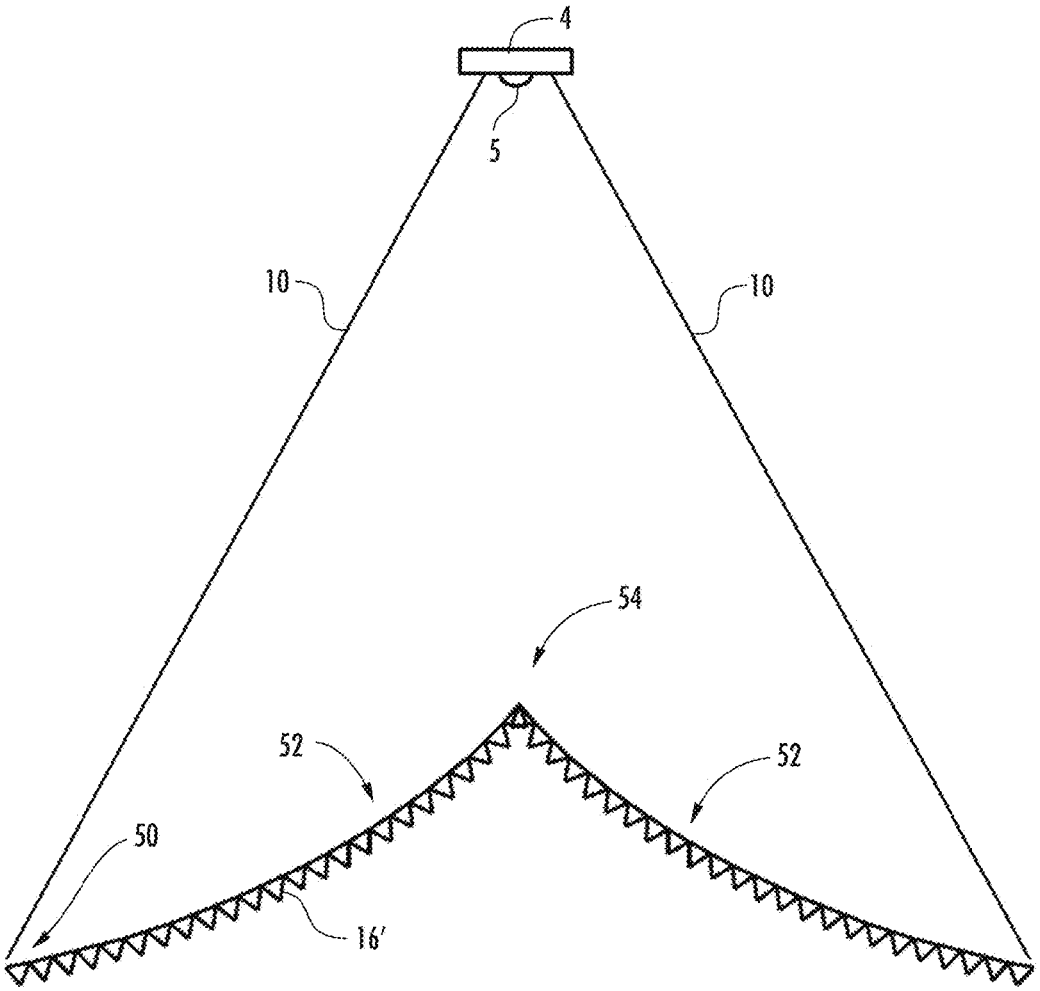
FIG. 29 is a cross-sectional view of a light source and a curved prism optic having an inward-pointed shape with prisms facing away from the light source.

In the embodiments of FIG. 29 of the '039 patent and FIG. 29 of the '361 patent, planar kinoform diffusers are added to either side of the curved diffuser embodiments of FIG. 27 of the '039 patent and FIG. 27 of the '361 patent, and the opaque light shields are removed. The elongated surface structures of the added planar kinoform diffusers are on the outside surface of the diffuser facing away from the light source, and are oriented parallel to the light source, and thus the "plane of diffusion" is perpendicular to the light source. The planar side diffusers may add additional light in a batwing distribution in the phi=90 degree plane perpendicular to the light source. This embodiment disadvantageously uses kinoform diffusers and requires placing them at two different orientations which prevents the use of a single shaped diffuser and may add cost. The embodiment does not use prisms.

Figure 1:
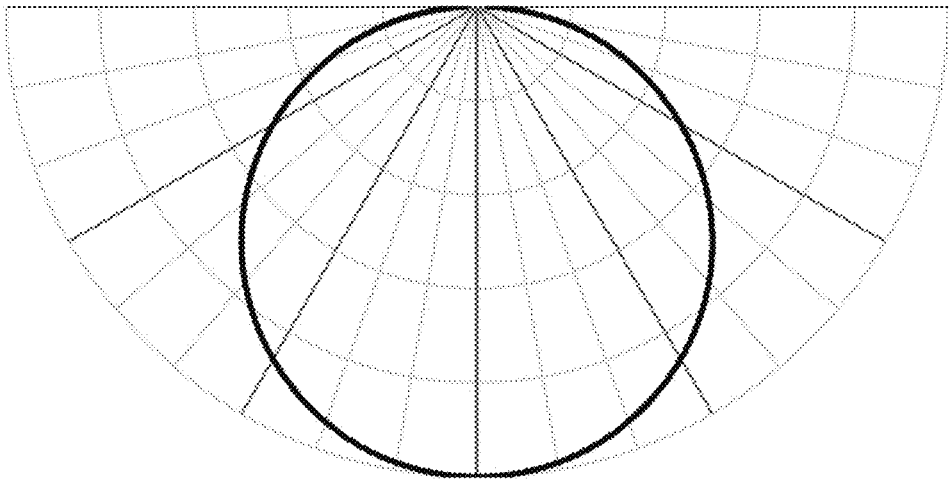
FIG. 1 is a chart illustrating a Lambertian intensity distribution with a Full Width Half Maximum (FWHM) of 120 degrees.
Figure 2:
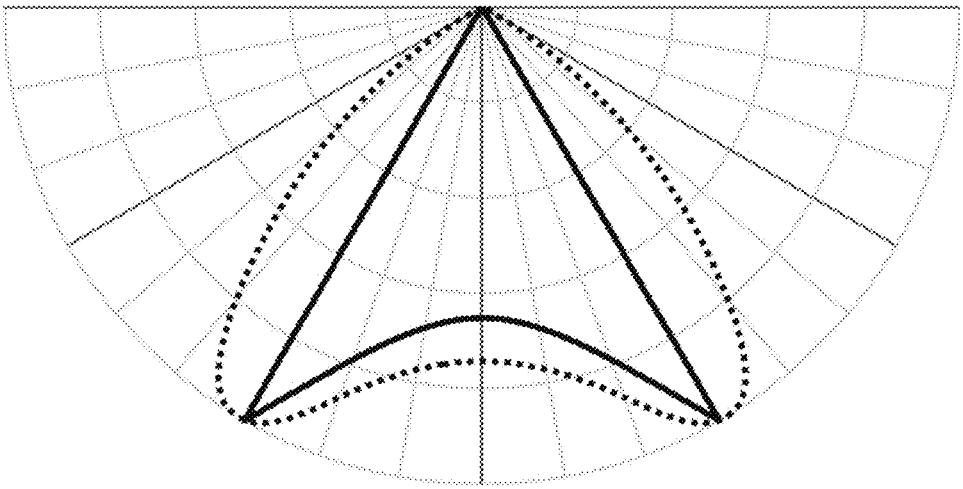
FIG. 2 is a chart illustrating theoretical and practical batwing distributions.
Figure 4:
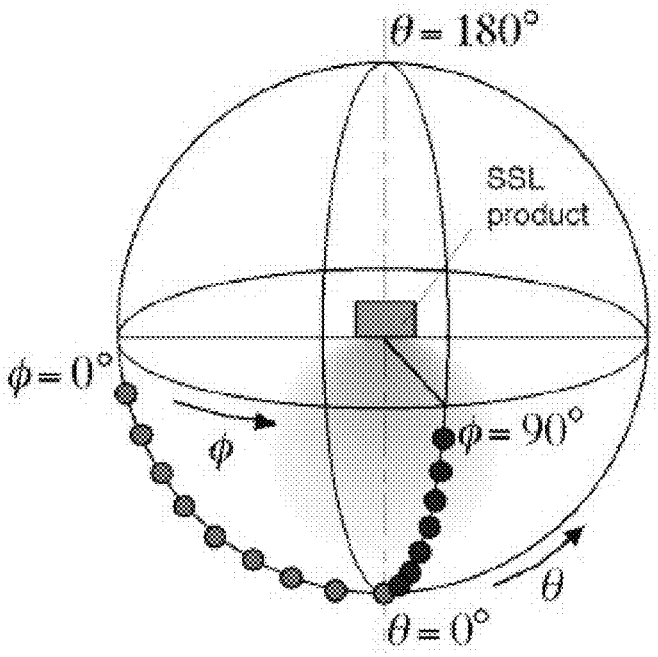
FIG. 4 is a chart illustrating the measurement of light distributions in a spherical coordinate system.
Figure 32:
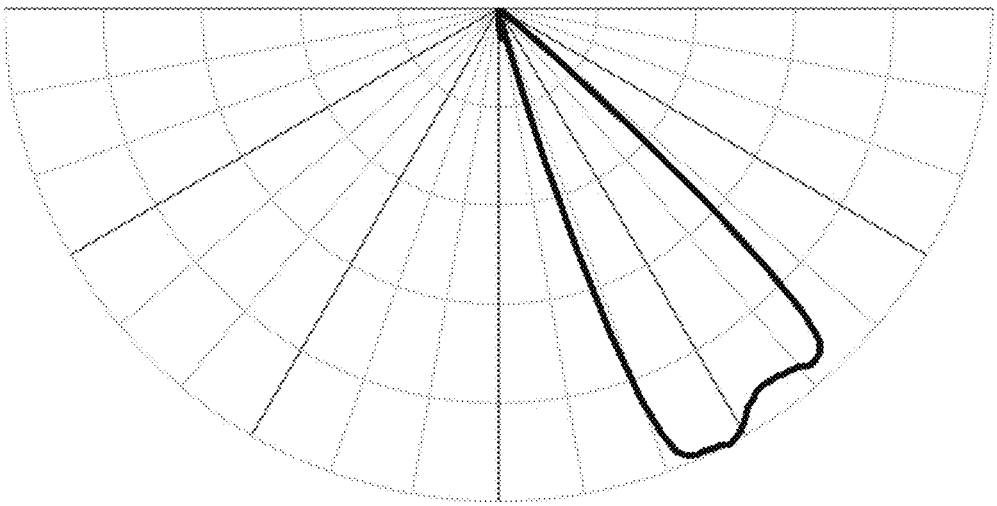
FIG. 32 is a chart illustrating the light distribution after passing through the prism optic of FIG. 31.

In the embodiments of FIG. 32 of the '039 patent and FIG. 32 of the '361 patent, a curved kinoform diffuser positioned below a linear light source, and planar kinoform diffusers are placed on either side of said curved diffuser. A batwing distribution in the phi=90 degree plane perpendicular to the light source is formed. The elongated surface structures of the kinoform diffuser are on the outside surface of the diffuser facing away from the light source, and are oriented parallel to the light source, and thus the "plane of diffusion" is perpendicular to the light source. Further teachings about this embodiment in the '361 patent including FIGS. 32-1 through 32-4 show that the central curved region does not contribute to the batwing distribution, but rather has a Lambertian-like distribution similar to the light source, the batwing distribution being generated substantially by the planar kinoform diffusers on the sides. The embodiment does not use prisms.

In the embodiments of FIGS. 32-5, 32-6A, and 32-6B of the '361 patent, the embodiments of FIG. 32 of the '039 patent and FIG. 32 of the '361 patent are modified, replacing the curved center section with a central planar diffuser that may be offset from the planes of the side diffusers. The central planar diffuser does not create a batwing distribution and may be of a type other than a kinoform diffuser, including a sandblasted diffuser or perforated metal. A batwing distribution in the phi=90 degree plane perpendicular to the light source is formed, the batwing distribution being generated substantially by the planar kinoform diffusers on the sides. The embodiment does not use prisms.

In the '039 patent, the diffuser may need to include multiple light scattering elements, "on each of which are one or more sub-elements." In practice these sub-elements may be very difficult to create and control. Advantageously, various embodiments described herein do not require kinoform diffusers and do not require such sub-elements. Advantageously, various embodiments described herein employ prism films that are widely and inexpensively available.

In U.S. Pat. No. 8,047,673, Santoro describes a light control device implemented with multiple planar diffusers. The light control devices and luminaires disclosed create 1D batwing light distributions by means of a central lamp, multiple diffusers, and openings with carefully designed placement. These patents do not use a non-planar prism optic with prisms facing away from the light source. The individual diffusers of the luminaire do not create batwing distributions. Rather the distribution is created using the diffusers, lamp, openings, and internal reflections working collectively, and thus is distinct from various embodiments described herein, which can create 1D batwing distributions from non-planar shaped outward-facing prism elements.

In U.S. Pat. No. 6,612,723, Futhey et. al. create substantially collimated distributions, using linear light sources and inward-facing prisms formed in various shapes to direct light in a direction substantially perpendicular to the luminaire. They do not create batwing light distributions.

In U.S. Pat. No. 7,537,374 and U.S. Pat. No. 7,815,355, backlights are described in which a curved transflective (partially transmissive and reflective) optic is formed in a shallow curve to more uniformly illuminate the backlight. In some embodiments, prism films may be used for the curved transflective optic, but in those cases the prism film is said to be preferably inward-facing. The patent not produce a batwing light distribution pattern.

In U.S. Pat. Nos. 7,261,435 and 7,229,192, Mayfield et. al. disclose a luminaire that uses a curved lens containing linear shapes, in either inward-facing or outward-facing orientations to optically reduce the surface brightness of the light source, provide diffused non-batwing illumination, and reduce light at high angles (glare). Most preferred embodiments use rounded lenses rather than triangular prisms with a short focal length intended to provide even diffusion. The lenses do not produce a batwing distribution.

In U.S. Pat. No. 6,280,052, White describes a curved optic consisting inward-facing prisms arranged in a pointed shape that has two symmetric halves both of which are convex facing toward the lamp. The luminaire produces a distribution that is approximately uniform over all angles, and thus is not a batwing light distribution.

CN 202532218 U discloses a lamp structure with batwing light intensity distribution. The lamp structure comprises at least two light-emitting diode (LED) groups, a light guide plate, a reflecting part and a prism sheet, and is characterized in that: the light guide plate is provided with a first surface and a second surface; and the first surface is provided with a micro structure. Distribution in a way that both sides are sparse while middle is dense is adopted, so that the refraction angle of light rays is changed, and the light rays are refracted out of the light guide plate. Light rays are uniformly scattered effectively through the geometric structure on the prism sheet facing the light guide plate, so that batwing light intensity distribution is achieved.

Potential Advantages

Various embodiments described herein can create useful light distributions including a 1D linear batwing light distribution using a prism optic with

- Prisms oriented substantially parallel to linear light source
- Prisms outward-facing, i.e. on the surface facing away from the light source
- Prisms formed into an extended non-planar shape with cross section in the plane perpendicular to the light source.

Various embodiments described herein can contain at least one section of continuously-curved outward-facing prism.

Various embodiments described herein can create batwing light distributions using inexpensive commercially-available prism films.

Various embodiments described herein can create narrow or collimated light distributions.

Various embodiments described herein can have the prism film shape chosen such that few or substantially none of the prisms are oriented such that their bases are perpendicular to light rays emitted by the light source into said prisms.

Various embodiments described herein can create useful light distributions including a 1D linear batwing light distribution using a prism optic with a substantially linear light source, the prisms oriented substantially parallel to the long axis of the light source.

Various embodiments described herein can create useful light distributions including a 1D linear batwing light distribution using a prism optic with two or more substantially parallel substantially linear light sources, the prisms oriented substantially parallel to the long axis of the light source.

Various embodiments described herein can provide a contiguous or monolithic prism optic that can create useful light distributions including a 1D linear batwing light distribution.

Various embodiments described herein can provide a prism optic with high optical transmission, having substantially no light-absorbing materials.

Various embodiments described herein can provide a prism optic with high optical transmission, having prism orientations chosen to minimize retro-reflection of light back into the interior of the luminaire.

Various embodiments described herein can provide a prism optic that obscures or helps obscure light sources, including but not limited to LEDs and fluorescent lamps.

Various embodiments described herein can provide a prism optic than can be efficiently and inexpensively mass-produced in areas large enough to be suitable for use in general lighting.

Various embodiments described herein can provide a prism optic that reduces luminance at high viewing angles relative to a linear source.

Various embodiments described herein can provide a prism optic that creates a one-sided distribution suitable for applications including wall-wash and/or cove lighting.

Various embodiments described herein can provide a prism optic which creates desired light distributions including batwing distributions and one-sided distributions when used with appropriately configured specular or diffuse reflectors.

Various embodiments described herein can provide a luminaire employing a prism optic, the luminaire emitting light into a batwing distribution.

Various embodiments described herein can provide a luminaire employing a prism optic, the luminaire emitting light into a one-sided distribution suitable for applications such as wall-wash and/or cove lighting applications.

Various embodiments described herein can provide a luminaire employing multiple light sources and prism optics, the light sources and prism optics cooperating to provide a batwing light distribution.

Various embodiments described herein can provide a luminaire with a distinct visual appearance that may be pleasing to a viewer.

Measurement

Light distributions are typically measured using goniometric apparatus similar to that described in the IES LM-79 standard, as illustrated in FIG. 4. In FIG. 4, a luminaire or illuminated optical device is depicted (labeled SSL product) emitting light in a downward dimension. The two circles with dots on their perimeters represent planes at two different azimuthal angles $\phi$ (phi). In each of these planes, the polar angle $\theta$ (theta, ranging from −180 to 180 degrees) is defined as indicated. Example measurement points in the phi=0 degree and phi=90 degree planes are depicted as dots. At each of these points, luminous intensity is measured as a function of the theta angle from the principle axis of the light source. This luminous intensity is measure by an optical detector, the optical detector and/or light source moved relative to each other so that the optical detector measures light at the desired angles. In practice a light distribution can be measured at any group of phi and theta points desired. Many lights emit substantially in one hemisphere, and thus theta will often be measured from −90 to 90 degrees.

General Description

Various embodiments described herein can provide a prism optic comprising a substrate having a first and second surface, the first surface having pattern elements comprising a plurality of substantially parallel, linear prismatic structures, or prisms, said substrate shaped into a non-planar shape such that the prisms are parallel to one or more linear light sources.

In many embodiments, the prisms are substantially isosceles triangular in cross-section, and may include other features such as a rounded tip and/or valley, or surface roughness.

Figure 5:
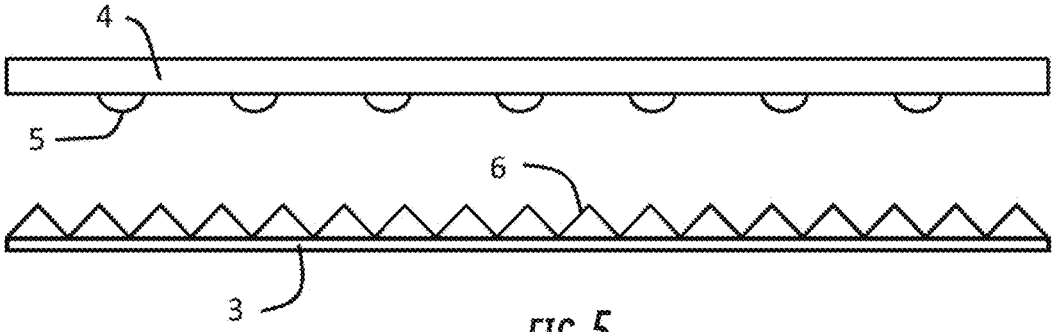
FIG. 5 is a cross-sectional view of a light source and a planar prism optic with prisms facing the light source.
Figure 6:
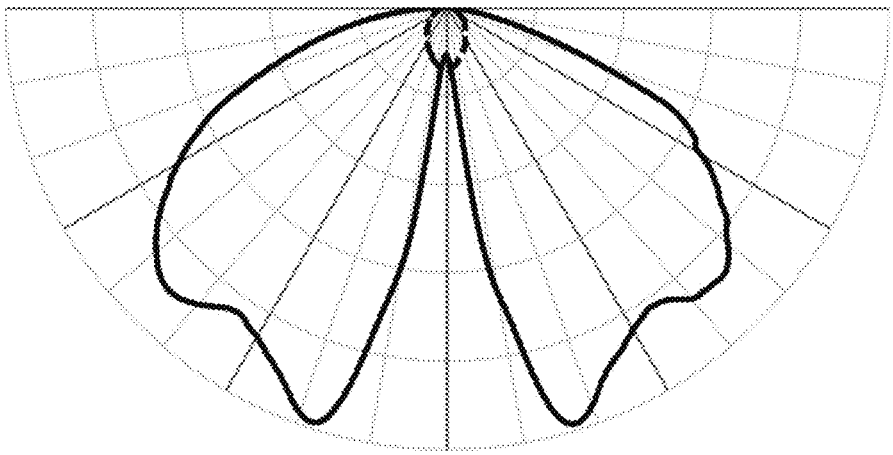
FIG. 6 is a chart illustrating the light distribution after passing through the prism optic of FIG. 5.

In a first laboratory experiment, the present inventors tested a commercial planar 90-degree prism optic 3 with an extended Lambertian source 4 comprising an array of unfocused LEDs 5, as shown cross-sectionally in FIG. 5. The prisms 6 had refractive index 1.6 and approximately 25 micron pitch. Confirming the data presented in FIG. 3C, FIG. 6 shows the light intensity distribution measured by the present inventors by illuminating a planar prism film with an extended Lambertian LED light source, with the prism side facing the light. The prisms 6 are depicted as triangles and are not presented to scale. The solid line represents the measurement made in a plane designated phi=90 degrees that is perpendicular to the orientation of the linear prisms on the prism film and is similar to a batwing distribution. The dashed line shows the phi=0 degree plane parallel to the prism orientation, and shows the output distribution is Lambertian. This use of a prism film is known in the art.

In FIG. 5 and other figures herein, prisms are not drawn to scale, so as to allow clear illustration of their inward-facing or outward-facing orientation.

Figure 7:
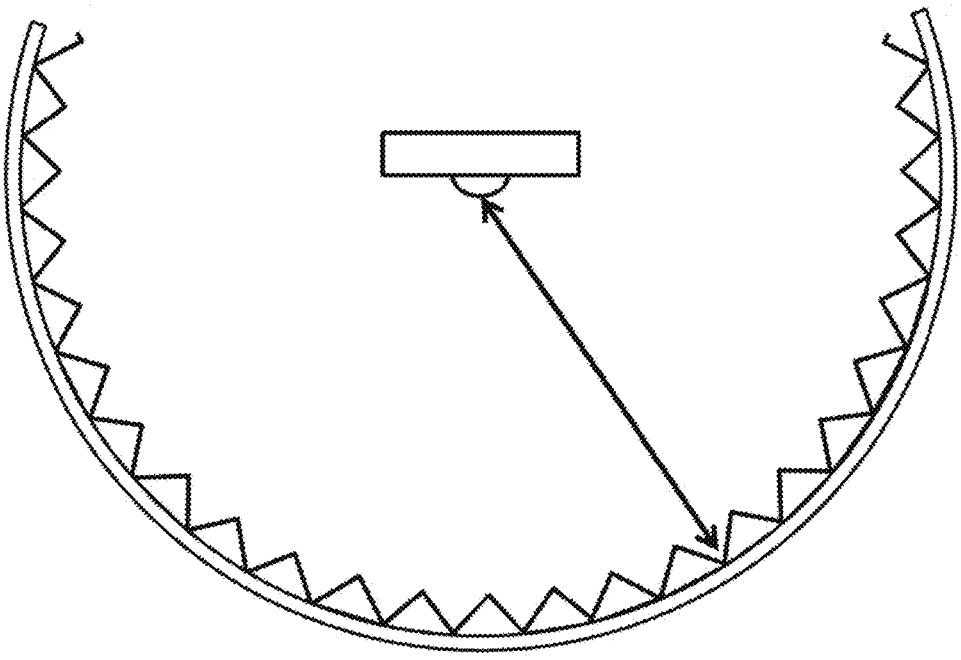
FIG. 7 is a cross-sectional view of a light source and a curved prism optic having a cylindrical shape with prisms facing the light source.
Figure 8:
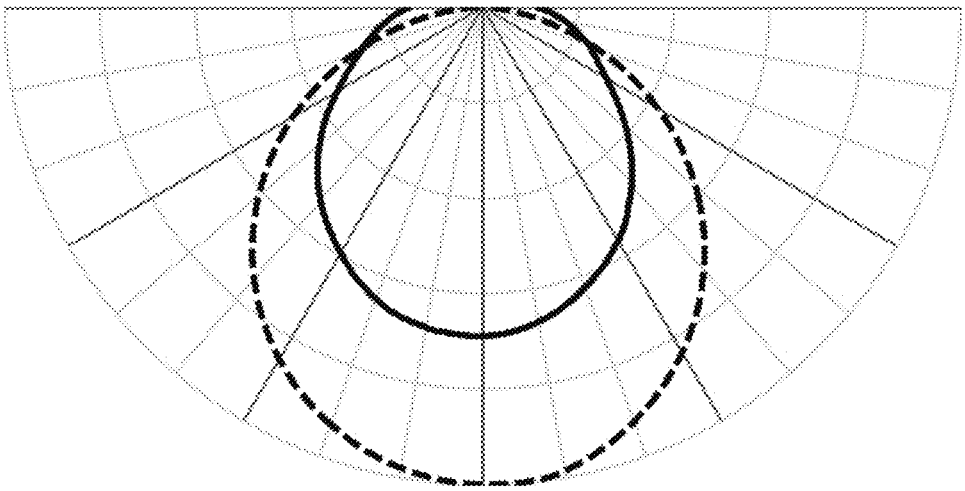
FIG. 8 is a chart illustrating the light distribution after passing through the prism optic of FIG. 7.

Desiring a curved version of the experiment shown in FIG. 5, in a second laboratory experiment a prism film was curved around a linear light source. The prism optic is concave relative to the light source. The experiment included a linear light source (a line of LEDs) and a 90-degree prism optic curved into a circular cylinder 8.5 inches in diameter with its center coincident with the linear light source and the prisms oriented parallel to the light source. The prisms had refractive index 1.49. A cross-section of this luminaire is shown in FIG. 7. As with the first experiment of FIG. 5, the prisms faced inward toward the light source. The light distribution produced by this solution is shown in FIG. 8. The dashed line represents the measurement of the light source alone, made in a plane designated phi=90 degrees (perpendicular to the long dimension of the light source). The solid line represents the measurement including the prism optic, also made in a plane designated phi=90 degrees. This second experiment failed to produce a batwing light distribution.

Figure 9:
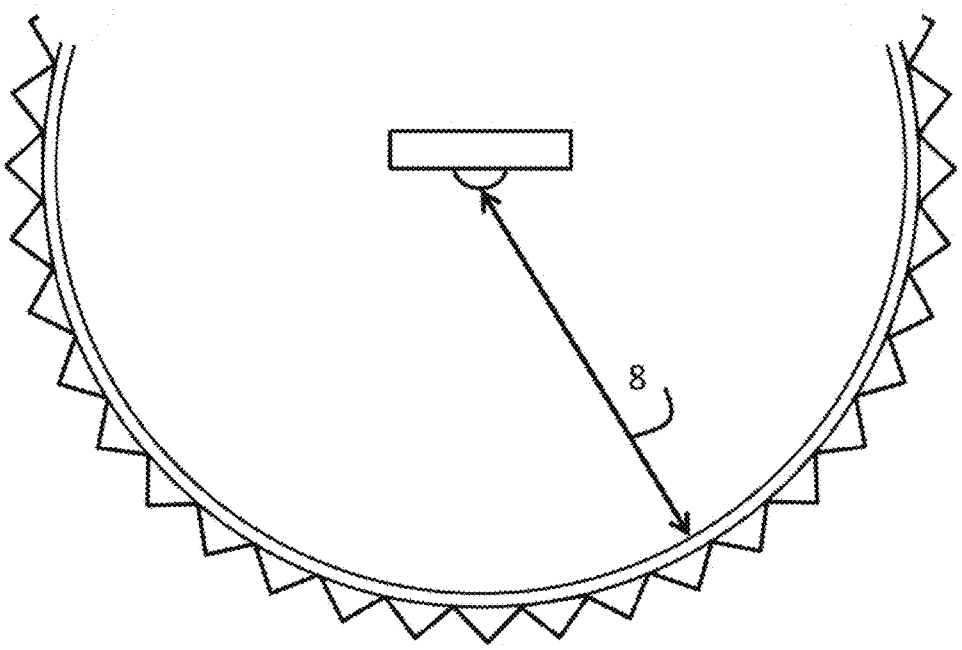
FIG. 9 is a cross-sectional view of a light source and a curved prism optic having a cylindrical shape with prisms facing away from the light source.
Figure 10:
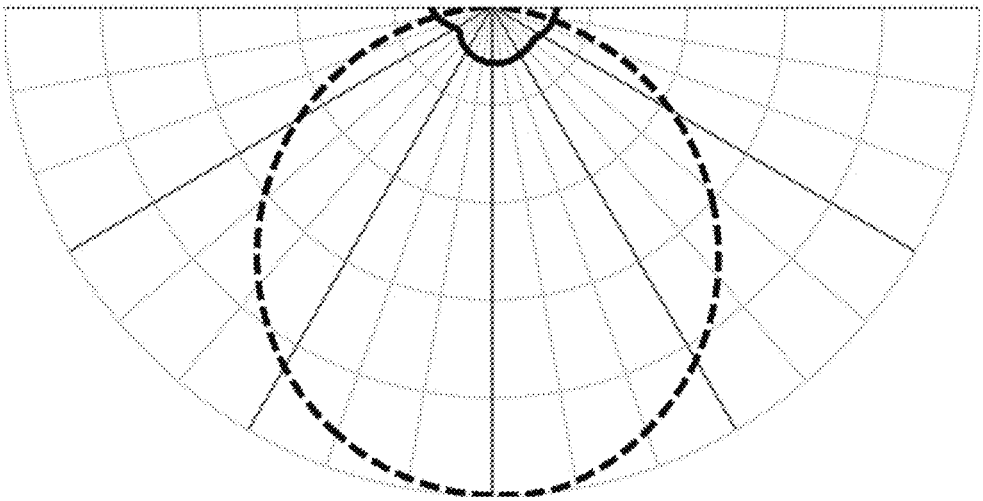
FIG. 10 is a chart illustrating the light distribution after passing through the prism optic of FIG. 9.

In a third laboratory experiment, the orientation of the 90-degree prism film used in the second experiment was reversed. As shown cross-sectionally in FIG. 9, a linear light source was used with a prism optic curved into a circular cylinder 8.5 inches in diameter with its center coincident with the linear light source. The prism optic is concave relative to the light source. Arrow 8 represents the radius of the cylinder and shows that the center of the cylinder is coincident with the light source. In this third experiment, the prisms were parallel to and faced outward away from the linear light source. The prisms had refractive index 1.49. The light distribution produced by this solution is shown in FIG. 10. The dashed line represents the measurement at phi=90 degrees of the light source alone. The solid line represents the measurement at phi=90 degrees including the prism optic. The outward-facing prisms caused very low light transmission. A luminaire built on this design may have unacceptably low efficiency. This third experiment failed to produce a batwing light distribution.

DETAILED DESCRIPTION OF EMBODIMENTS

Various embodiments described herein are based on the surprising finding, after the failure of the third laboratory experiment using outward-facing prisms, that arrays of outward-facing parallel prisms in certain cross-sectional shapes can create useful light distributions including batwing light distributions.

Figure 11A:
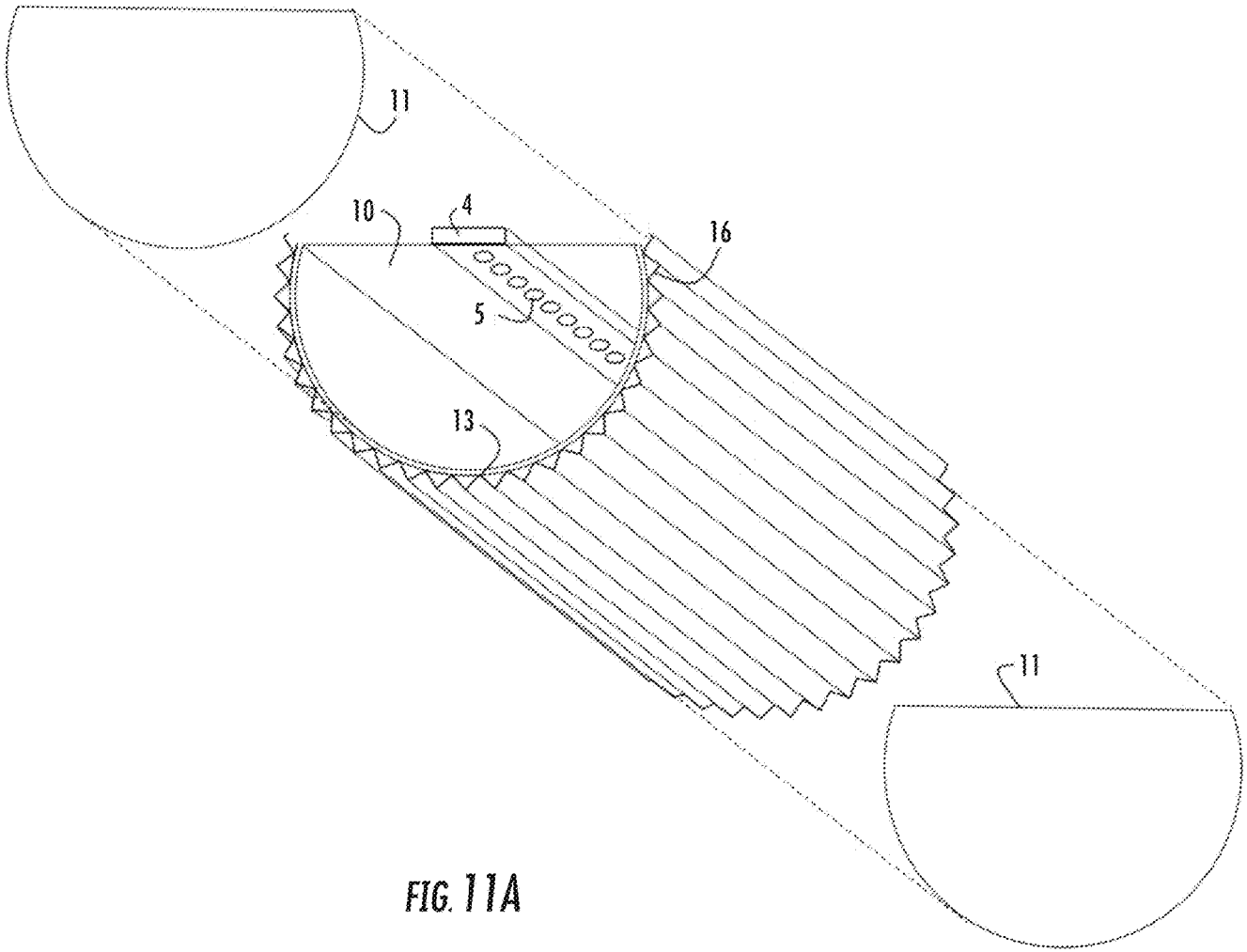
FIG. 11A is a perspective view of a light source and a curved prism optic having a cylindrical shape with prisms facing away from the light source.
Figure 11B:
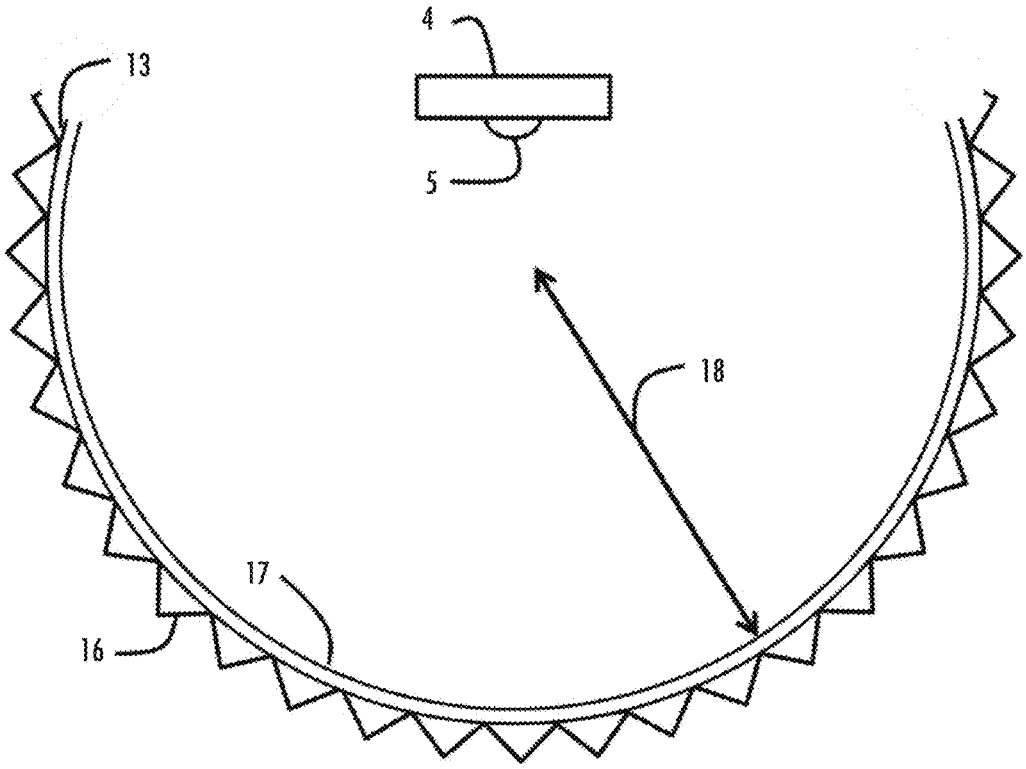
FIG. 11B is a cross-sectional view of the light source and curved prism optic of FIG. 11A.
Figure 12:
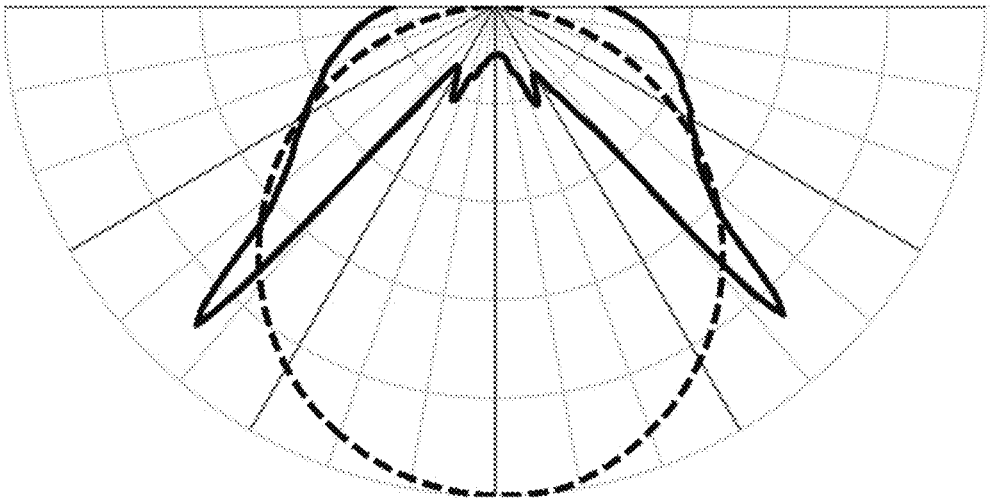
FIG. 12 is a chart illustrating the light distribution after passing through the prism optic of FIGS. 11A and 11B.

In one embodiment, a 90-degree prism optic 13 was curved into a circular cylinder 8.5 inches in diameter as shown in exploded view in FIG. 11A and cross-sectionally in FIG. 11B. The prism optic 13 was curved into a cylinder with its center parallel to and 1.5 inches in front of a linear light source 4. The prism optic is concave relative to the light source. In FIG. 11B, the radius of the curved prism optic is indicated by arrow 18. The source included a linear array of LEDs 5. The linear array of LEDs included ¼ watt LEDs arranged in one line with 17 mm spacing. The LEDs were mounted on a circuit board which was in thermal contact with a heat sink. The LED and prism optic were approximately 12 inches long. It is understood that the luminarie can be made substantially any length. The LEDs were white-light LEDs consisting of blue LEDs with visible-light phosphors as known in the art. The LEDs emitted light into substantially 120 degree symmetric Lambertian distribution. The prisms 16 were approximately 25 microns in pitch, and are exaggerated in size for clarity in the figure. The prisms faced outward away from the light source 4 and had refractive index 1.49. The light distribution produced by this configuration was measured and is shown in FIG. 12. The dashed line represents the measurement at phi=90 degrees of the light source alone, and is approximately Lambertian. The solid line represents the measurement at phi=90 degrees including the prism optic. Surprisingly, although similar to the third laboratory experiment, this embodiment produced an approximately batwing distribution, and had light transmission significantly greater than that of the third experiment. First-pass transmission, the amount of light transmitted through the prism optic without aid from a reflector inside the light, is estimated to be 55%. In a related embodiment, a reflector 10 and reflective end caps 11 are added to improve efficiency by reflecting light that does not strike the prism optic or is reflected by the prism optic.

Although the light source used was a linear array of LEDs, it is understood that other approximately linear light sources can be used in the present invention, including fluorescent lamps with or without additional reflectors, organic light-emitting diode (OLED) sources, substantially linear light guides illuminated by LEDs or other sources. Light sources may emit into 360 degrees in the plane normal to the linear light source, or 180 degrees in the plane normal to the linear light source, or any other angle. Preferably, the emission angle in the plane normal to the linear light source is wide enough to illuminate substantially the entire prism optic. When LEDs are used, it is understood that LEDs can be of any light distribution wide enough to illuminate substantially the entire prism optic, as are commercially available from CREE, Philips Lumileds, Nichia, Samsung, Osram Opto Semiconductors, LG Innotek, Seoul Semiconductor, Sharp, TG, Everlight, and other LED manufacturers. The LEDs can all have one color, or can be a mix of colors such as red, green, blue (RGB) arrays or combinations of LEDs at different color points as known in the art.

It will be understood that all embodiments presented in cross-section herein represent a three-dimensional luminaire such as depicted in FIG. 11A, and can be fitted with end caps. In other embodiments, luminaires are created including a curved outward-facing prism optic, a linear light source, and additional luminaire components known in the art including housings, power supplies, controls, light sensors, heat sinks, decorative elements, protective covers, power cables, airflow vents, and means of affixing to a surface such as clips for a suspended ceiling, surface-mount hardware, or suspension hardware.

Figure 13:
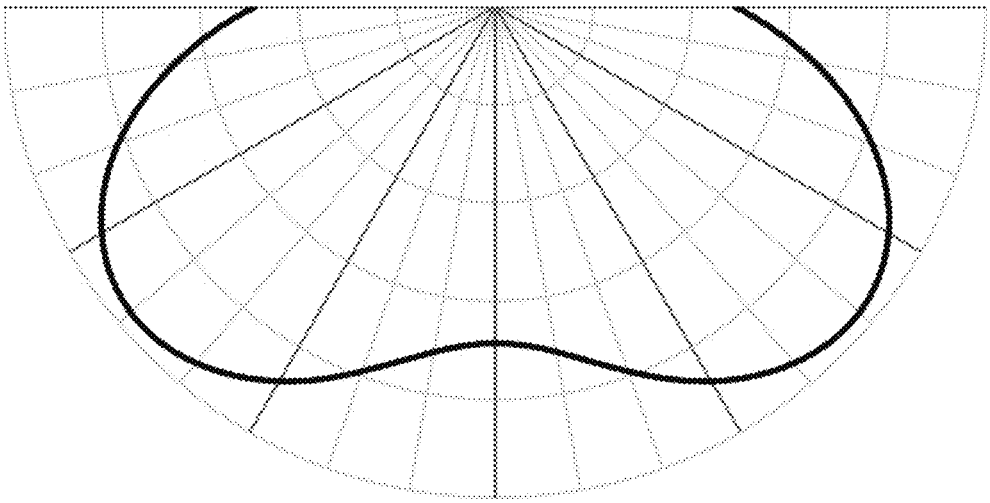
FIG. 13 is a chart illustrating the light distribution after passing through the prism optic of FIGS. 11A and 11B with a diffuser on the surface opposite the prisms.

In another embodiment, a 90-degree prism optic was curved into a circular cylinder 8.5 inches in diameter with its center parallel to and 1.5 inches in front of a linear light source in a manner similar to the cross-section of FIG. 11B. The prisms faced outward away from the light source and had refractive index 1.49, and a conventional microstructured 30-degree diffuser was provided on the surface 17 of the prism optic 13 opposite the prisms 16. The microstructured diffuser is not shown in the figure. The prism optic is concave relative to the light source. The light distribution produced by this embodiment was measurement at phi=90 degrees and is shown in FIG. 13. This embodiment produced a batwing distribution that is smoother than the distribution of FIG. 12 due to the addition of the diffusive inner surface. Also unexpectedly, the illuminated curved diffuser took on an unusual and attractive visual appearance which resembled a uniformly diffuse approximately 6-inch cylindrical bright source situated inside an 8.5 inch transparent cylinder. The visual appearance changed when viewed from different angles in the phi=90 degree plane in a manner that may be pleasing to a viewer. First-pass transmission is estimated to be 60%.

Figure 14:
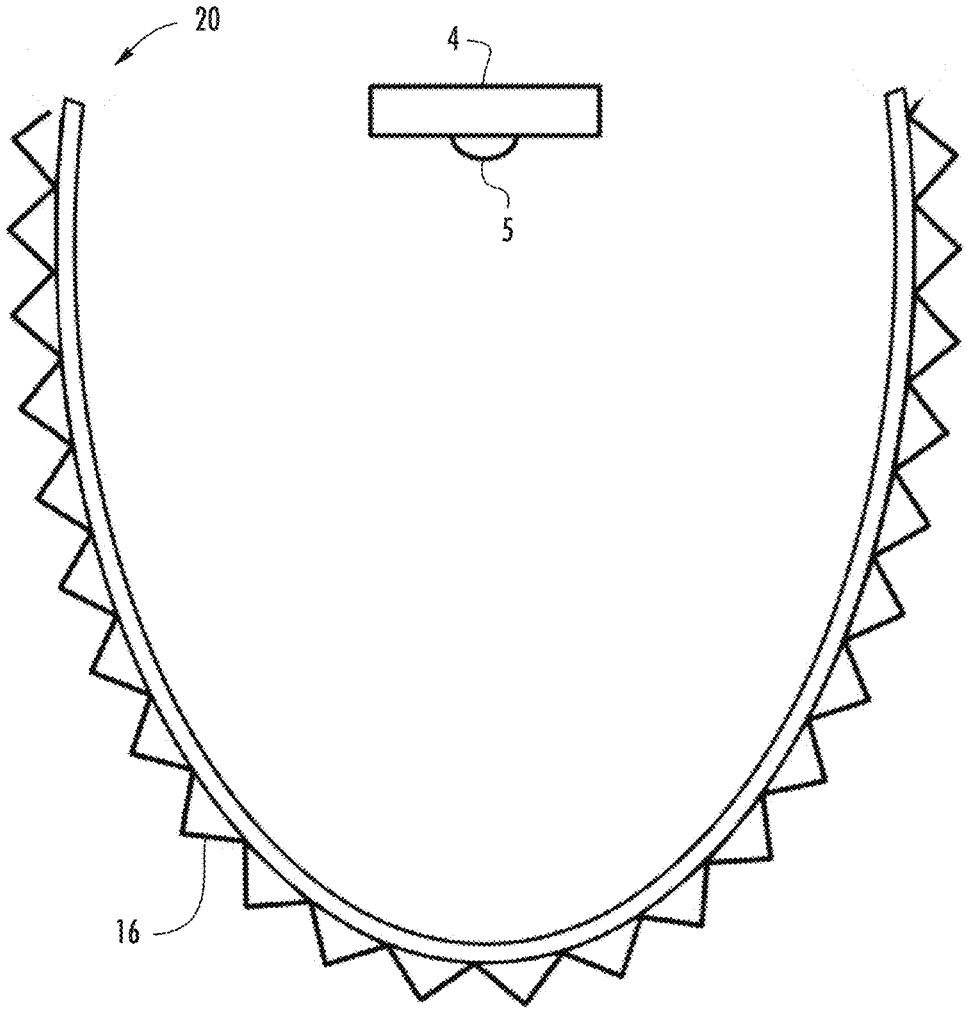
FIG. 14 is a cross-sectional view of a light source and a curved prism optic having an elliptic cylindrical shape with prisms facing away from the light source.
Figure 15:
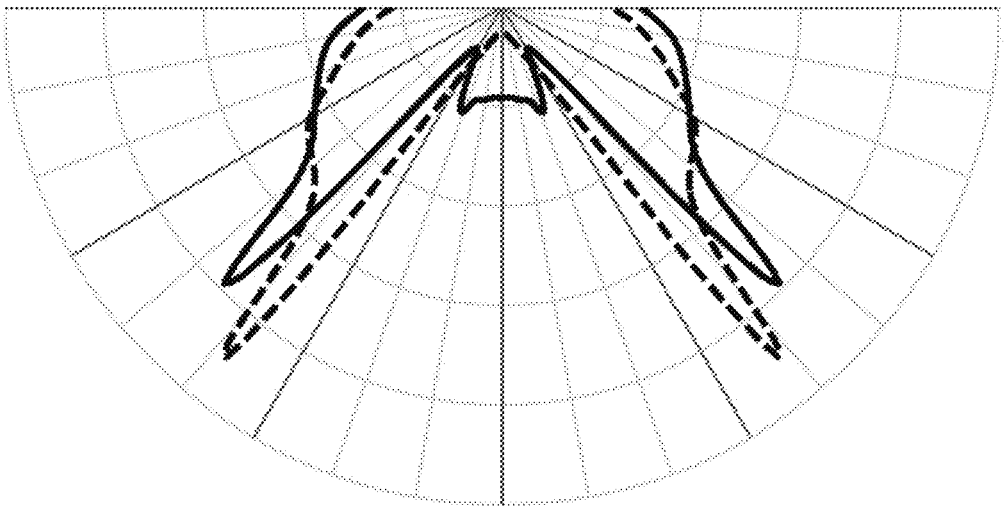
FIG. 15 is a chart illustrating the light distribution after passing through the prism optic of FIG. 14.

In another embodiment, a 90-degree prism optic 20 was curved into an approximately elliptic cylinder shape with major axis approximately 8.5 inches and minor axis approximately 6.5 inches around a linear light source 4 as depicted cross-sectionally in FIG. 14. The prisms 16 faced away from and were oriented parallel to the light source 4 and had refractive index 1.6. The prism optic 20 is concave relative to the light source 4. The light source 4 was placed at the center of the elliptical cross-section. The resulting light distribution measurement at phi=90 degrees shown in the solid line of FIG. 15. First-pass transmission is estimated to be 50%. In a related embodiment, the light source 4 was moved to a location 0.75 inches behind the center of the ellipse, the resulting light distribution measurement at phi=90 degrees shown in the dashed line of FIG. 15. First-pass transmission is estimated to be 60%. Surprisingly both of these configurations resulted in approximately batwing distributions, with the angular spread between the peaks apparently adjustable by moving the location of the light source.

Figure 16:
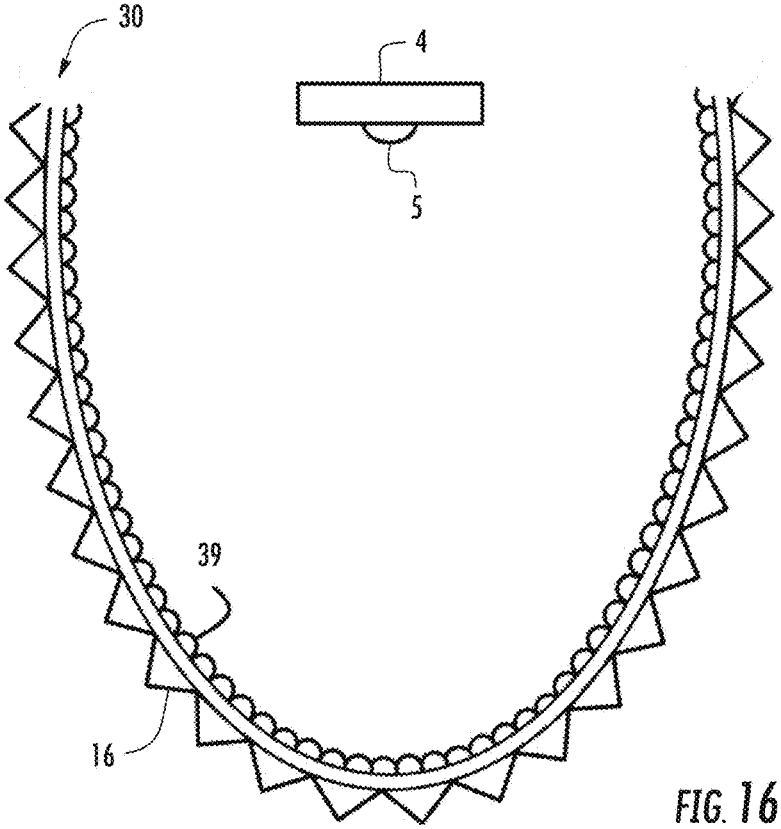
FIG. 16 is a cross-sectional view of a light source and a curved prism optic having an elliptic cylindrical shape with prisms facing away from the light source and a diffuser on the surface opposite the prisms.
Figure 17:
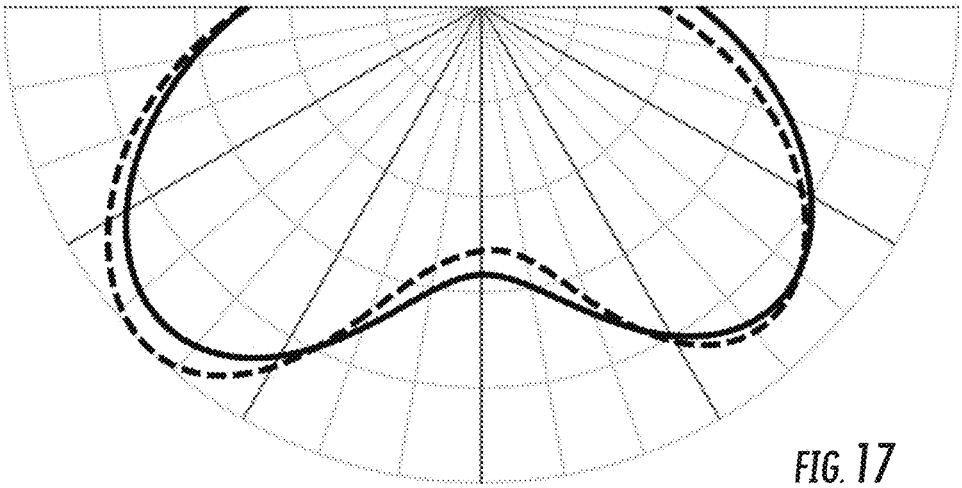
FIG. 17 is a chart illustrating the light distribution after passing through the prism optic of FIG. 16.

In another embodiment a 90-degree prism optic 30 was curved into an approximately elliptic cylinder shape with major axis approximately 8.5 inches and minor axis approximately 6.5 inches around a linear light source 4 as depicted cross-sectionally in FIG. 16. The prisms 16 faced away from and were oriented parallel to the light source 4 and had refractive index 1.49. The prism optic 30 is concave relative to the light source 4. A conventional microstructured 30-degree diffuser was provided on the inner surface of the diffuser facing toward the light source, depicted schematically as semicircles 39 in FIG. 16. The light source 4 was placed at the center of the elliptical cross-section, the resulting light distribution measurement at phi=90 degrees shown in the solid line of FIG. 17. Some asymmetry is visible in the curves due to imperfections in the laboratory experiment. First-pass transmission is estimated to be 60%. In a related embodiment, the light source 4 was moved to a location 0.75 inches behind the center of the ellipse, the resulting light distribution measurement at phi=90 degrees shown in the dashed line of FIG. 17. First-pass transmission is estimated to be 70%. Surprisingly both of these configurations resulted in approximately batwing distributions. Again, unexpectedly, the curved prism optic took on an unusual and attractive visual appearance similar to a diffuse source floating inside a curved clear component that may be pleasing to a viewer.

Figure 18:
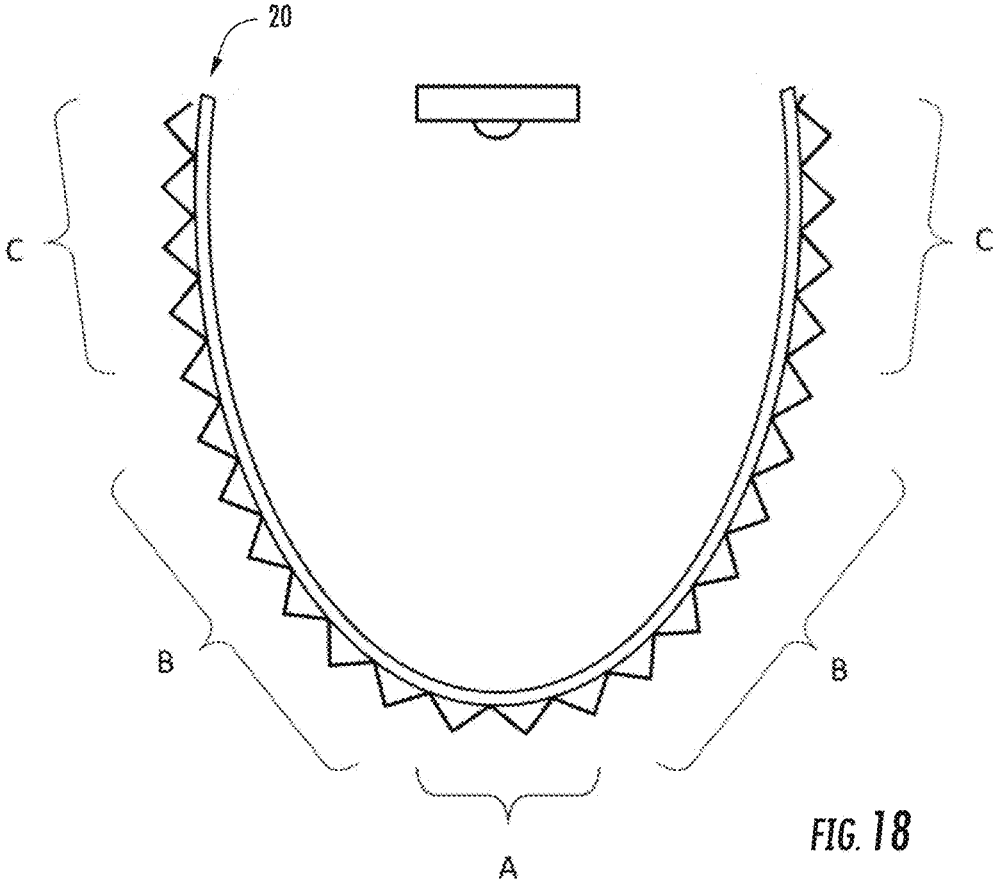
FIG. 18 is a cross-sectional view illustrating regions of a curved prism optic having an elliptic cylindrical shape.

Experimentation revealed that different parts of the elliptic cylinder prism optic were contributing to different features in the light output distribution. In FIG. 18, the elliptical prism optic 20 has been divided into three approximate regions. Region A did not contribute significantly to the useful batwing light distribution and may have resulted in lower efficiencies, possibly due to retroreflection by prisms that are oriented facing directly toward the light source. It is desirable to minimize such retroreflection through choice of film shape, by avoiding placing prisms in retroreflecting orientations and/or through choice of prism internal angle. Regions B contributed strongly to the batwing light distribution, and in Region B the prism optic is concave relative to the light source. Regions C contributed to the distribution but also contributed unwanted glare.

Figure 19A:
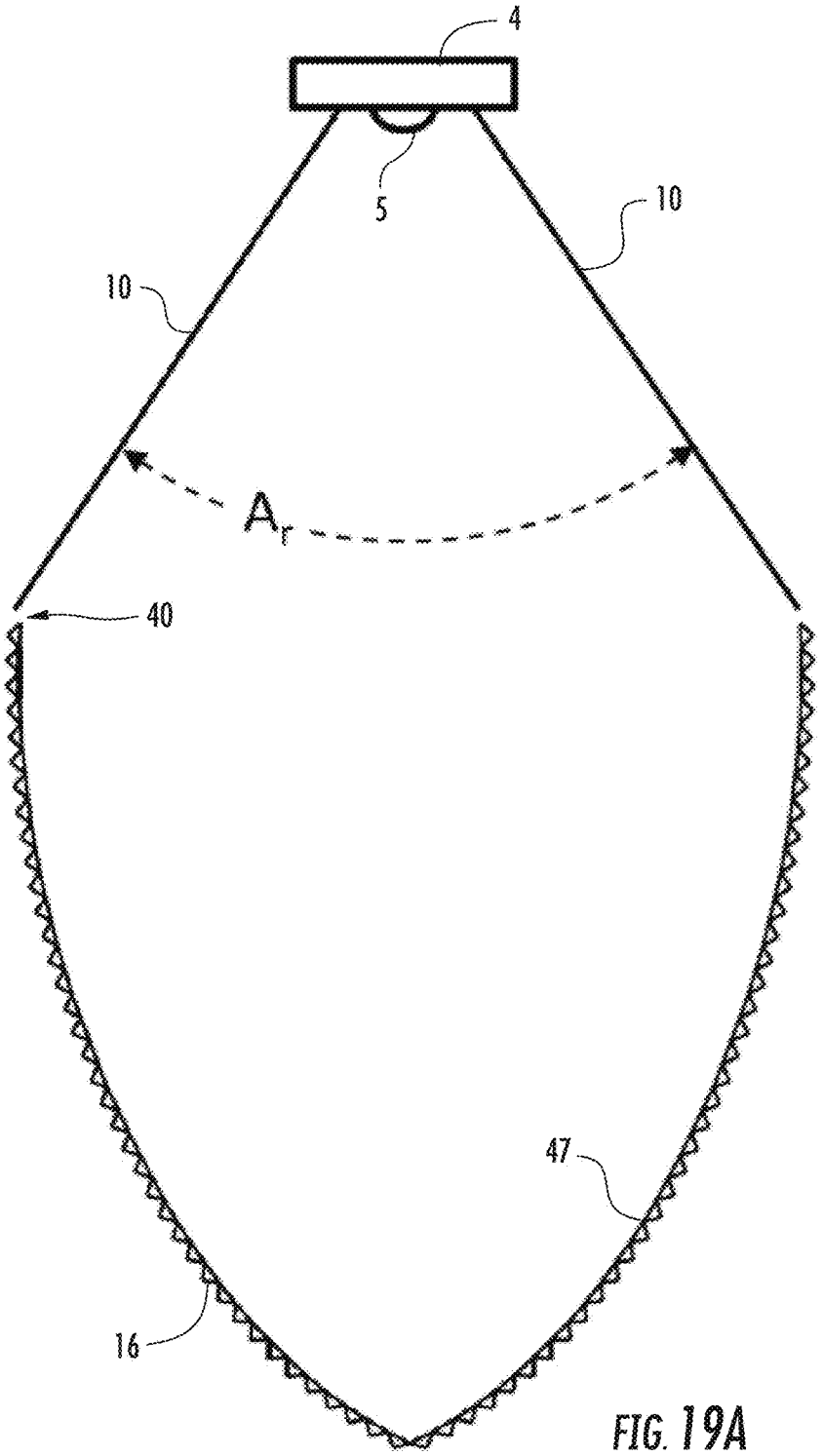
FIG. 19A is a cross-sectional view of a light source and a curved prism optic having a pointed arch shape with prisms facing away from the light source.
Figure 19B:
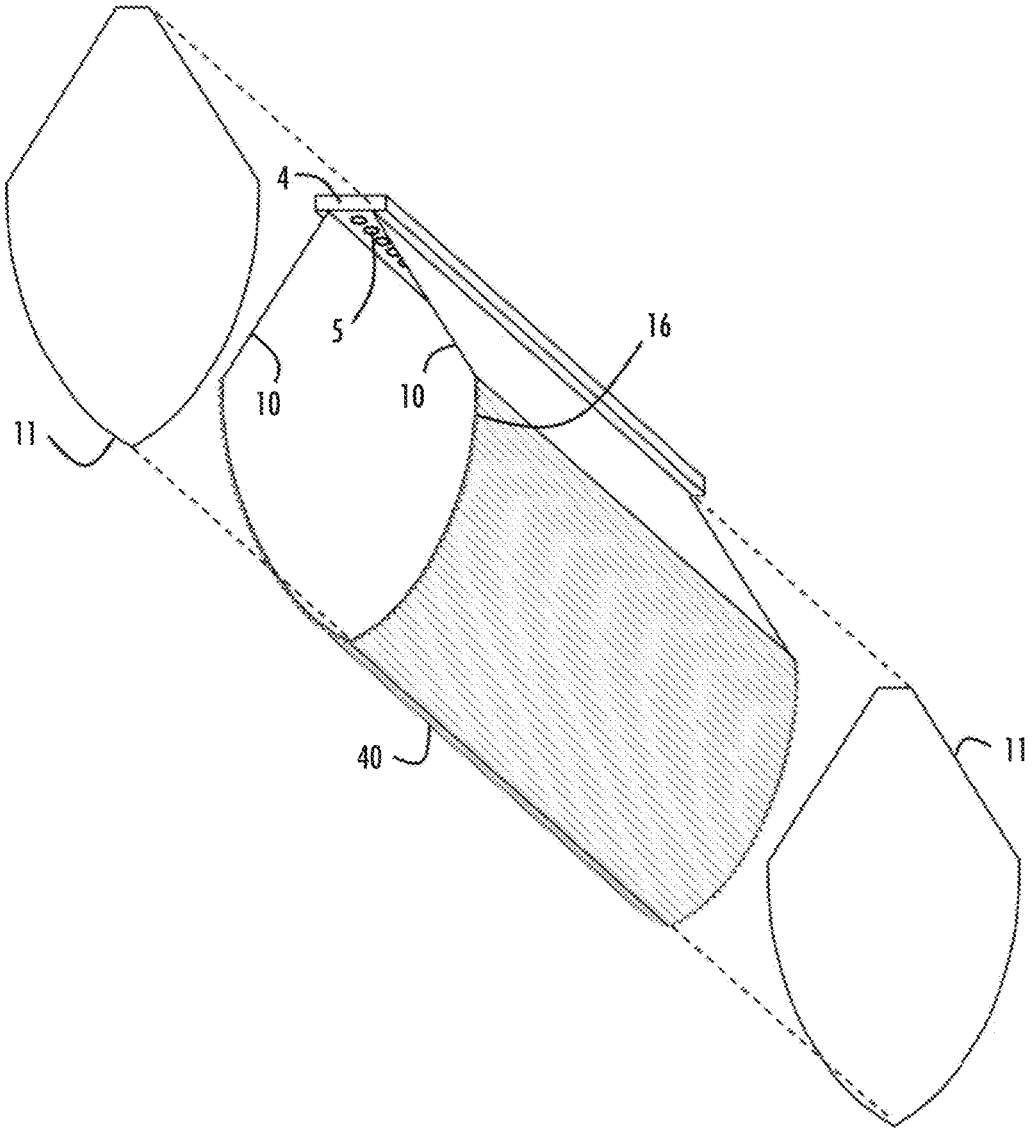
FIG. 19B is a perspective view of the light source and curved prism optic of FIG. 19A.
Figure 20:
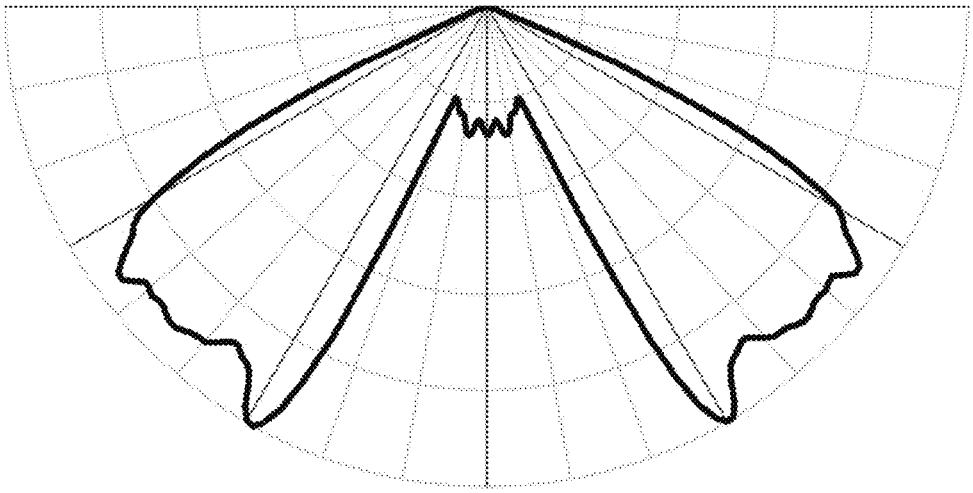
FIG. 20 is a chart illustrating the light distribution after passing through the prism optic of FIGS. 19A and 19B.
Figure 21:
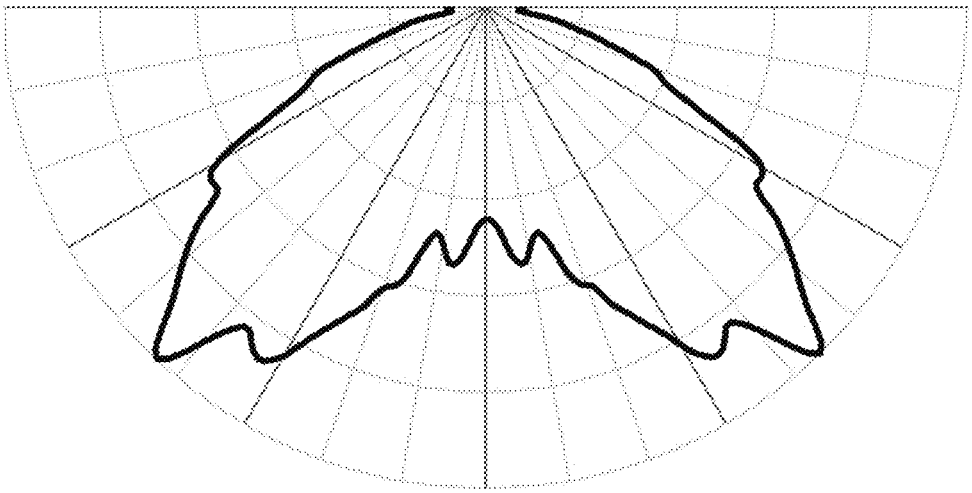
FIG. 21 is a chart illustrating the light distribution after passing through the prism optic of FIGS. 19A and 19B with a diffuser on the surface opposite the prisms.

In another embodiment, regions A and C were essentially removed from the shape of the prism optic, leaving the pointed-arch shape shown cross-sectionally in FIG. 19A and in exploded view in FIG. 19B. The prism optic 40 has 90-degree prisms 16 facing away from and oriented parallel to the light source 4. The prism optic 40 is concave relative to the light source. The light source 4 consisted of a linear array of LEDs 5. The prisms 16 had refractive index 1.49. End caps 11 consisting of highly-reflecting material prevent loss of light from the ends of the luminaire. Specular reflectors 10 were provided to capture rays where region C had been, these reflectors spanning from just beside the light source to the edge of the prism optic 40 and having the function of directing substantially all available source light toward the prism optic 40. The resulting batwing light distribution at phi=90 degrees depicted in FIG. 20. First-pass transmission is estimated to be 93%, an advantageously high transmission that may result in high luminaire efficiency. In a related embodiment (not pictured) a conventional microstructured 25-degree diffuser was provided on the inner surface 47 of the prism optic 40 facing toward the light source. The resulting batwing light distribution at phi=90 degrees depicted in FIG. 21. First-pass transmission is estimated to be 87%, an advantageously high transmission that may result in high luminaire efficiency. Again, unexpectedly, the shaped prism optic took on an unusual and attractive visual appearance that may be pleasing to a viewer. In a related embodiment, the shaped prism optic is used with two or more light sources, producing a batwing distribution.

In some embodiments, a specular reflector (such as polished or coated metal or multilayer plastic films) with one end near the light source is preferable for the reflector. This will direct light toward the prism optic, and the proximity of one end of the reflector near the light source will create a virtual image of the light source situated near the light source, such that rays appear to emanate from a location near the light source, thus may have a similar effect to rays directly from the light source when interacting with the prism optic. This may also have the effect of limiting the angular spread of the incident rays in the phi=90 degree plane (the plane normal to the linear light source), such that the prism optic is illuminated by an effective light source that has narrower angular spread in the phi=90 degree plane than the bare light source would have if used without reflectors.

The angle formed between the planes containing the two side reflectors, the reflector angle $A_r$ indicated in FIG. 19A may be any angle. For a typical Lambertian source, such as a linear array of Lambertian LEDs emitting light into +/−90 degrees in the phi=90 degree plane, specular reflectors with angle $A_r$ greater than or equal to 60 degrees on each side will cause light rays to undergo substantially a single reflection before reaching the prism optic. Each reflection from an imperfect reflector will result in a slight loss of light, thus it may be preferable to minimize the number of reflections in a luminaire design. Thus angle $A_r$ greater than or equal to 60 degrees on each side may be preferable when efficiency is a concern.

Sometimes it is desirable to limit the angular spread of the output light of the luminaire, such as to control high-angle light (glare), to create a narrow (e.g. 40-degree FWHM) batwing light distribution, or to create a one-sided batwing light distribution with limited total spread (e.g. 20-degree FWHM) in the phi=90 degree plane. Through experimental testing, the present inventors have found that when such limited-spread angular distributions are required, it may be advantageous to limit the angle $A_r$. Because the reflector usually spans the space from the light source to the edge of the prism optic, limiting the angle $A_r$ may similarly limit the angle of the light source in the Phi=90 degree plane subtended by the prism optic. This may limit the effective spread of the light source at the prism optic, and may advantageously allow light distributions of limited angular spread to be created. Thus it may be preferable to have the reflector angle $A_r$ between 20 and 90 degrees, more preferably between 30 and 60 degrees inclusive.

Figure 22:
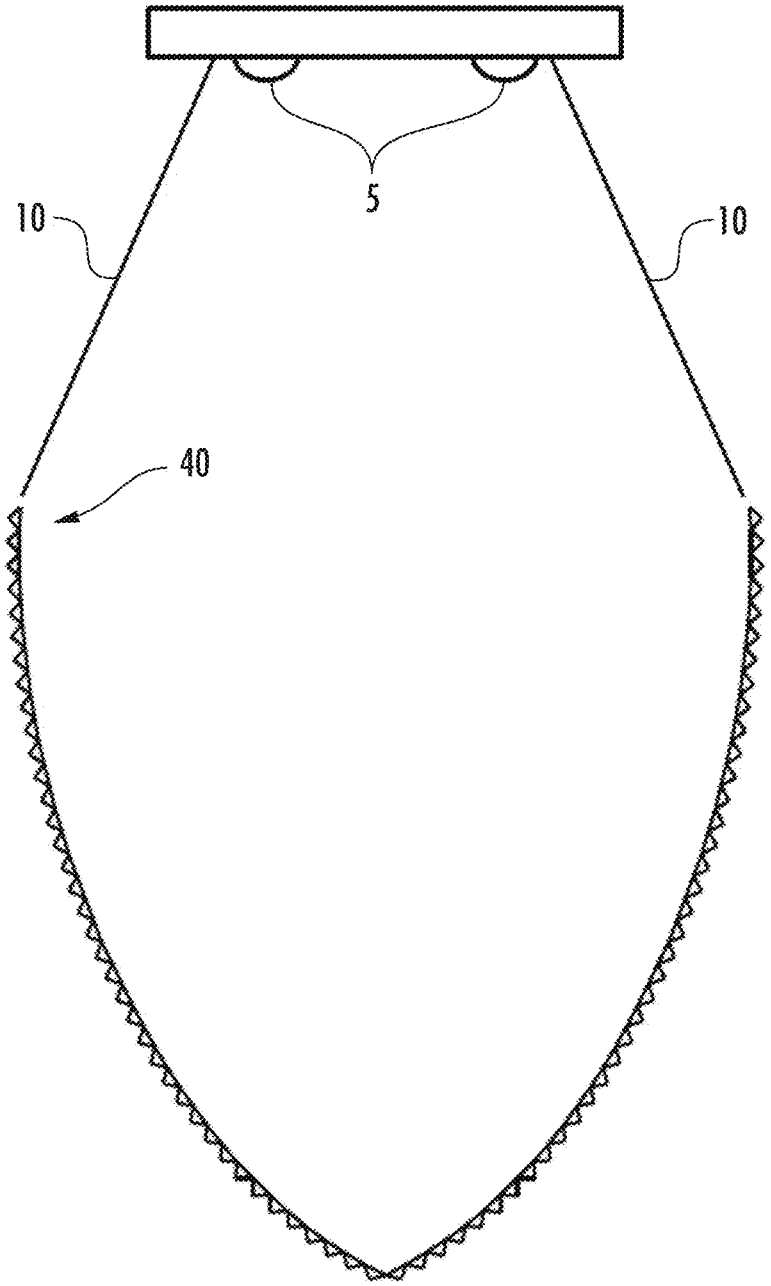
FIG. 22 is a cross-sectional view of multiple light sources and a curved prism optic having a pointed arch shape with prisms facing away from the light sources.
Figure 23:
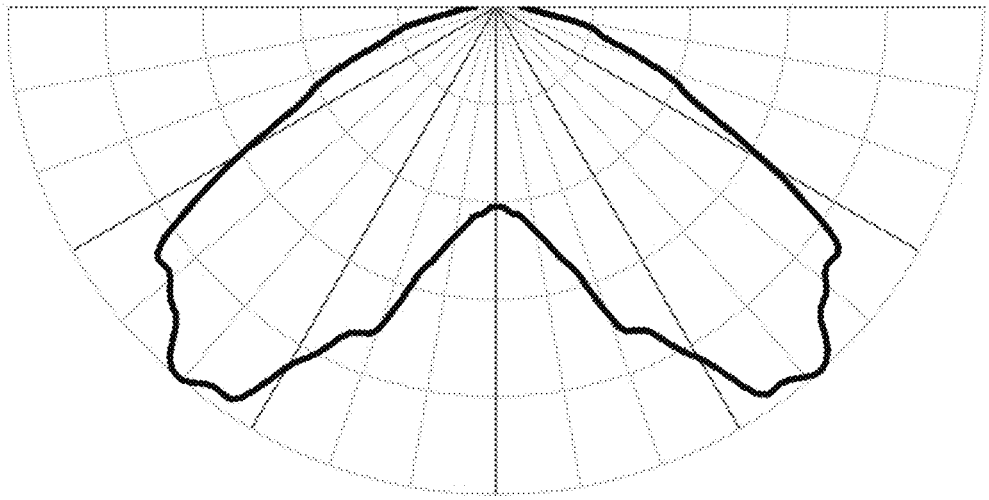
FIG. 23 is a chart illustrating the light distribution from two lights sources after passing through the prism optic of FIG. 22.
Figure 24:
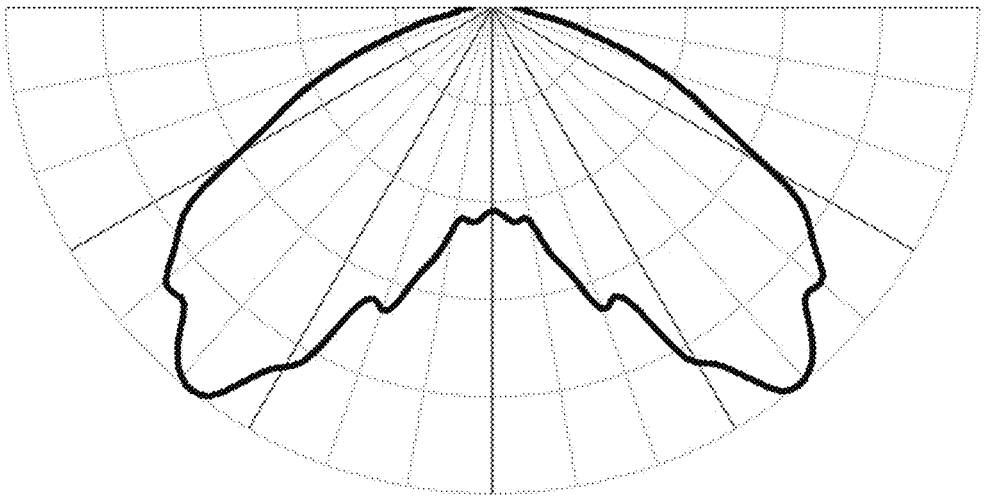
FIG. 24 is a chart illustrating the light distribution from three light sources after passing through the prism optic of FIG. 22.

In another embodiment, FIG. 22 depicts a light with two light sources (e.g., two linear arrays of LEDs 5), and FIG. 23 depicts the resulting light distribution, using 90-degree outward-facing prisms of refractive index 1.49 with a 20-degree conventional diffuser on the inside surface. The prism optic is concave relative to the light source. First-pass transmission is estimated to be 87%, an advantageously high transmission that may result in high luminaire efficiency. FIG. 24 depicts light distribution from a similar embodiment using 3 sources (luminaire not pictured), using 90-degree outward-facing prisms of refractive index 1.49 with a 20-degree conventional diffuser on the inside surface. First-pass transmission is estimated to be 88%, an advantageously high transmission that may result in high luminaire efficiency.

In some embodiments, a diffuse reflector is preferable for the reflector. Diffuse reflectors are available with reflectivity up to approximately 98%, such as BrightWhite 98™ made by Bright View Technologies, Morrisville, N.C. In operation of a luminaire employing a diffuser or prism optic, some light is transmitted and/or refracted through the diffuser or prism optic on the first pass, while other light is directed by the diffuser or prism optic back into the luminaire. Diffuse reflectors with very high reflectivity may enable luminaires to achieve high light output, due to their ability to accept light that has been reflected from the diffuser or prism optic and reflect it back with little loss, allowing the light multiple chances to impinge upon and be transmitted through the diffuser or prism optic. A diffuse reflector also enhances scrambling of light rays, and may desirably reduce the visibility of light source(s).

In some embodiments, a combination of diffuse and specular reflectors may be used. In some embodiments, reflectors may be partly light-transmitting. In some embodiments, partly light-transmitting reflectors may diffuse transmitted light.

In some embodiments, the light from the LEDs may be partially focused using reflectors or a lens such as commercially-available total-internal-reflection (TIR) lenses, so that substantially all the light impinges upon the prism optic without need for further reflectors.

The refractive index of the prism material may have an effect on the efficiency and light distribution of the luminaire. Prisms are known to impart larger angular deviation upon light rays when they have higher refractive index. The prism internal angle of a prism optic also affects the light distributions. It is known that isosceles prisms with smaller internal angle will have larger angles at the other two vertices of the prism. In cases in which total internal reflection does not occur, this will lead to larger angular deviations of light rays passing through the prisms.

Figure 25:
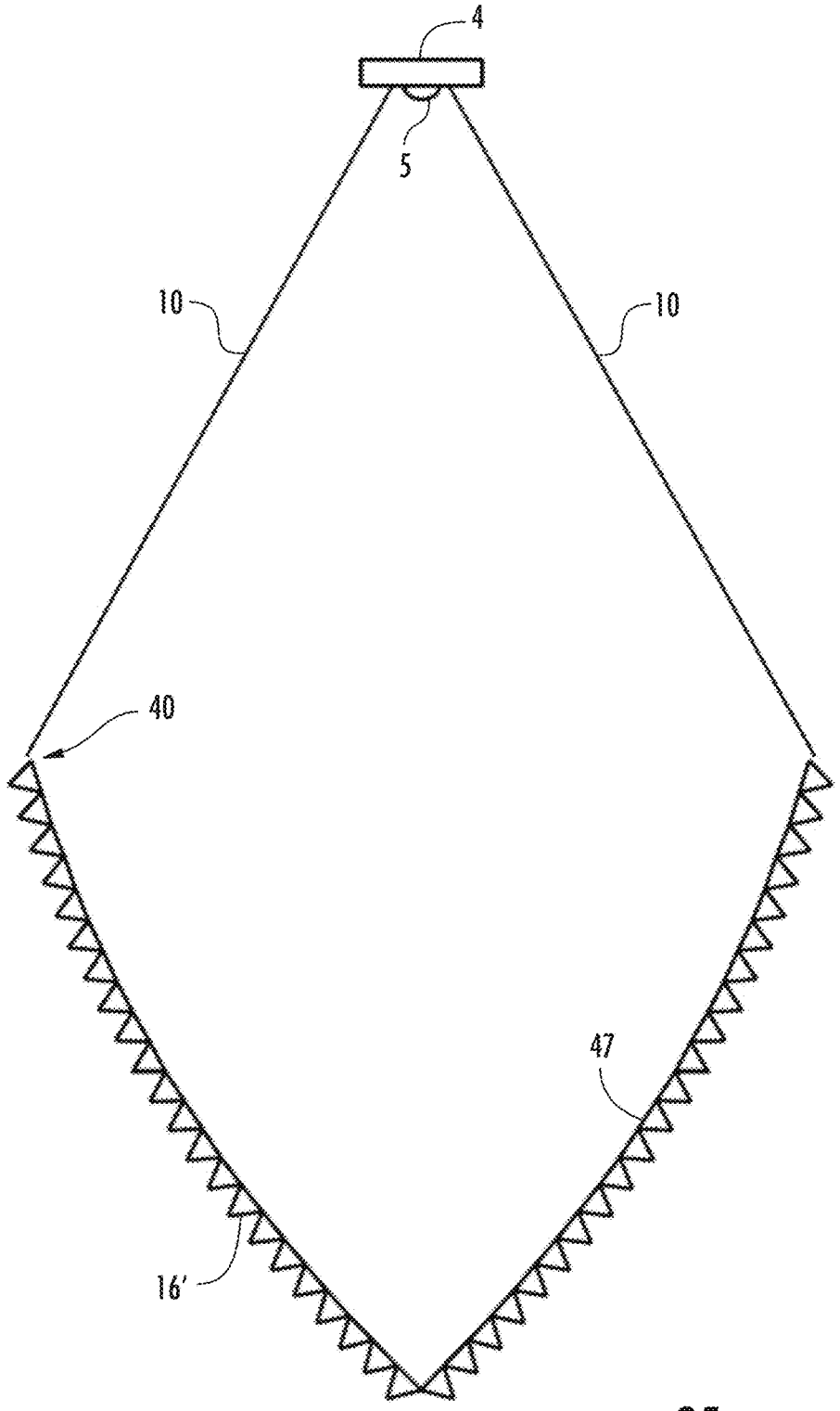
FIG. 25 is a cross-sectional view of a light source and a curved prism optic having a pointed arch shape with 60 degree prisms facing away from the light source.
Figure 26:
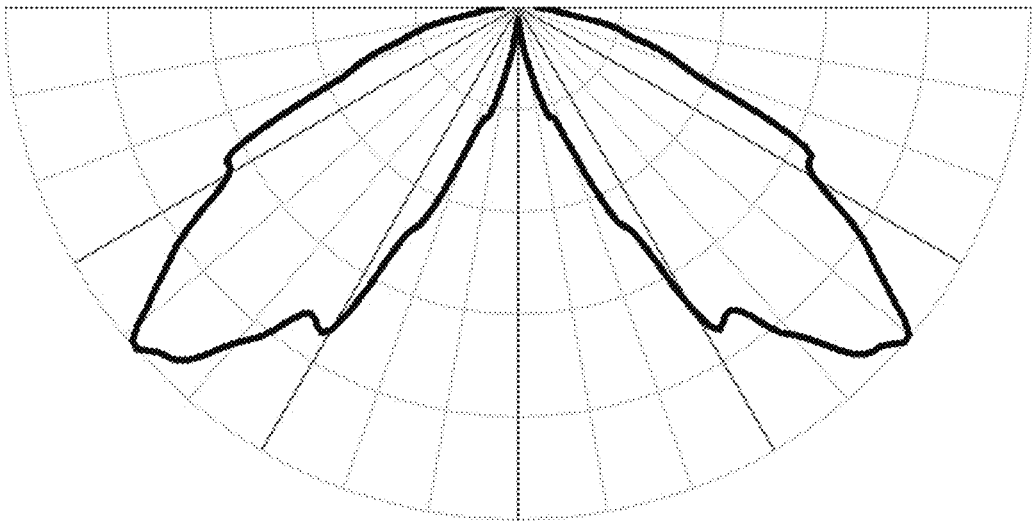
FIG. 26 is a chart illustrating the light distribution after passing through the prism optic of FIG. 25 with a diffuser on the surface opposite the prisms.

In another embodiment, 60-degree prisms 16' were arranged in the pointed-arch shaped prism optic 40 shown in FIG. 25. The prisms faced away from and were oriented parallel to the light source 4 and had refractive index 1.49. The prism optic 40 is concave relative to the light source 4. A conventional microstructured 20-degree diffuser was provided on the inner surface 47 of the prism optic 40 facing toward the light source 4 (not depicted in figure). Optional specular reflectors 10 were provided at the sides, these reflectors spanning from just beside the light source 4 to the edge of the prism optic 40 and having the function of directing substantially all available source light toward the prism optic 40. The resulting batwing light distribution at phi=90 degrees is depicted in FIG. 26. First-pass transmission is estimated to be 90%, an advantageously high transmission that may result in high luminaire efficiency. The shaped prism optic took on an unusual and attractive visual appearance that may be pleasing to a viewer. When compared to the embodiment of FIG. 19, the embodiment of FIG. 25 employing 60-degree prisms had a higher estimated first-pass transmission. Prism optics with lower prism angle than 90 degrees may have advantageously higher first-pass transmission than 90-degree prism optics. In addition, for a similar sized light source and reflector, a luminaire employing a 60-degree optic may have more light-bending power and may thus create a batwing light distribution using a smaller prism optic and hence smaller total luminaire size than a luminaire using a 90-degree optic.

Figure 27A:
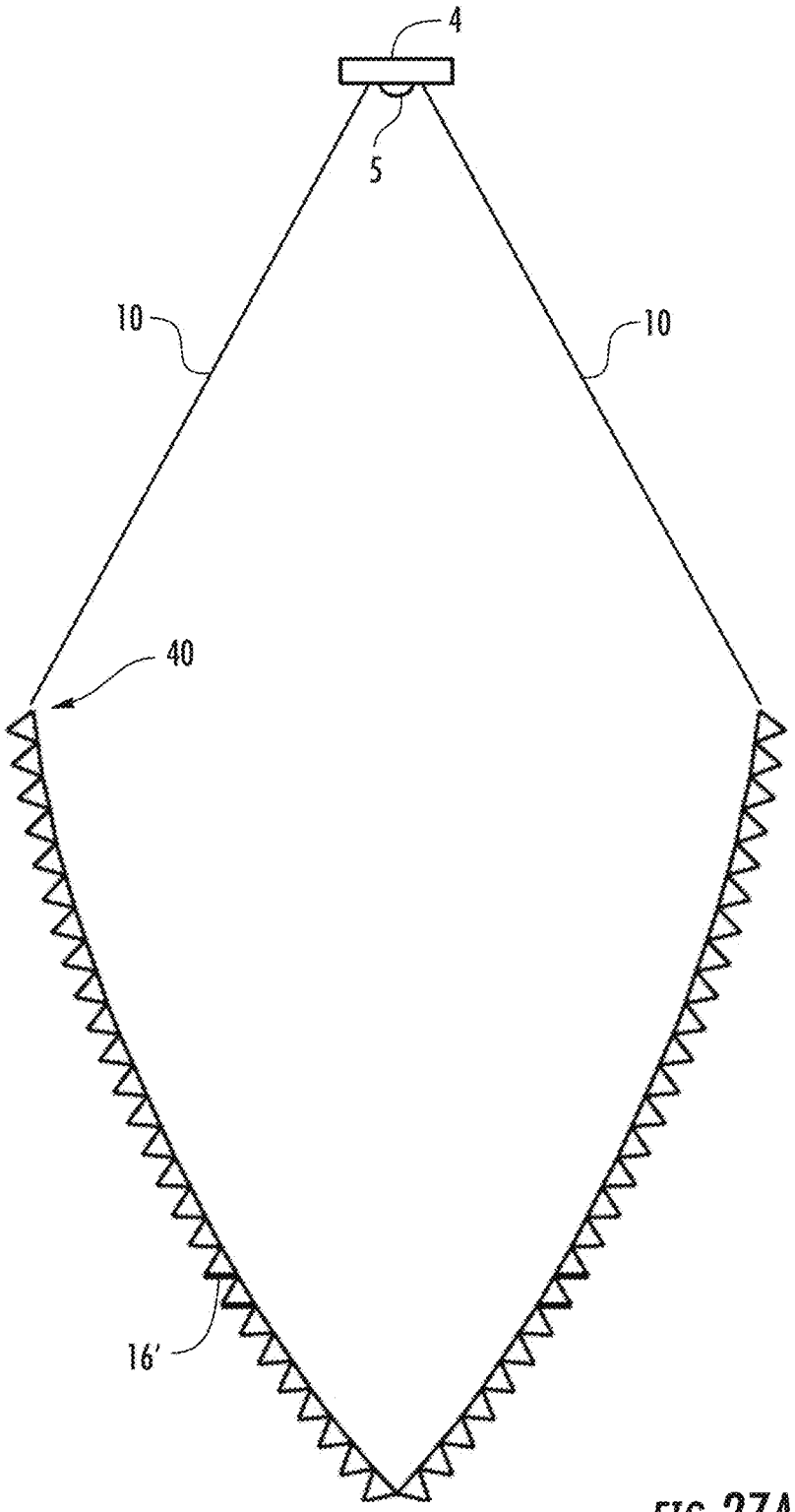
FIG. 27A is a cross-sectional view of a light source and a curved prism optic having a pointed arch shape with 60 degree prisms facing away from the light source.
Figure 27B:
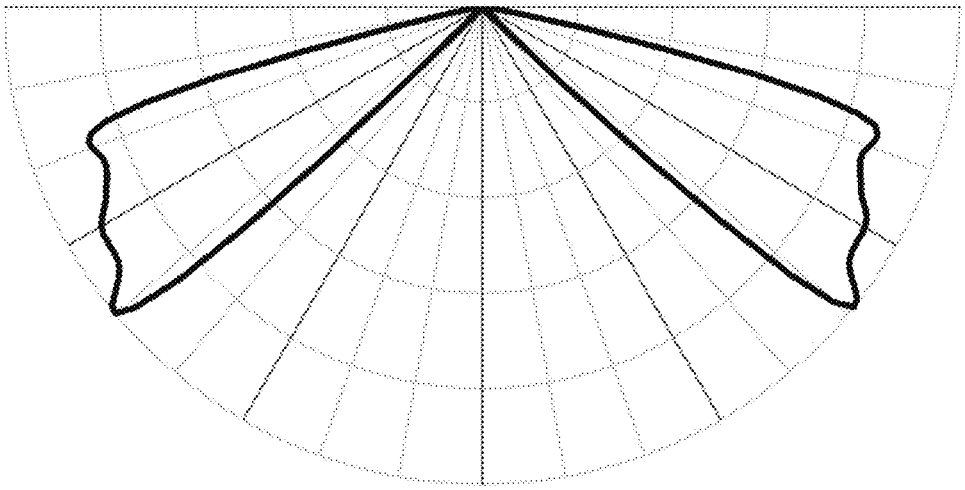
FIG. 27B is a chart illustrating the light distribution after passing through the prism optic of FIG. 27A.

In another embodiment, 60-degree prisms 16' without additional diffusion were arranged in a pointed-arch shaped prism optic 40 shown in FIG. 27A. The prisms 16' faced away from and were oriented parallel to the light source 4 and had refractive index 1.60. The prism optic 40 is concave relative to the light source 4. Optional specular reflectors 10 were provided at the sides, these reflectors spanning from just beside the light source 4 to the edge of the prism optic 40 and having the function of directing substantially all available source light toward the prism optic 40. The resulting batwing light distribution at phi=90 degrees is depicted in FIG. 27B. First-pass transmission is estimated to be 85%, an advantageously high transmission that may result in high luminaire efficiency.

Figure 28:
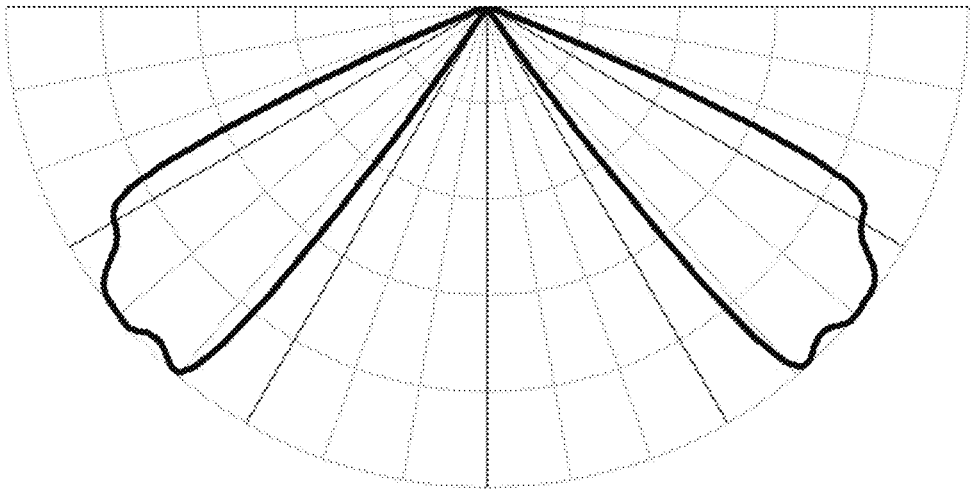
FIG. 28 is a chart illustrating the light distribution after passing through the prism optic of FIG. 27A with a refractive index of 1.49.

In another embodiment, 60-degree prisms 16' without additional diffusion were arranged in the same pointed-arch shaped prism optic 40 shown in FIG. 27A. The prisms 16' faced away from and were oriented parallel to the light source 4 and had refractive index 1.49. The prism optic 40 is concave relative to the light source 4. Optional specular reflectors 10 were provided at the sides, these reflectors spanning from just beside the light source 4 to the edge of the prism optic 40 and having the function of directing substantially all available source light toward the prism optic 40. The resulting batwing light distribution at phi=90 degrees depicted in FIG. 28. First-pass transmission is estimated to be 90%, an advantageously high transmission that may result in high luminaire efficiency. When compared to the previous embodiment, the lower refractive index of this embodiment may be surprisingly advantageous because of the higher first-pass transmission.

Figure 30:
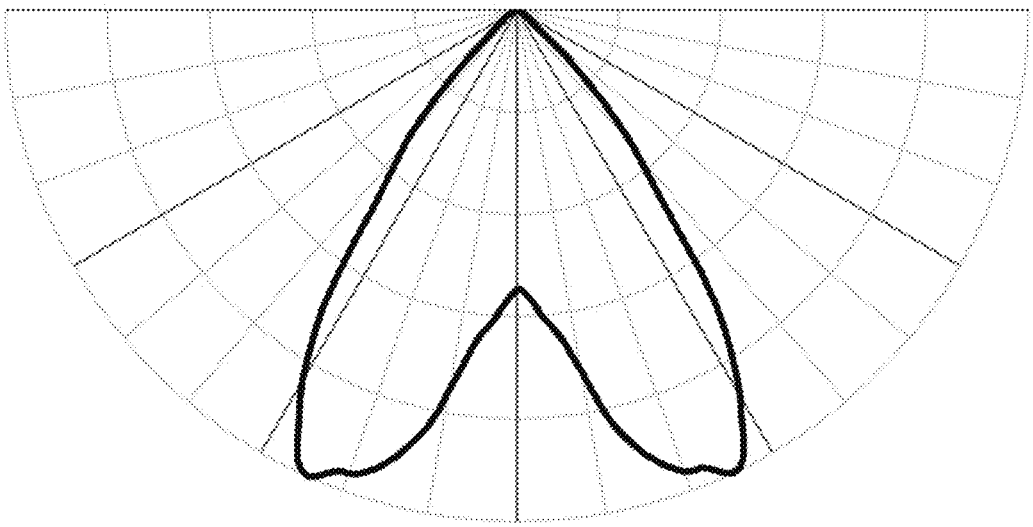
FIG. 30 is a chart illustrating the light distribution after passing through the prism optic of FIG. 29.

In another embodiment, a prism optic 50 has 60-degree prisms 16' arranged in two outward-bending curves 52 that meet in an angle at a central point 54 closest to the light source 4, as shown in FIG. 29. The prisms 16' faced away from and were oriented parallel to the light source 4 and had refractive index 1.49. Each outward-bending curve 52 comprising the prism optic 50 is concave relative to the light source 4. Optional specular reflectors 10 were provided at the sides, these reflectors spanning from just beside the light source 4 to the edge of the prism optic 50 and having the function of directing substantially all available source light toward the prism optic 50. The resulting batwing light distribution at phi=90 degrees depicted in FIG. 30. First-pass transmission is estimated to be 89%, an advantageously high transmission that may result in high luminaire efficiency. Advantageously, glare was very low as shown by low luminance at angles above 65 degrees. The shaped prism optic took on an unusual and attractive visual appearance that may be pleasing to a viewer.

Figure 31:
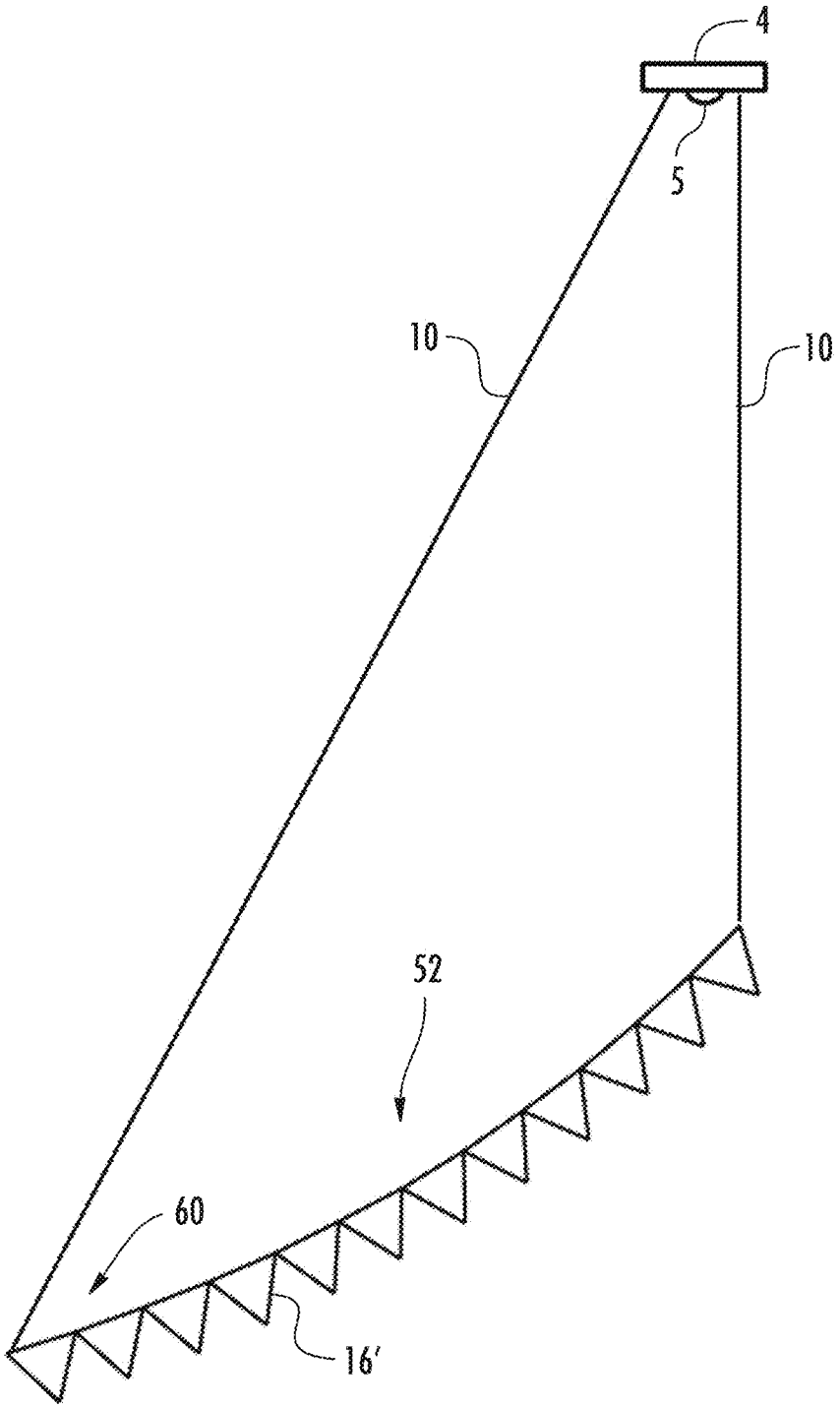
FIG. 31 is a cross-sectional view of a single-sided luminaire including a light source and a curved prism optic with prisms facing away from the light source.

In another embodiment, a prism optic 60 has 60-degree prisms 16' arranged in a single curve 52 representing one-half of the embodiment of FIG. 29, divided along the vertical central plane, as depicted in FIG. 31. The prisms 16' faced away from and were oriented parallel to the light source 4 and had refractive index 1.49. The prism optic 60 is concave relative to the light source 4. Optional specular reflectors 10 were provided at the sides, one reflector in substantially the same position as in the embodiment of FIG. 29, and the other reflector at the vertical central plane where the embodiment of FIG. 29 was divided. The resulting one-sided light distribution at phi=90 degrees depicted in FIG. 32. Such a one-sided distribution may be advantageous when a one-sided distribution is needed, such as wall-wash, cove, or specialty lighting applications.

Figure 33A:
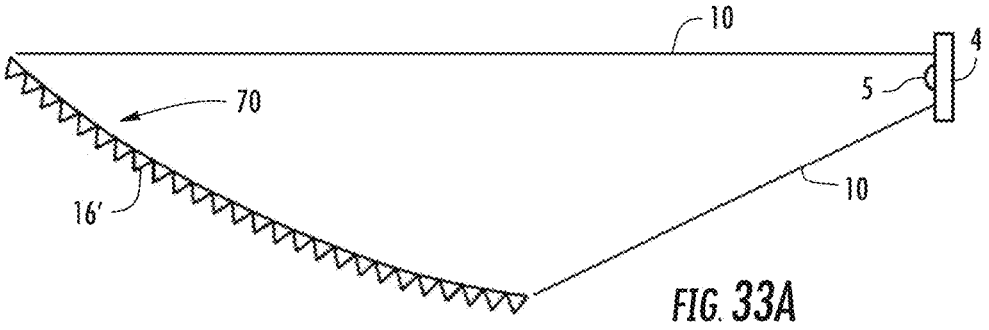
FIG. 33A is a cross-sectional view of a single-sided luminaire including a light source and a curved prism optic with prisms facing away from the light source.
Figure 33B:
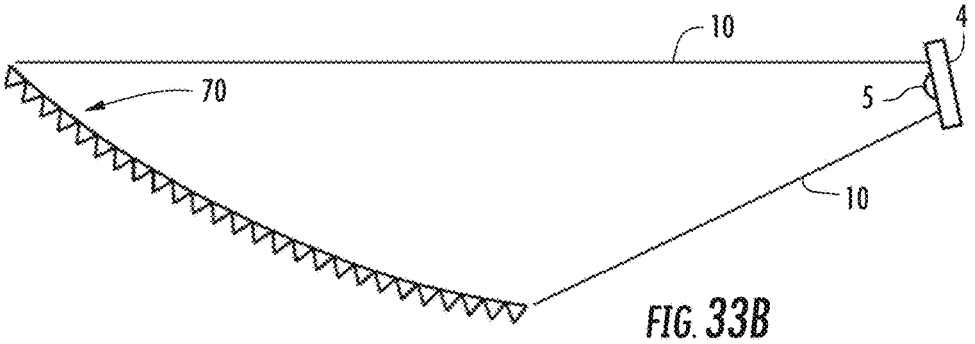
FIG. 33B is a cross-sectional view of a single-sided luminaire including a light source and a curved prism optic with prisms facing away from the light source.
Figure 34:
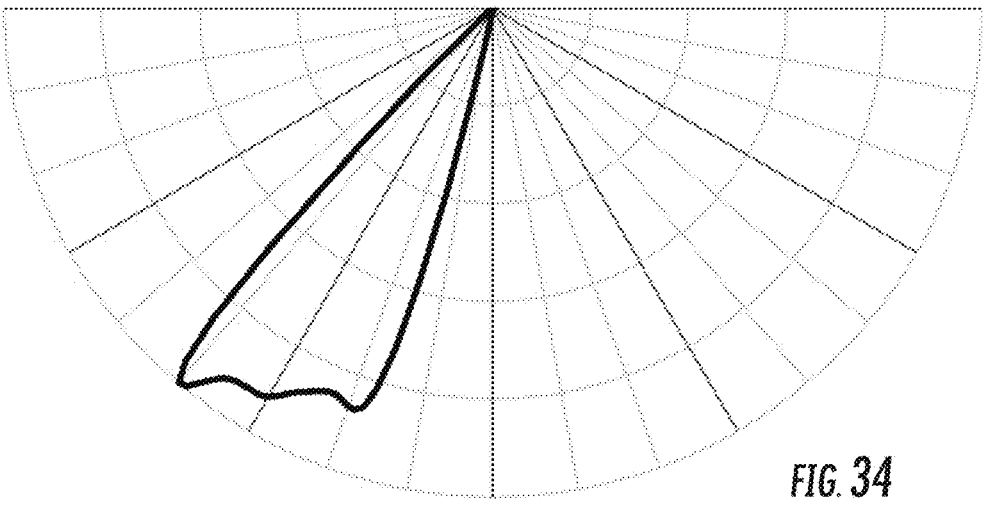
FIG. 34 is a chart illustrating the light distribution after passing through the prism optic of FIG. 33A.

In another embodiment, a prism optic 70 has 60-degree prisms 16' arranged in a single curve representing one-half of the embodiment of FIG. 25, divided along the vertical central plane, as depicted in FIG. 33A. The prisms 16' faced away from and were oriented parallel to the light source 4 and had refractive index 1.49. The prism optic 70 is concave relative to the light source. Optional specular reflectors 10 were provided at the sides, one reflector in substantially the same position as in the embodiment of FIG. 25, and the other reflector at the vertical central plane where the embodiment of FIG. 25 was divided. The resulting one-sided light distribution at phi=90 degrees depicted in FIG. 34. Such a one-sided distribution may be advantageous when a one-sided distribution is needed, such as wall-wash, cove, or specialty lighting applications. In a related embodiment as shown in FIG. 33B, the light source 4 was tilted to be aligned with the center of the curved prism optic 70. This tilt may optimize efficiency by aligning the angle of maximum source brightness with the center of the prism optic 70. For a Lambertian distribution, the efficiency is only weakly dependent on the light source tilt because a Lambertian is nearly constant at angles near the normal, thus the tilt of the light source may be chosen either to maximize efficiency, or for other reasons such as its effect on the light distribution or for convenient mounting to a heat sink.

A batwing module is defined herein as a light source and curved prismatic prism optic with other optional elements such as reflectors, housings, and heat sinks, that creates a one-sided or two-sided batwing distribution according to the embodiments of the present invention. Examples include the embodiments of FIGS. 11, 14, 16, 18, 19, 22, 25, 27, 29, 31, and 33. A batwing module can be a luminaire. It is also possible to combine multiple batwing modules into a luminaire to create desired light distributions that are the combined light distributions of the individual modules. Doing so may provide advantages in flexibility of design, choice of light distribution, and aesthetic design.

A "light distribution device" is defined herein as a light transmissive substrate or prism optic with optional elements such as end caps, reflectors, housings, and heat sinks that can create a one-sided or two-sided batwing distribution according to the embodiments of the present invention. For example, a light distribution device may include the prism optic 40 and optionally the reflectors 10 of FIGS. 19A, 22, 25 and 27A. The light distribution device may further include the end caps 11 of FIG. 19B.

The light distribution devices are configured to connect to a light assembly, which may include the linear light source 4, 5. For example, a light distribution device including the prism optic 40 and the reflectors 10 is shown connected to a light assembly including the linear light source 4, 5 in FIG. 19A.

Figure 35:
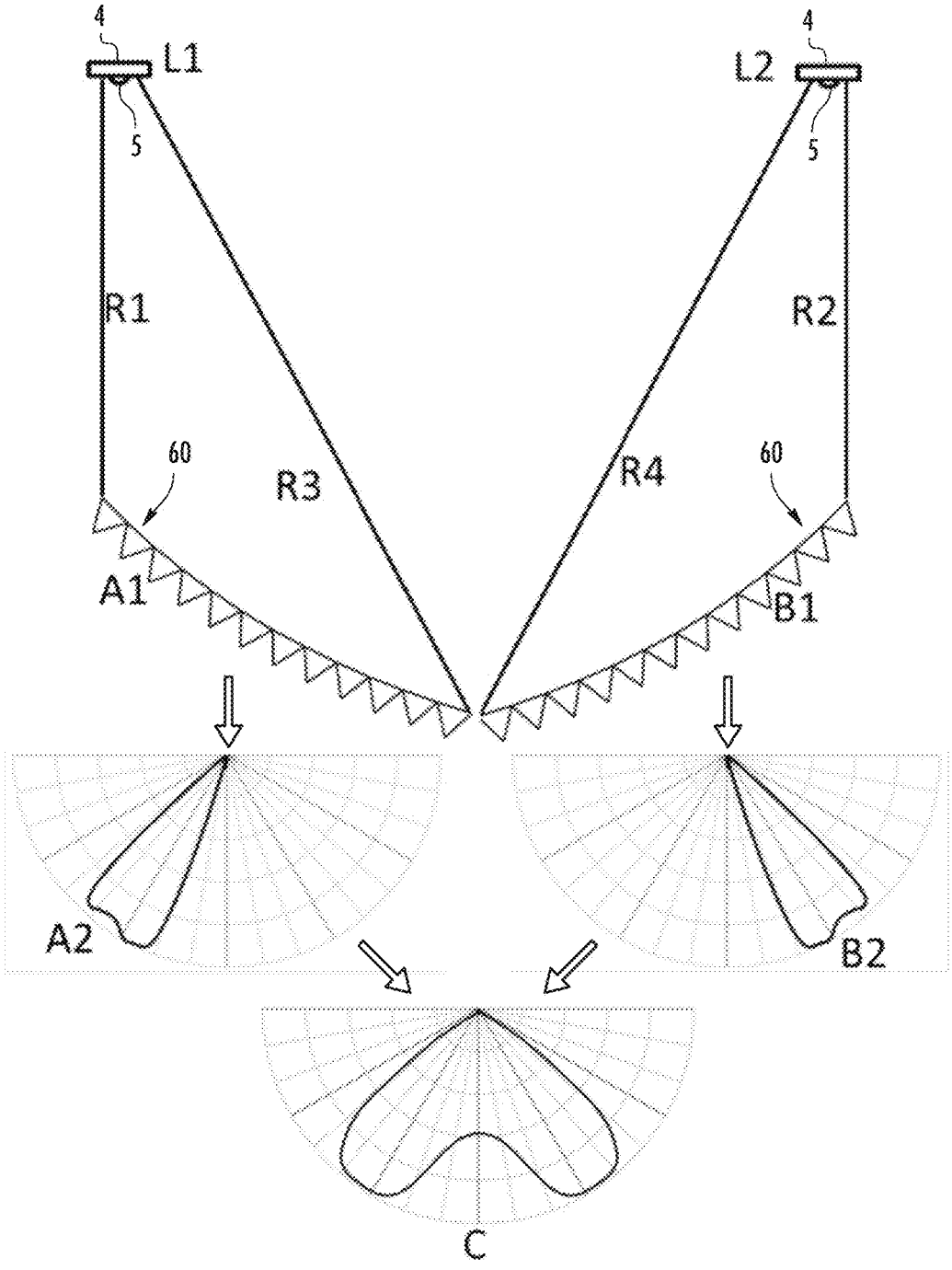
FIG. 35 includes a cross-sectional view of a pair of single-sided luminaires each including a light source and a curved prism optic with prisms facing away from the light source and charts illustrating the light distribution after passing through the prism optics.
Figure 36:
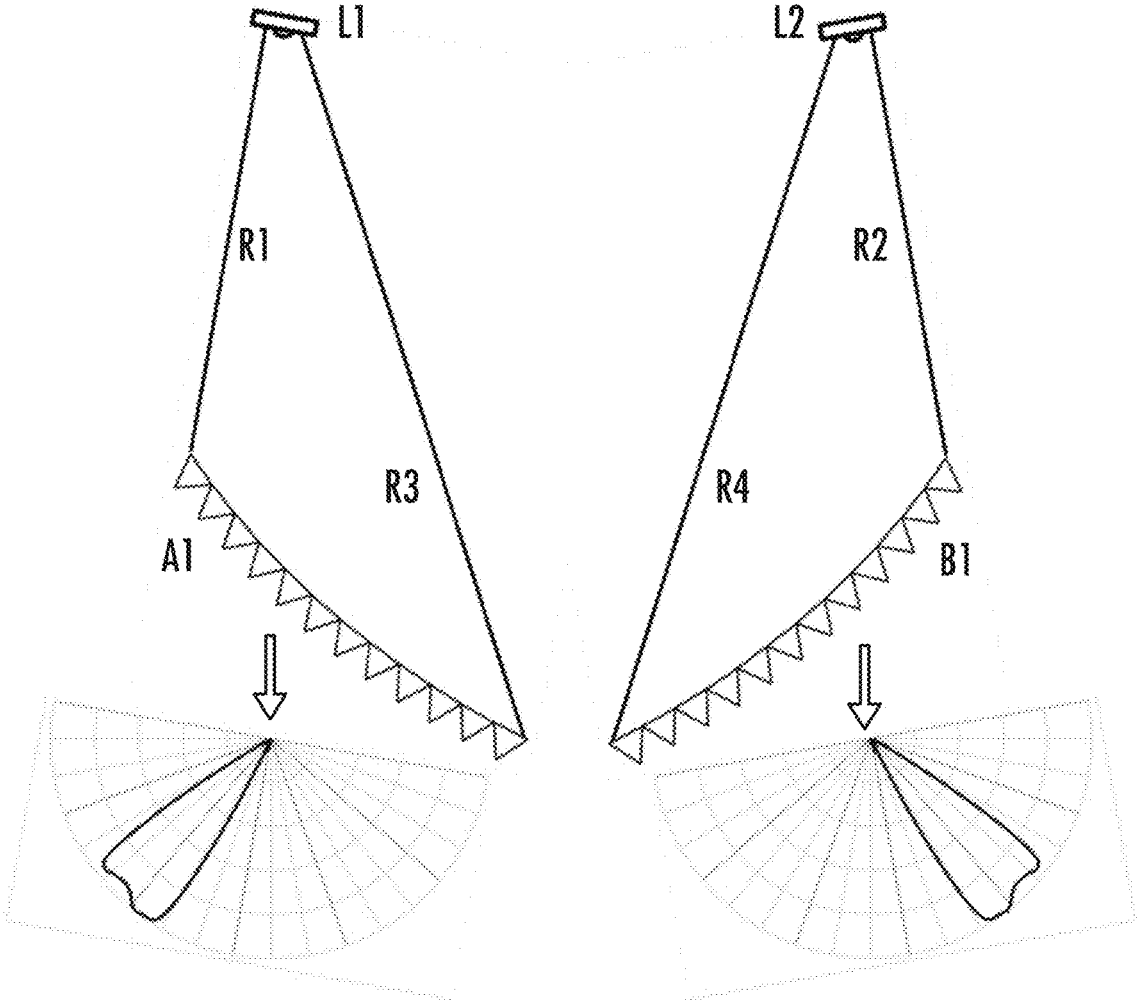
FIG. 36 includes a cross-sectional view of a pair of single-sided luminaires each including a light source and a curved prism optic with prisms facing away from the light source and charts illustrating the light distribution after passing through the prism optics.

In another embodiment, two batwing modules of the embodiment of FIG. 31 are used together and in mirror-image configuration, as shown in FIG. 35. In one batwing module, light source L1 (similar to the light source 4 shown in FIG. 31) and reflectors R1 and R3 (similar to the reflectors 10 shown in FIG. 31) direct light toward prism optic A1 (similar to the prism optic 60 shown in FIG. 31) producing light distribution A2. In the other batwing module, light source L2 (similar to the light source 4 shown in FIG. 31) and reflectors R2 and R4 (similar to the reflectors 10 shown in FIG. 31) direct light toward prism optic B1 (similar to the prism optic 60 shown in FIG. 31) producing light distribution B2. With the addition of a conventional microstructured diffuser on the surface opposite the prisms of prism optics A1 and B1, the batwing light distribution C is produced. In a related embodiment, the two batwing modules in the embodiment of FIG. 31 are rotated in opposite directions, as shown in FIG. 36. The rotation can be used to determine the corresponding rotations of the light distributions generated, adjusting the angular spread between areas of peak brightness in the combined light distribution, and hence can adjust the overall width of the batwing light distribution (not pictured). It is advantageous to be able to select the width of a batwing light distribution. In a related embodiment, diffusion is added to the surface of the prism optic substrate opposite the prisms, widening the distribution and adjusting the amount of light at nadir in the combined batwing light distribution. In related embodiments, two or more batwing modules have different characteristics such as rotation, size, position, and light source brightness, enabling design of asymmetric or specialized light distributions by the superposition of the light distributions of the batwing modules.

Figure 37:
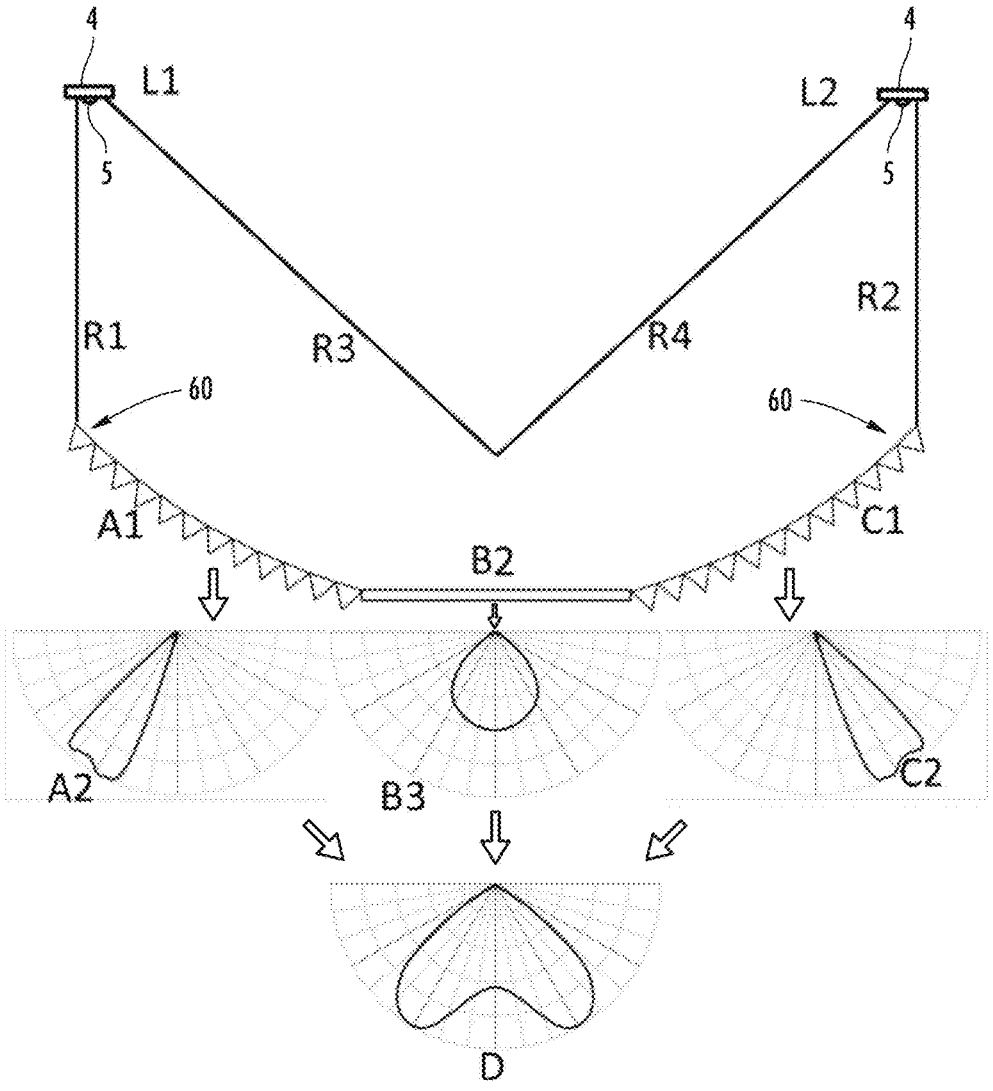
FIG. 37 includes a cross-sectional view of a luminaire including a pair of light sources and a pair of curved prism optics with prisms facing away from the light sources and charts illustrating the light distribution after passing through the prism optics.

In a further variation of the embodiment of FIG. 35, a conventional diffuser B2 is added between the two curved prism optics, as illustrated in FIG. 37. This conventional diffuser has the effect of adding a Lambertian light distribution to the two single-sided distributions and results in increased illumination at nadir. In this embodiment, the combined batwing light distribution D is a combination of the light distributions A2, B3, C2 produced by the light sources and prism optics. Light sources L1 and L2, separated spatially, illuminate prism optics A1 and C1 respectively. Reflectors R1 and R2 reflect light toward the diffuser and prism optics. Reflectors R3 and R4 can take on any shape, but are illustrated in the figure in one advantageous position, in which the reflectors R3 ensures that source L1 illuminates prism optic A1 and diffuser B2 but does not directly illuminate prism optic C1. Direct illumination of prism optic C1 from source L1 may create light in undesirable locations (such as high-angle glare). Correspondingly, reflector R4 also ensures that source L2 illuminates prism optic C1 and diffuser B2 but does not directly illuminate prism optic A1. Advantageously, the diffusivity of diffuser B2 and the width of diffuser B2 can be adjusted to achieve the desired contribution of the center section to the combined batwing light distribution, giving an increased degree of control over the intensity of light at nadir. This is one exemplary embodiment, but many other embodiments are possible that combine curved prism optics discussed herein with conventional optical elements including diffusers, specular reflectors, diffuse reflectors, and transparent materials or openings that transmit light directly. In related embodiments, the diffuser B2 of FIG. 37 is curved inward and/or inset toward the light sources, reducing high-angle luminance that may be generated by the conventional diffuser.

Figure 38A:
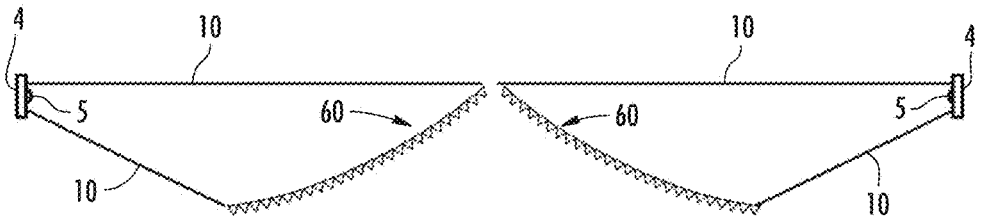
FIGS. 38A-38C are cross-sectional views of two-part luminaires according to some embodiments described herein.
Figure 38B:
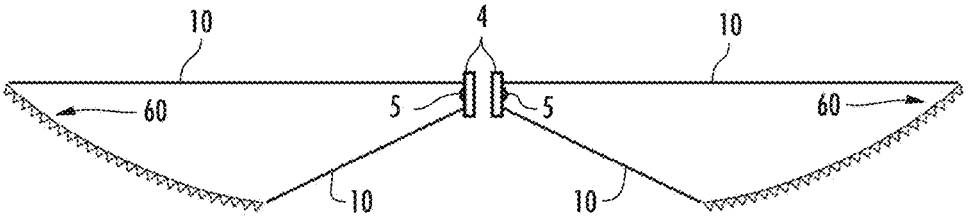
Figure 38C:
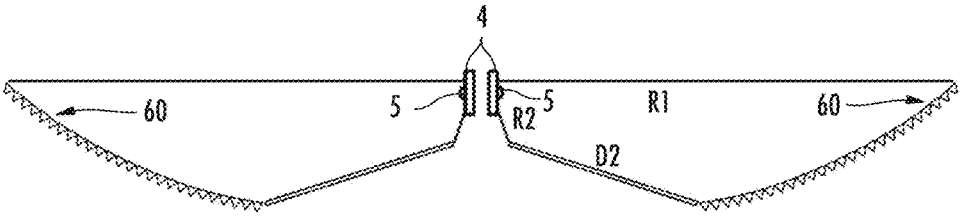

In the embodiments of FIGS. 38A-38C, two of the batwing modules of FIG. 33 are combined to create a luminaire. This luminaire may be advantageous because of its limited height for applications including recessed troffers and surface-mount lighting, in which it may be desirable that the height or thickness of a luminaire be minimized. In FIG. 38A, a two-part luminaire has light sources 4 at opposite sides, which may be advantageous if two separate heatsinks, each disposed on the outside of a light source, are needed to accommodate the light sources. The embodiment of FIG. 38A also may be advantageous because each of the two batwing modules may block high-angle light emitted by the other module, thus limiting glare from the luminaire. In FIG. 38B, a two-part luminaire has the light sources 4 nearly back-to-back in the middle, which may be advantageous if a heatsink is needed and a single heatsink can accommodate both light sources. In another embodiment similar to FIG. 38B, not pictured, a single fluorescent lamp or other emitter that emits light into all angles may be used in the center to illuminate both sides of the luminaire. In FIG. 38C, a light source illuminates prism optic 60 with help from reflectors R1 and R2 in a manner similar to other embodiments herein, and has the additional feature of a semi-transparent diffuser/reflector D2. Diffuser D2 can be a conventional diffuser such as a volumetric, holographic, or microstructured diffuser, which is low-loss material that transmits and diffuses one portion of the light incident upon it, while reflecting substantially all of the light that is not transmitted. The transmitted and diffused light may range from 0 to 100% of the light incident upon the diffuser, while the reflected light will be substantially the remainder of the incident light, some of said reflected light illuminating prism optic 60. If the transmission of diffuser D2 is substantially above zero, then the luminaire will exhibit a luminous surface at D2 that may serve two purposes: Diffuser D2 may provide visual appeal by being a luminous surface; and transmission of D2 and light distribution created by D2 may contribute to the combined batwing light distribution of the luminaire.

In luminaire design, aesthetic appeal may be a desirable attribute. In many embodiments, the combination of shaped prism optics and optional conventional diffusers, along with their specific shape configuration may add aesthetic appeal to a luminaire.

Figure 39:
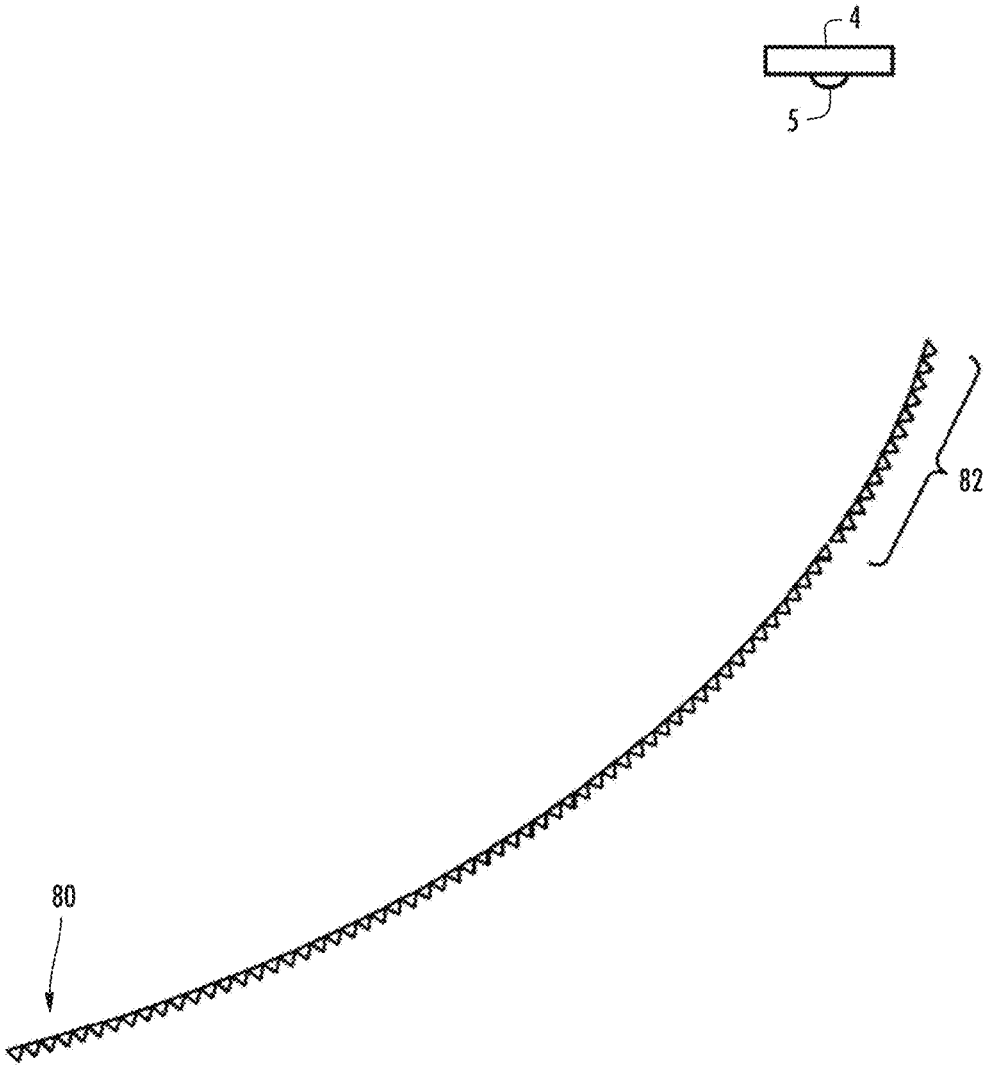
FIG. 39 is a cross-sectional view of a light source and a curved prism optic having a logarithmic spiral shape with prisms facing away from the light source.
Figure 40A:
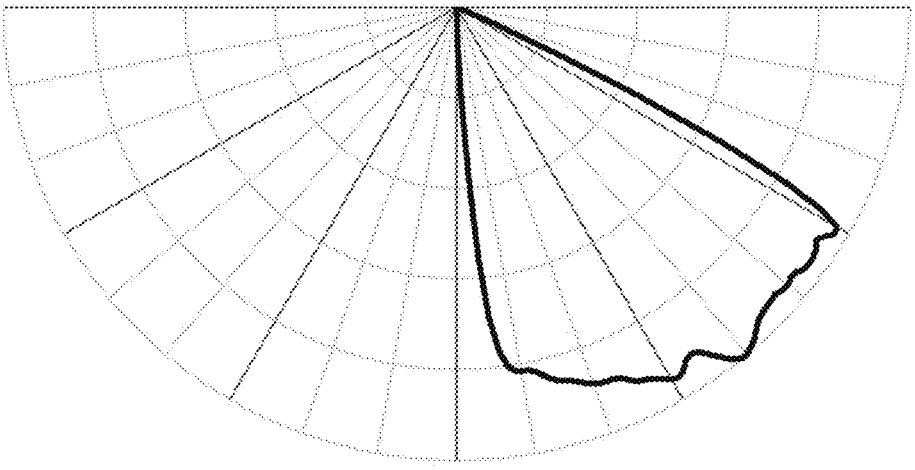
FIG. 40A is a chart illustrating the light distribution after passing through the prism optic of FIG. 39.
Figure 40B:
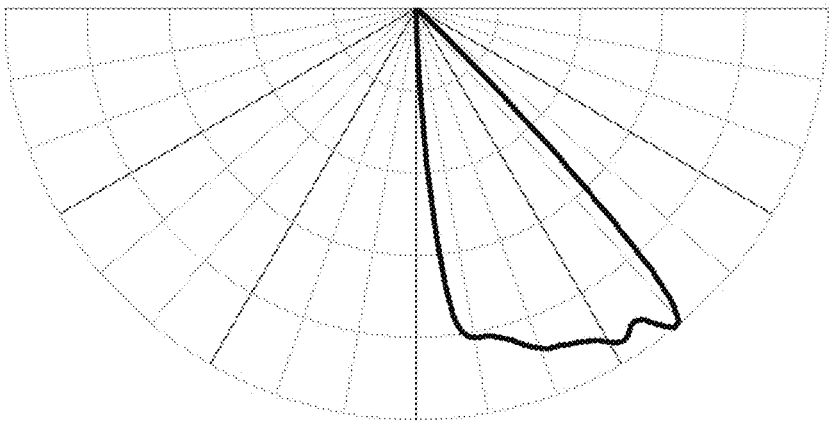
FIG. 40B is a chart illustrating the light distribution after passing through the prism optic of FIG. 39 with a section removed from the prism optic.

In an additional embodiment, a curved prism optic 80 is arranged in the shape of a logarithmic spiral whose center is coincident with a Lambertian light source 4, as illustrated in FIG. 39. The prisms have a 65-degree peak angle and refractive index 1.6. The logarithmic spiral shape is given by the equation rho=A*exp(B*theta) where * denotes multiplication, rho is the radial distance from the center to the base of the prisms, theta is the angle relative to the light source, and theta=0 is defined as the direction of maximum luminous intensity of the Lambertian light source. The entire spiral pictured covers the angular range of theta from −40 degrees to +20 degrees. A prismatic film in a logarithmic spiral shape centered upon the light source has the property that the angle between an incident ray and the normal to the base of any given prism on the film is constant. For this embodiment, constants A and B are chosen such that the light enters the prisms at an angle of 55 degrees from the normal to the prisms. The resulting batwing light distribution at phi=90 degrees depicted in FIG. 40A. In an additional embodiment, a section 82 is removed from the spiral so that the spiral covers the angular range of theta from −40 degrees to 0 degrees. The resulting batwing light distribution at phi=90 degrees depicted in FIG. 40B, and has a narrower angular spread. It should be noted that shapes other than a logarithmic spiral can produce useful batwing light distributions, including for example the sections of pointed-arch shape already noted for the embodiment of FIGS. 19A and 19B.

Figure 41:
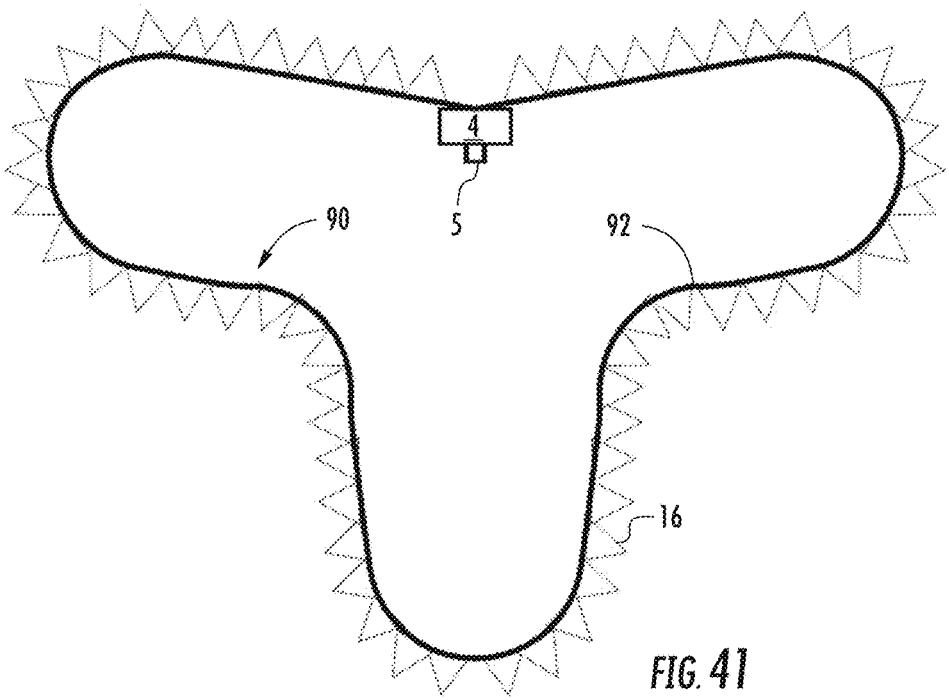
FIG. 41 is a cross-sectional view of a light source and a T-shaped curved prism optic with prisms facing away from the light source.
Figure 42:
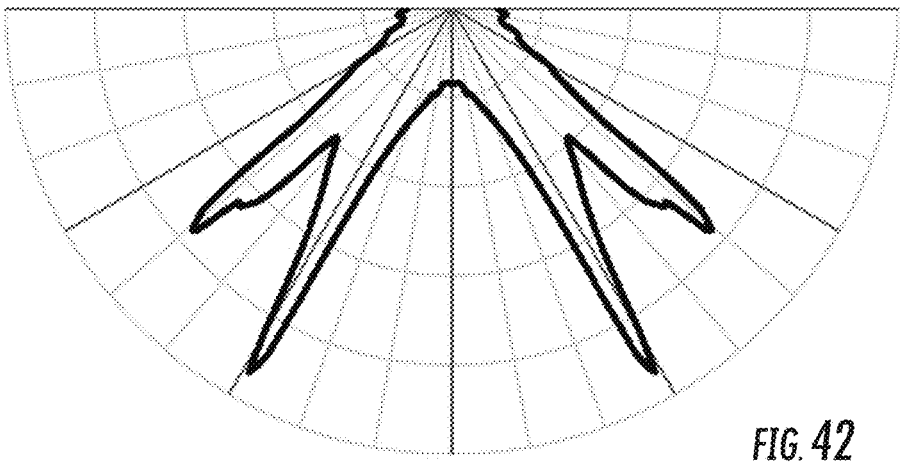
FIG. 42 is a chart illustrating the light distribution after passing through the prism optic of FIG. 41.
Figure 43:
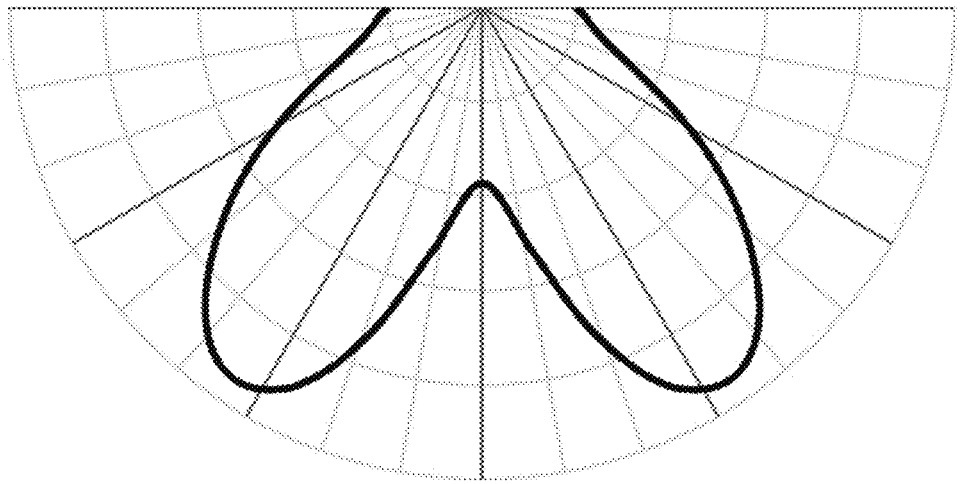
FIG. 43 is a chart illustrating the light distribution after passing through the prism optic of FIG. 41 with a diffuser on the surface opposite the prisms.

In another embodiment, a prism optic 90 with 90-degree prisms 16 and without additional diffusion was arranged in a T-shaped curved configuration as shown in FIG. 41. The prisms 16 faced away from and were oriented parallel to the light source 4 and had refractive index 1.6. The measured batwing light distribution at phi=90 degrees depicted in FIG. 42. In a related embodiment, a conventional microstructured 30-degree diffuser is added to the inside surface 92 of the prism optic 90 and prisms are used with refractive index 1.49 in the same shape. The measured batwing light distribution at phi=90 degrees depicted in FIG.

Figure 44:
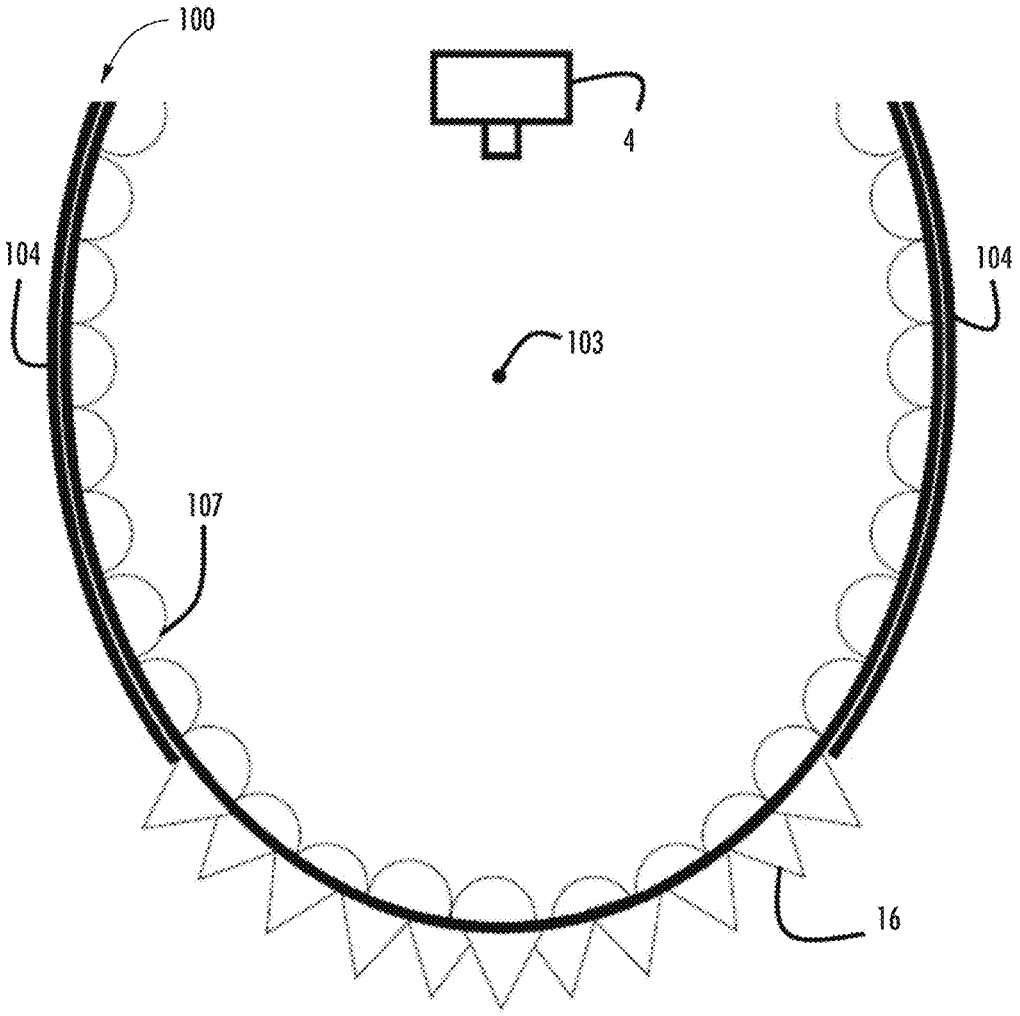
FIG. 44 is a cross-sectional view of a light source and a curved prism optic with prisms facing away from the light source and light blocking sides.
Figure 45:
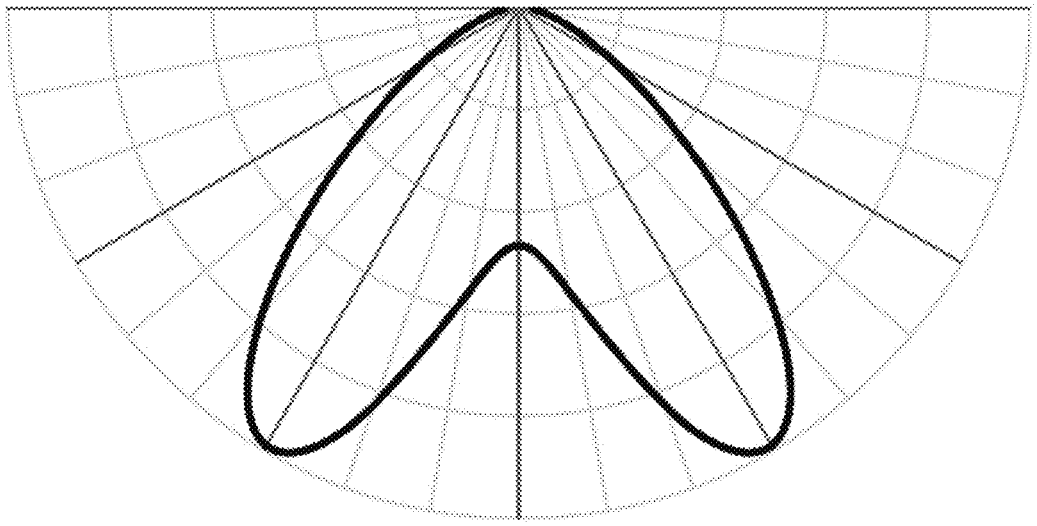
FIG. 45 is a chart illustrating the light distribution after passing through the prism optic of FIG. 44.

In another embodiment, a 90-degree prism optic 100 was curved into an approximately elliptic cylinder shape with major axis approximately 8.5 inches and minor axis approximately 6.5 inches around a linear light source 4 as depicted cross-sectionally in FIG. 44 with the light source 4 positioned 0.75 inches behind the center 103 of the ellipse. The prisms 16 faced away from and were oriented parallel to the light source and had refractive index 1.49. The prism optic 100 is concave relative to the light source. A conventional microstructured 30-degree diffuser was disposed on the inside surface of the prism optic, depicted as semicircles 107 in the figure. A black film 104 was disposed on either side of the ellipse to block some of the transmitted light. The resulting light distribution measurement at phi=90 degrees shown in FIG. 45. The light distribution is a batwing shape and has low luminance at high angles. First-pass transmission may be low due to the absorption by the black material.

Figure 46:
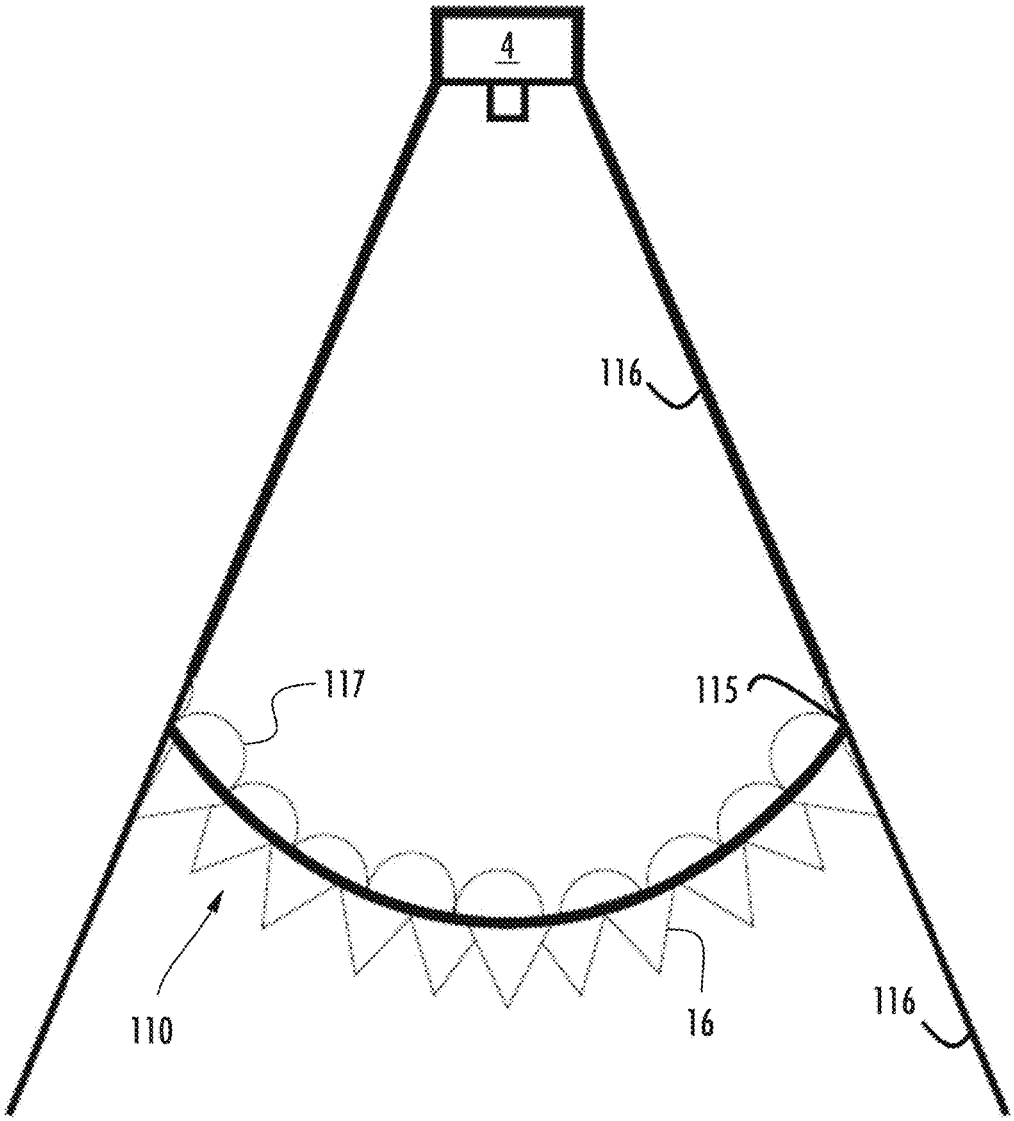
FIG. 46 is a cross-sectional view of a light source, a curved prism optic with prisms facing away from the light source and internal and external reflectors.
Figure 47:
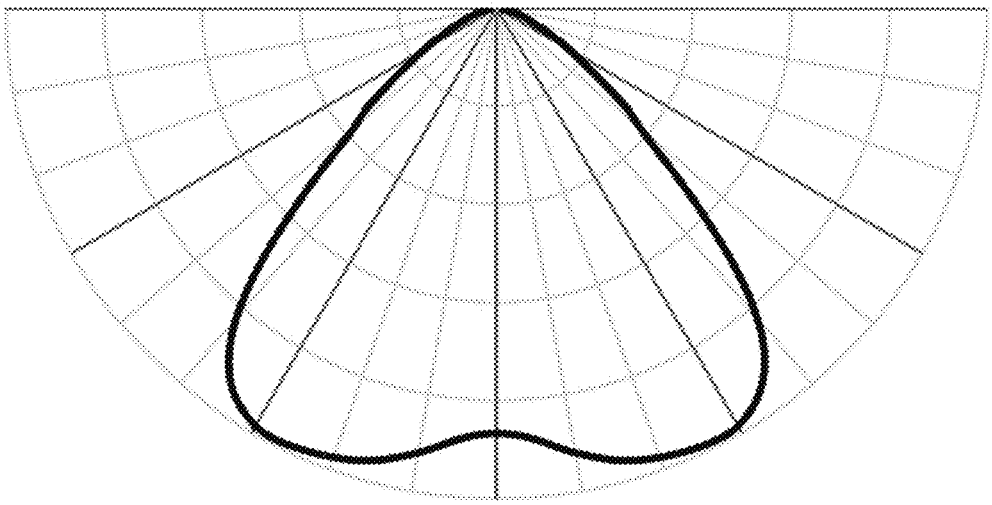
FIG. 47 is a chart illustrating the light distribution after passing through the prism optic of FIG. 46.
Figure 48:
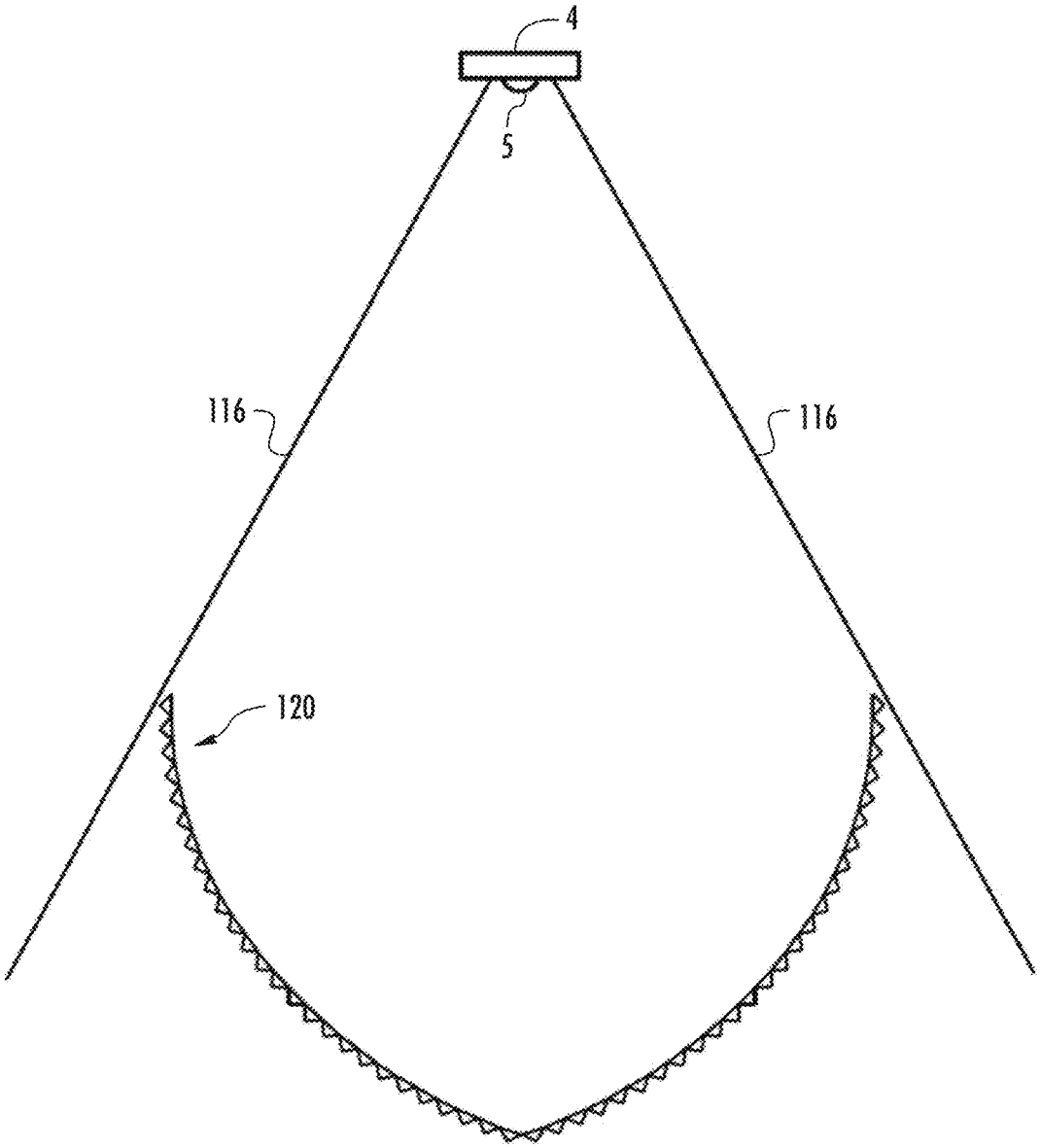
FIG. 48 is a cross-sectional view of a light source, a curved prism optic having a pointed arch shape with prisms facing away from the light source and internal and external reflectors.
Figure 49:
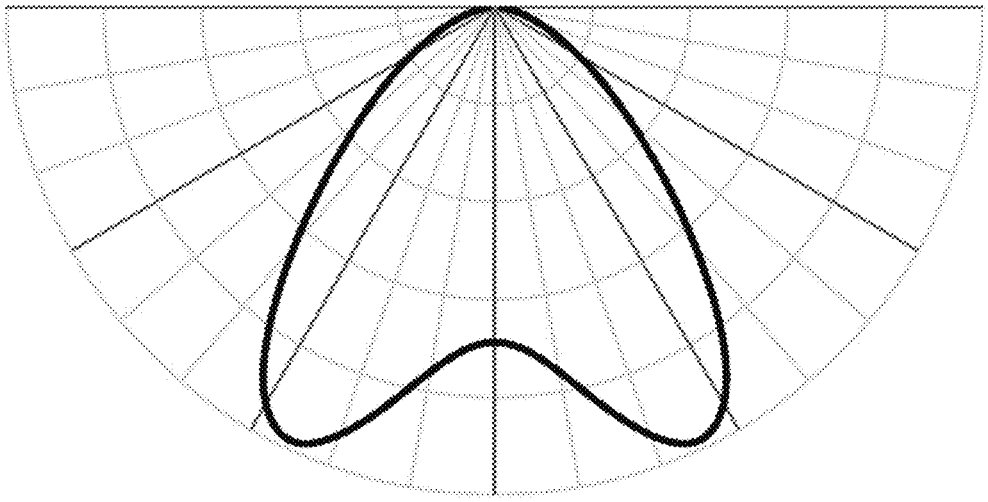
FIG. 49 is a chart illustrating the light distribution after passing through the prism optic of FIG. 48.

In another embodiment, a 90-degree prism optic 110 was curved into an approximately cylinder shape with radius less than 4 inches and center in front of a linear light source as depicted cross-sectionally in FIG. 46. The prisms 16 faced away from and were oriented parallel to the light source 4 and had refractive index 1.49. The prism optic 110 is concave relative to the light source. A conventional microstructured 30-degree diffuser was disposed on the inside surface of the prism optic, depicted as semicircles 117 in the figure. The closest part of the prism optic was the edge 115 which was affixed to a diffuse reflector 116 4 inches from the light source. The diffuse reflector 116 extended two inches beyond the prism optic 110 in the direction away from the light source 4. The resulting light distribution measurement at phi=90 degrees shown in FIG. 47. It has a batwing shape and has low luminance at high angles. In a related embodiment, the prism optic 120 was formed into a pointed-arch shape as depicted in FIG. 48. The prism optic is concave relative to the light source 4. The resulting light distribution measurement at phi=90 degrees shown in FIG. 49. It has a batwing shape and has low luminance at high angles, and may have higher efficiency than the embodiment of FIG. 46 due to the absence of a central flat section.

Figure 50:
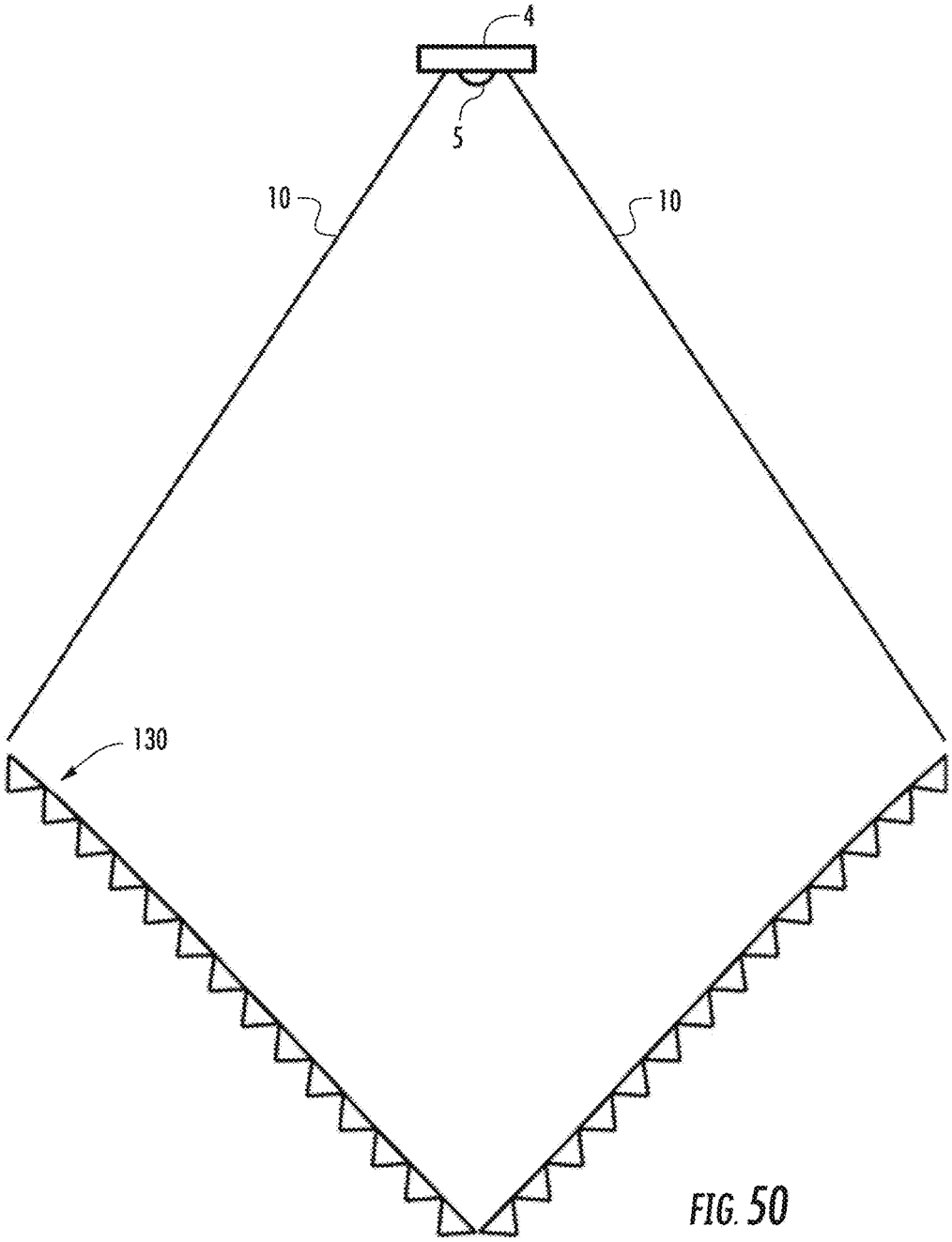
FIG. 50 is a cross-sectional view of a light source and a prism optic having a bent shape with prisms facing away from the light source.
Figure 51:
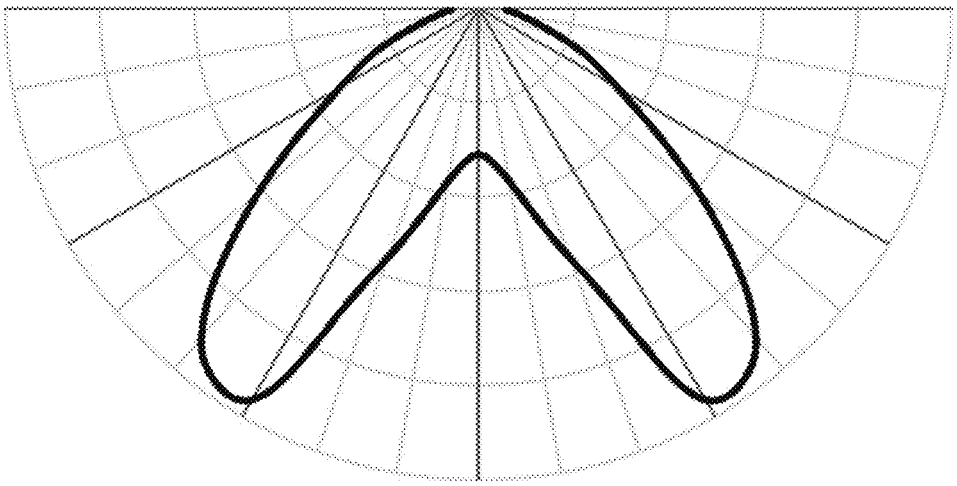
FIG. 51 is a chart illustrating the light distribution after passing through the prism optic of FIG. 50.

In another embodiment, an 80-degree prism optic 130 was formed into an outwardly angle-bent shape with slight convex curvature relative to the light source as depicted cross-sectionally in FIG. 50. The prisms faced away from and were oriented parallel to the light source 4 and had refractive index 1.49. The prism optic 130 is slightly convex relative to the light source 4. The resulting light distribution measurement at phi=90 degrees shown in FIG. 51. It has a batwing shape and has low luminance at high angles.

Figure 53:
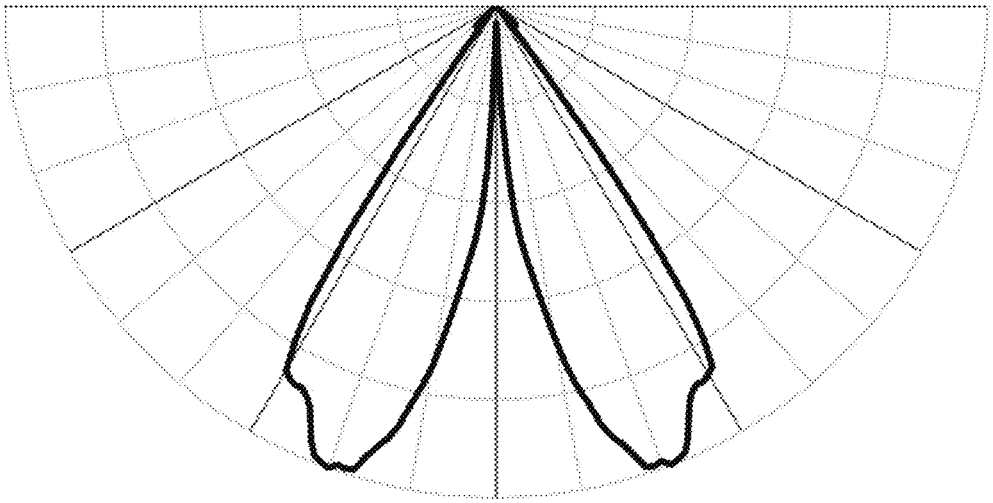
FIG. 53 is a chart illustrating the light distribution after passing through the prism optic of FIG. 52.
Figure 54:
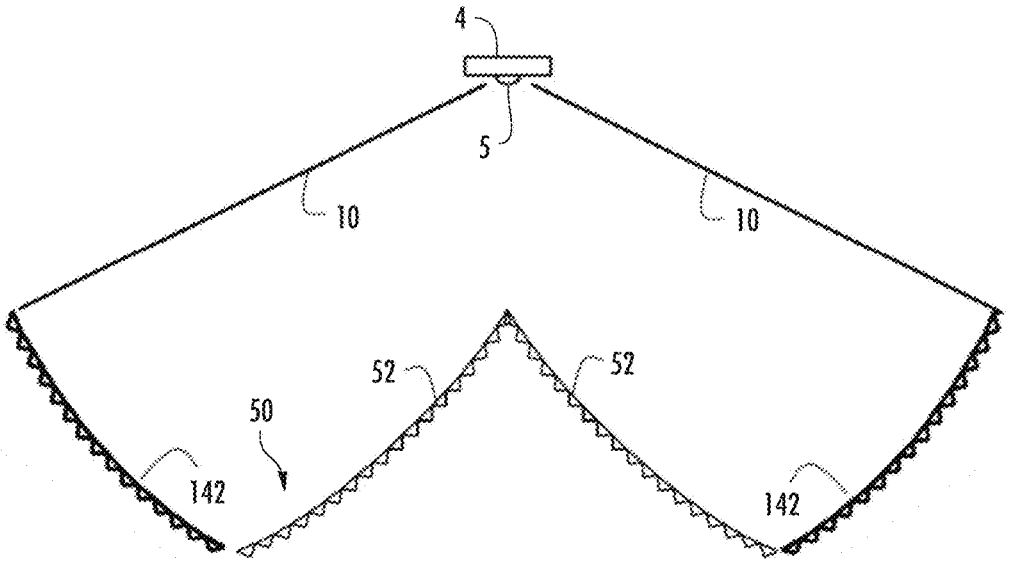
FIG. 54 is a cross-sectional view of a light source and a prism optic having multiple curved sections with prisms facing away from the light source.
Figure 55:
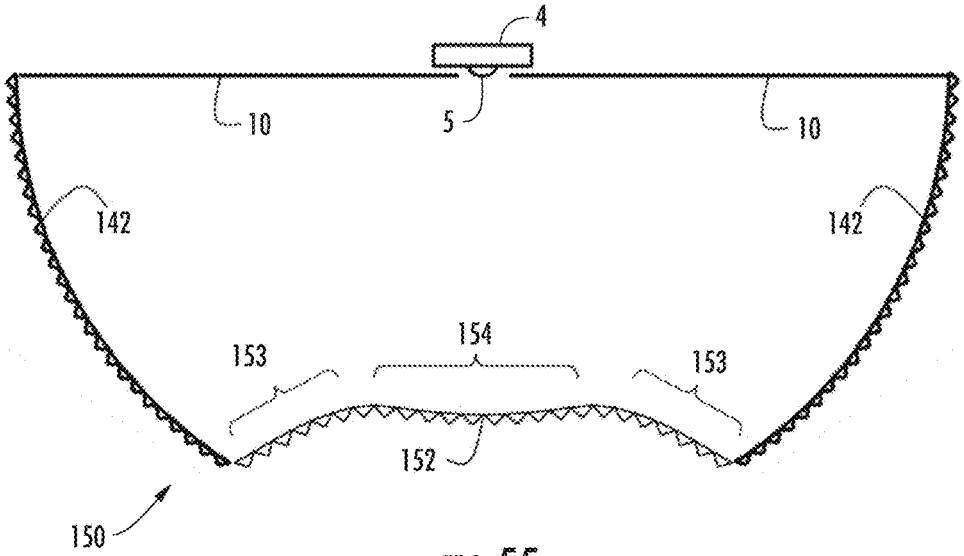
FIG. 55 is a cross-sectional view of a light source and a prism optic having multiple curved sections including light-collimating sections with prisms facing away from the light source.
Figure 56:
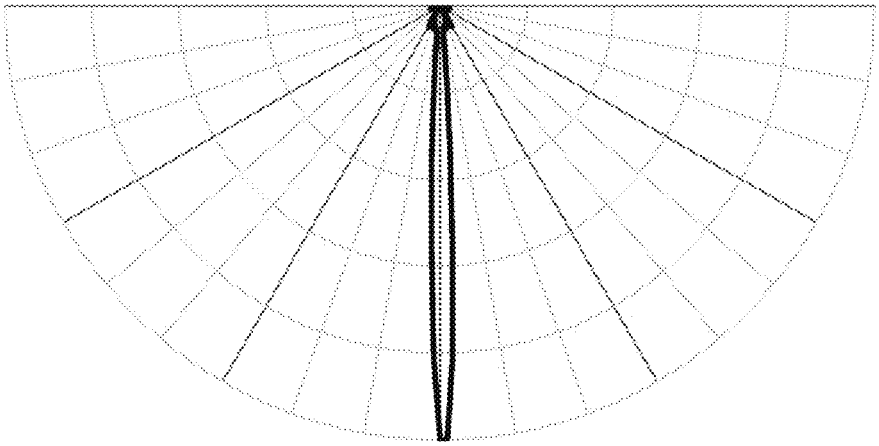
FIG. 56 is a chart illustrating the light distribution after passing through the prism optic of FIG. 55.

In other embodiments, a shaped prism optic as disclosed herein is surrounded by a further prism optic of cylindrical shape, centered upon the light source to provide retroreflection of light. In one example, depicted in FIG. 52, a curved prism optic 140 similar to that used in the embodiment of FIG. 29 includes an inner section 50 and extended cylindrical sections 142 with radius indicated by arrow 148 coincident with a light source 4 consisting of an array of LEDs 5. Prisms face outward, and are 90-degree prisms with refractive index 1.6. Each prism optic is concave relative to the light source. The cylindrical component 142 of the prism optic serves to retroreflect light striking it back toward the light source. A high-efficiency diffuse reflector 10 is disposed near the light source 4 with holes through which the LEDs emit light. The diffuse reflector efficiently redirects the retroreflected light into a Lambertian distribution, again giving it a chance to strike the inner section 50 of the curved prism optic and be emitted into a useful light distribution. The resulting light distribution measurement at phi=90 degrees shown in FIG. 53. It has a batwing shape and has low luminance at high angles. In embodiments such as this, prism internal angles near 90 degrees may be advantageous because they may retroreflect light substantially toward the light source such that light reflected from the reflector is near the source, maintaining the apparent narrowness of the source and maintaining the desired light distribution. In a related embodiment, the positions of the reflectors 10 are changed as illustrated in FIG. 54, still producing a batwing light distribution In another embodiment shown in FIG. 55, a shaped prism optic 150 includes inner section 152 and outer cylindrical sections 142, concave relative to the light source 4. Inner section 152 has a shape that includes light-collimating sections 153 curved and convex relative to the light source, and substantially retroreflecting central section 154, concave relative to the light source in which prisms are oriented substantially in a cylinder with their bases substantially perpendicular to the light source. Retroreflecting central section 154 and cylindrical sections 142 retroreflect light back toward the light source 4 and reflector 10. Light transmitted through curved light-collimating sections 153 is refracted into a substantially collimated beam. The resulting linearly collimated light distribution at phi=90 degrees is depicted in FIG. 56. The light is not collimated in the phi=0 degrees plane. In a related embodiment, the embodiment shown in FIG. 55 is rotated to emit collimated light in a desired direction. In a related embodiment, cylindrical sections 142 and reflectors 10 are replaced by a planar reflector positioned on each side, spanning from very near the light source to the edge of inner section 152, and a collimated light distribution is created.

Figure 52:
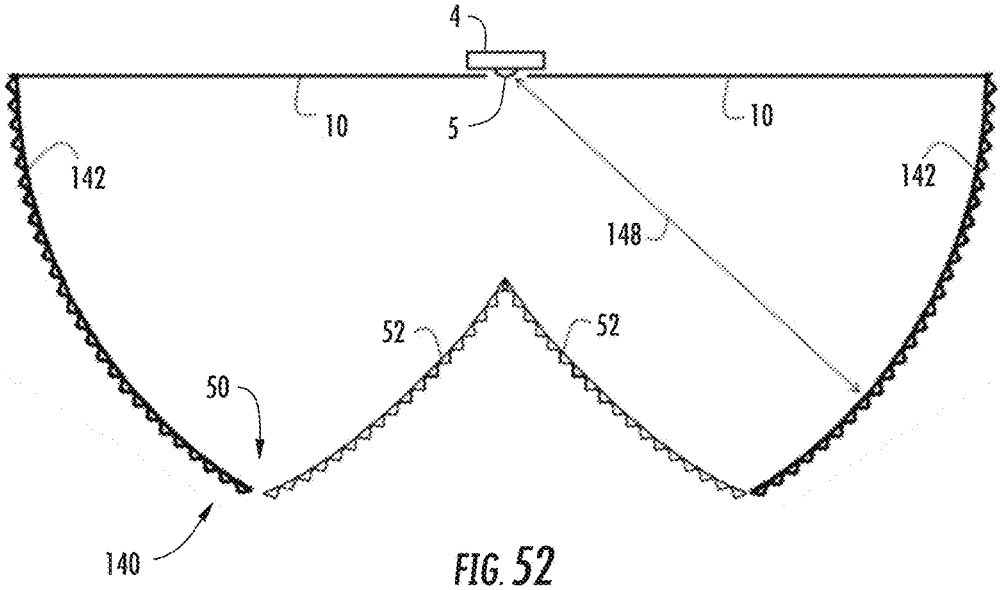
FIG. 52 is a cross-sectional view of a light source and a prism optic having multiple curved sections with prisms facing away from the light source.

In additional embodiments related to the embodiments of FIGS. 52 and 55, the retroreflecting cylindrical section 142 may completely surround a light source that emits light in all directions such as a fluorescent tube, and one or more light-emitting inner sections 152 may be included at various positions, the resulting light distribution being the superposition of light distributions produced by each of the inner sections. In one example, a linear direct-indirect pendant luminarie is created with upward-facing and downward-facing light-emitting inner sections in which a broad batwing distribution is projected upward toward a ceiling, and additional narrower batwing distribution is projected downward.

In additional embodiments, 2D circular batwing illumination can be achieved by a circularly-symmetric prism optic used in conjunction with a point or point-like light source that is small compared to the prism optic. In one embodiment, a batwing module or luminaire is created whose shape is the volume defined by the shape of FIG. 25 rotated about a central vertical axis, thus creating a module with a light source, a conical reflector, and a prism optic with prisms making circles around the central axis. It is illuminated by a small LED such as a chip-on-board LED array with small size relative to the prism optic. Such a batwing module will create a circularly-symmetric 2D batwing distribution. In a similar embodiment, a batwing module or luminaire is created whose shape is the volume defined by the shape of FIG. 29 rotated about a central vertical axis, creating a 2D batwing distribution with low luminance at high angles.

It is known in the art that Fresnel lenses can be used to form source light into specific light distributions, including batwing distributions. Fresnel lenses for focusing or shaping light are known in the art. In order to achieve a desired optical effect, Fresnel lenses employ elements that may be of prism-like shape, that vary in their geometry (such as pitch and/or sidewall slope) across the surface of the Fresnel lens or substrate in order to provide a specific optical function, such as focusing light. This variation across the substrate differentiates a Fresnel lens from prism optics of the present invention, which are substantially the same at any location on the substrate, forming the batwing light distributions using their shape. Advantageously, prism optics can be manufactured in large volumes, and can be customized to each desired luminaire and light distribution simply by cutting to a specific size and forming to a specific shape. Fresnel lenses would require separate design and manufacturing for each desired light distribution and for each luminaire design.

Many variations on prism films are commercially available in the display industry. Films may have variations on prisms including added roughness, bumps, dimples, variation of prism angle, and/or waviness for various purposes useful in the display industry. Manufacturers include Samsung, SKC Haas, DNP, EFUN, LG Chem, and MNTech. Because they are used in the display industry, gain and uniformity are considerations, so the prisms are substantially parallel and have substantially 90 degree internal angle to maximize gain, and any these variations are substantially uniform on the size scales of displays ranging from handheld to large television sizes. As long as these films are uniform across the dimensions of a luminaire, it is expected that they will be useful in the luminaires of the present invention.

Figure 57A:
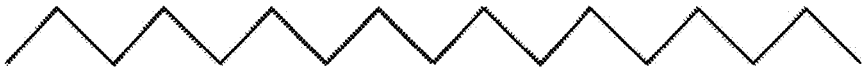
FIGS. 57A-57C illustrate cross sections of prisms according to some embodiments described herein.
Figure 57B:
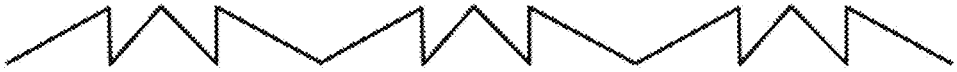
Figure 57C:
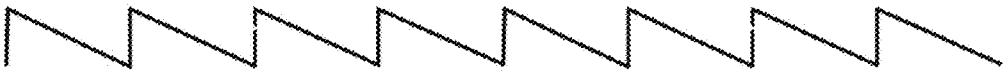

Although isosceles triangular prisms, as depicted in FIG. 57A have been discussed in many embodiments herein, it is possible to use other angular cross-sections. Prisms that vary deterministically or pseudo-randomly such as depicted in FIG. 57B may be useful as long as they are substantially uniform across the dimensions of a luminaire. In single-sided cases, such as presented in the embodiments of FIGS. 31, 33, and components of the embodiments of FIGS. 35, 36, 37, and 38, it may be possible to use non-symmetric prisms that are substantially uniform across a substrate such as those depicted in FIG. 57C. This may confer advantages such as increased control over light distribution angles or reduction of high-angle glare.

In additional embodiments, other types of luminaires known in the art can employ a batwing prism optic according to any of the embodiments described herein and produce a batwing distribution, said luminaires including but not limited to downlight, recessed troffer, surface-mount troffer, suspended pendant, suspended linear pendant, wall wash, cove, replacement lamp, PAR lamp, architectural, fine art, outdoor, bollard, aisle, stage/show lighting, and movie lighting.

In additional embodiments, luminaires including a batwing prism optic according to any of the embodiments described herein may employ additional elements such as conventional diffusers, additional prism optics, baffles, louvers, specular reflectors, diffuse reflectors, absorbers, openings, to further modify the light distribution for purposes such as obscuring lamps, enhancing or de-emphasizing nadir suppression, reducing high-angle luminance (glare), or forming asymmetric or one-sided distributions.

In additional embodiments, one or more specular reflectors is used in conjunction with a light source and batwing prism optic according to any of the embodiments described herein, to reflect or "fold" a symmetric batwing prism optic, creating a one-sided asymmetrical batwing distribution.

Manufacturing

The batwing prism optics according to any of the embodiments described herein can be created using many techniques known in the art.

The shape of the prisms may be cast onto a substrate using a suitable master mold, and thermally-curing polymer or ultraviolet (UV) light curing polymer, or the shape may be impressed into a thermoplastic substrate through compression molding or other molding, or may be created at the same time as the substrate using extrusion, extrusion-embossing or injection molding.

Figure 58:
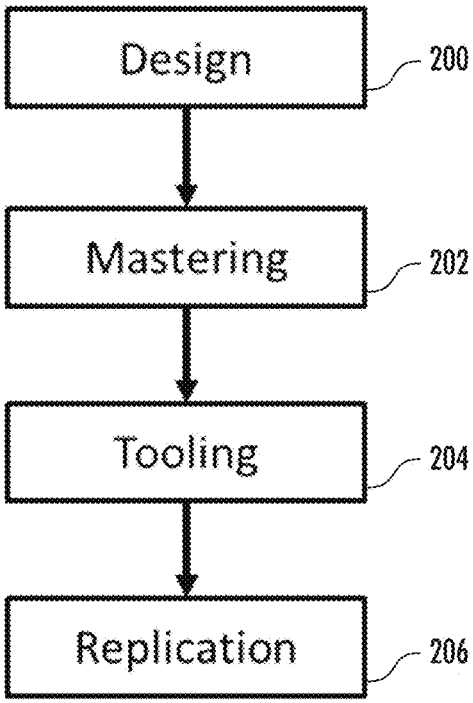
FIG. 58 is a flowchart of methods of fabricating light transmissive structures, such as prism optics, according to various embodiments described herein.

The microstructures may be produced by replicating a master, as illustrated at Block 206 of FIG. 58. For example, a prism optic can be made by replication of a master containing the desired shapes as described in U.S. Pat. No. 7,190,387 B2 to Rinehart et al., entitled Systems And Methods for Fabricating Optical Microstructures Using a Cylindrical Platform and a Rastered Radiation Beam; U.S. Pat. No. 7,867,695 B2 to Freese et al., entitled Methods for Mastering Microstructures Through a Substrate Using Negative Photoresist; and/or U.S. Pat. No. 7,192,692 B2 to Wood et al., entitled Methods for Fabricating Microstructures by Imaging a Radiation Sensitive Layer Sandwiched Between Outer Layers, assigned to the assignee of the present invention, the disclosures of all of which are incorporated herein by reference in their entirety as if set forth fully herein. The masters themselves may be fabricated using laser scanning techniques described in these patents, and may also be replicated to provide diffusers and/or prism optics using replicating techniques described in these patents.

In other methods and systems, laser holography, known in the art, is used to create a holographic pattern that creates the desired microstructure in a photosensitive material.

In other methods and systems, projection or contact photolithography, such as used in semiconductor, display, circuit board, and other common technologies known in the art, is used to expose the microstructures into a photosensitive material.

In other systems/methods, laser ablation, either using a mask or using a focused and modulated laser beam, is used to create the microstructures in a material.

In other methods and systems, micromachining (also known as diamond machining), known in the art, is used to create the desired microstructure from a solid material.

In other methods and systems, additive manufacturing (also known as 3D printing), known in the art, is used to create the desired microstructure in a solid material.

In other methods and systems, linear extrusion through a shaped die, known in the art, is used to create the desired prismatic structure in a solid transparent or translucent material.

In other methods and systems, injection molding, known in the art, is used to create the desired prismatic structure in a solid transparent or translucent material.

In other methods and systems, a prism optic is created in a planar form, and subsequently formed into the desired shape.

Variations

Many other variations on the structure may be provided according to various embodiments described herein.

The substrate may be thin, such as a flexible plastic film, or thick, such as a rigid acrylic or polycarbonate sheet. It may be monolithic or include multiple layers, such as a thin plastic film laminated to a thicker rigid substrate using an adhesive layer or other lamination method. Additional optical or mechanical layers may be present, such as a cladding layer of differing refractive index disposed outside of one or both surfaces of the batwing prism optic.

The prism may be formed on a thin flexible substrate or film, and placed inside a rigid translucent member such as a plastic profile extrusion to hold it in the desired shape. Such prism films may be preferable over extruded plastic with integral prisms for several reasons. Prism films may be less expensive to manufacture in high volumes. Extruding prisms with accurately defined shapes may be difficult in extruded plastic, whereas generally smooth extruded plastic lenses are inexpensive and common. The cost of prism films is related in part to its thickness, and as such prism films are preferably less than about 0.75 mm thick, more preferably less than 0.3 mm thick, and more preferably less than 0.2 mm thick. Prism films, in order to be inexpensively manufactured and stay flexible, have a prism pitch of preferably less than about 250 microns, and more preferably less than about 100 microns.

Customization of the batwing prism optic to achieve goals, including specific output distribution shapes, accommodating specific incoming light distributions, desired visual appearances, etc., can be achieved by varying many different aspects of the batwing prism optic and luminaire design according to any of the embodiments described herein. Variations in prism geometry (including prism pitch, curvature, and cross-sectional shape), internal angle, rounding of prism peaks and valleys, surface roughness, etc., can be used. Prisms can be asymmetric (with a gentle-sloping face on one side, and a strongly-sloped face in the other side). The refractive index of the prisms and/or substrate material can be varied.

Customization can include many aspects of the output light distribution, including but not limited to varying degrees of nadir suppression, different spreading angles, asymmetry, reduction of high-angle luminance, single-sided distributions, and beam bending distributions. Many of those distributions are highly desirable to lighting designers.

Figure 59A:
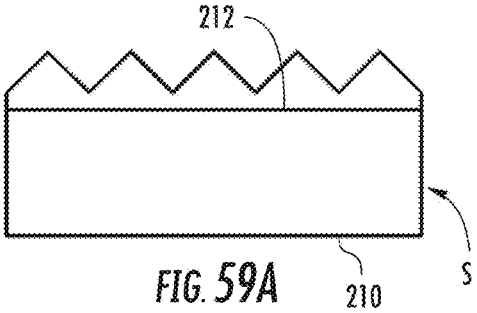
FIG. 59A is a cross-sectional view of a light transmissive structure such as a prism optic according to some embodiments described herein.

In some cases, the degree of nadir suppression provided by a given batwing prism optic may be too strong for a given incoming light distribution. In addition, with some light sources or prism optic designs, the light distribution created on a desired flat surface may not be smooth enough. In both of these cases it may be advantageous to add diffusion to the prismatic batwing prism optic. If the diffusion is sufficiently strong, it will reduce the nadir suppression created by the batwing prism optic, and smooth the distribution of light projected onto a flat surface. Adding diffusion to a batwing prism optic can have the additional desirable effect of helping obscure light sources. This can be achieved in many ways, as illustrated in FIG. 59. FIG. 59A shows a cross-section of a typical non-diffused embodiment for reference. The prism optic or light transmissive structure of FIG. 59A includes a substrate S having first and second opposing faces 210, 212 and a plurality of linear prisms on the second face 212.

Figure 59B:
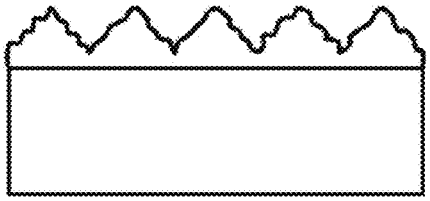
FIGS. 59B-59H are cross-sectional views of light transmissive structures with added diffusion features according to various embodiments described herein.

In one embodiment, depicted in FIG. 59B, diffusion is added to a prism optic according to any of the embodiments described herein by superimposing diffusive surface features. Many conventional surface (microstructure) diffusers include surface features such as microlenses or random roughness. Such surface features can be directly superimposed upon the surface of the prisms of the prism optic, and will add diffusion to the effect of the prism optic.

Figure 59C:
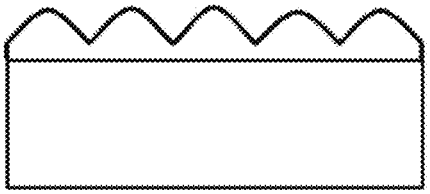

In other embodiments, depicted in FIG. 59C, diffusion is added to a prism optic according to any of the embodiments described herein by rounding the prism tips. In related embodiments the prism tips and/or valleys can be rounded. This rounding reduces nadir suppression and helps obscure light sources.

Figure 59D:
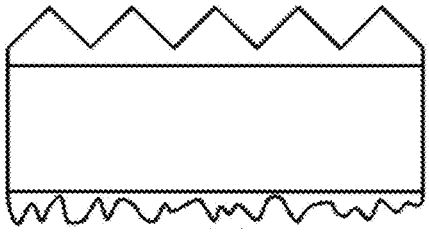

In other embodiments, depicted in FIG. 59D, diffusion is added to a prism optic according to any of the embodiments described herein by creating a conventional surface diffuser such as a microstructure or holographic diffuser on the surface of the substrate opposite the prism layer, using techniques known in the art.

Figure 59E:
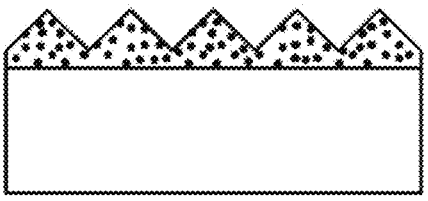

In other embodiments, depicted in FIG. 59E, diffusion is added to a prism optic according to any of the embodiments described herein by introducing light scattering in the prism layer. This can be accomplished for example by incorporating a scattering agent, such as minerals (e.g. TiO2, Silica, or Calcium Carbonate), microspheres or beads, particles, phase separated materials, into the liquid UV-curable polymer used to create the prism structure.

Figure 59F:
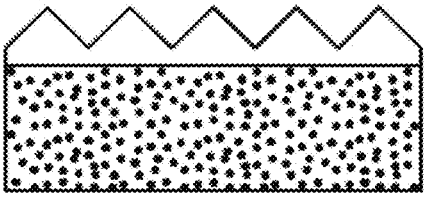

In other embodiments, depicted in FIG. 59F, diffusion is added to a prism optic according to any of the embodiments described herein by incorporating a scattering agent, such as minerals (e.g. TiO2, Silica, or Calcium Carbonate), microspheres or beads, particles, phase separated materials, into the substrate material.

Figure 59G:
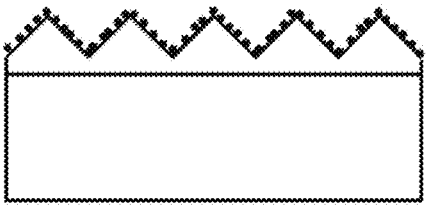

In other embodiments, depicted in FIG. 59G, diffusion is added to a prism optic according to any of the embodiments described herein by conformally coating a diffusive coating onto the surface of the prisms. Diffusive coatings are known in the art, such as a mineral dispersed in a binder polymer.

Figure 59H:
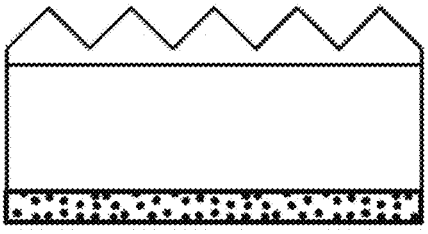

In other embodiments, depicted in FIG. 59H, diffusion is added to a prism optic according to any of the embodiments described herein by combining the transparent substrate with a diffusive layer, said diffusive layer comprising any conventional diffuser known in the art.

In other embodiments, not pictured, diffusion is added to a prism optic according to any of the embodiments described herein by using two layers separated by an air gap, said layers being a batwing prism optic as described herein and an conventional diffuser of any type. These embodiments introduce additional optical interfaces between air and the diffuser and prism optic materials, and thus may introduce additional reflections when used in a luminaire, reducing overall efficiency. For this reason, these embodiments may be less preferred.

Figure 60A:
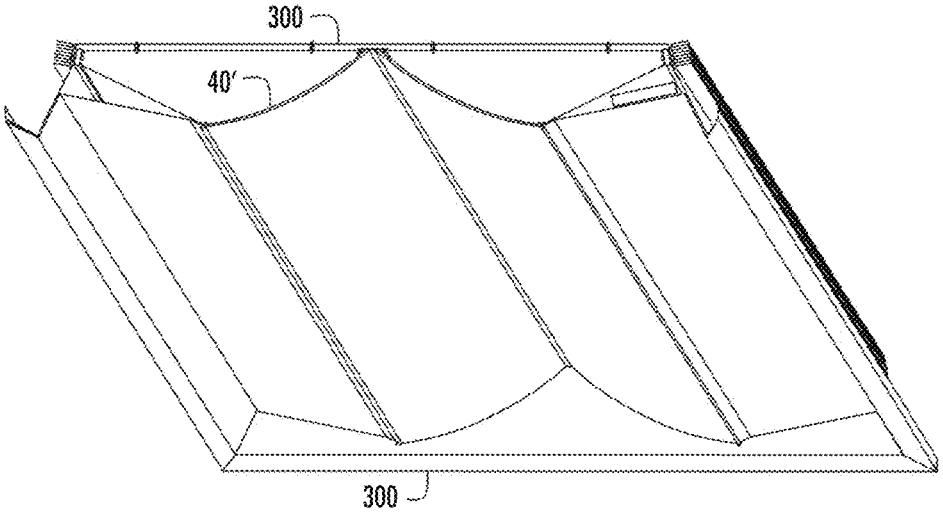
FIG. 60A is a perspective view of a recessed troffer luminaire according to some embodiments described herein.
Figure 60B:
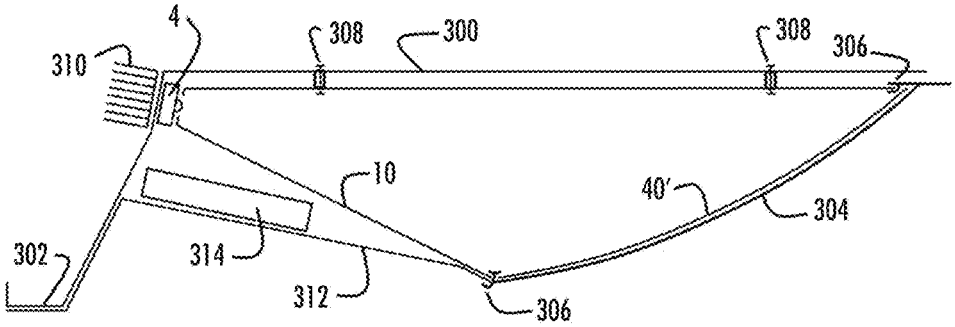
FIG. 60B is a cross-sectional view of the luminaire of FIG. 60A.

In an additional embodiment, FIG. 60A depicts a luminaire for recessed use in suspended ceilings with the frontmost part removed for clarity. FIG. 60B depicts a cross-section of one half of the symmetrical luminaire to illustrate details. Troffer housing 300 holds the elements of the luminaire, and troffer edges 302 facilitate insertion into a standard suspended ceiling. Light Source 4 illuminates prism optic 40' consisting of a 60-degree prism film with prisms of refractive index 1.49. In some embodiments the prism optic has additional diffusion including any of the examples of FIG. 59. Prism optic 40' is placed in a transparent extruded plastic lens 304 that together holds prism optic 40' to the shape of the embodiment of FIG. 25. The extruded plastic lens 304 may be formed of transparent or translucent diffusive polymers and may have smooth or matte surfaces, and includes appropriate features at its ends 306 to facilitate attachment to reflectors 10 and/or other components of the luminaire. Reflectors 10 direct light toward the prism optic 40', and may be held in place by fasteners such as screws with spacers 308. In embodiments in which heat sinks are necessary, heatsink 310 is affixed in thermal contact with light source 4, possibly through troffer housing 300, and may include thermal pastes, tapes, or adhesives (not shown) to facilitate heat conduction. Panels such as panel 312 may be included for mechanical support and decorative purposes, and may create internal cavities that may hold electronic driver circuits 314. Alternatively driver circuits may be otherwise disposed on the outside of the troffer housing 300 (this placement of a driver circuit not shown). The housing 300 surrounds the luminaire on all four sides and may be reflective to maximize efficiency. In some embodiments separate reflective end caps (not shown) may be used in addition to the housing 300. The luminaire produces a batwing light distribution and has low luminance at high angles in the phi=90 degree plane. As stated, in FIG. 60A, the frontmost part of troffer housing 300 and optional reflective end caps are not shown. It will be understood that similar luminaires can be made in other forms, including surface-mount, wall-mount, suspended or pendant, and pole-mounted. It will further be understood that similar luminaires can be made with a range of batwing light distributions optimized as described herein by adjustment of the placement of light source, reflector, and prism optic curvature.

In some embodiments, multiple modules can be combined into a linear hanging (pendant) luminaire in which some modules illuminate downward and some illuminate upward, simultaneously illuminating surfaces such as a floor, walls, and/or ceiling. It will be understood that the light distribution and luminous flux may be different for upward-facing and downward-facing components to fit the lighting requirements of a lighting designer.

In some embodiments, light transmitted by a prism optic can be used to illuminate a floor and light reflected by a prism optic, through first-surface reflection and/or multiple reflections through the prism optic, can be allowed to escape the luminaire via openings or transparent lenses to simultaneously illuminate a ceiling.

In many cases, the exact effect of the variations in prism optic design including the shape and curvature of the prism optic, prism angle, and refractive index according to any of the embodiments described herein need not be directly or completely understood to be optimized, because these variations can be readily designed using mathematical software such as MATLAB, and optimized using optical ray tracing software such as LightTools to achieve specific goals. It is possible with ray tracing software to model the output of a prism optic according to any of the embodiments described herein when presented with a light source of a specified location and light distribution, and additional optional features such as reflectors. It is also possible to make and ray-trace a complete computer model of a luminaire, so as to optimize the prism optic design according to any of the embodiments described herein and luminaire design to achieve a specific output light distribution from the luminaire.

Various embodiments have been described above with reference to the accompanying drawings. Other embodiments may take many different forms and should not be construed as limited to the embodiments set forth herein. Rather, these embodiments are provided so that this disclosure will be thorough and complete, and will fully convey the scope of the invention to those skilled in the art.

When an element is referred to as being on, coupled or connected to/with another element, it can be directly on, coupled or connected to/with the other element or intervening elements may also be present. In contrast, if an element is referred to as being directly on, coupled or connected to/with another element, then no other intervening elements are present. As used herein, the term "and/or" includes any and all combinations of one or more of the associated listed items. The symbol "I" is also used as a shorthand notation for "and/or".

It will be understood that although the terms first and second are used herein to describe various regions, layers and/or sections, these regions, layers and/or sections should not be limited by these terms. These terms are only used to distinguish one region, layer or section from another region, layer or section. Thus, a first region, layer or section discussed above could be termed a second region, layer or section, and similarly, a second region, layer or section could be termed a first region, layer or section without departing from the teachings of the present invention. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," "includes" and/or "including", "have" and/or "having" (and variants thereof) when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A light distribution device for use with a light assembly including a linear light source having a light source longitudinal axis, the light distribution device comprising:

a light transmissive substrate having first and second opposing faces; and a plurality of substantially parallel linear prisms on the second face that extend in a longitudinal direction of the substrate, a respective prism having a generally triangular cross section in a plane transverse to the longitudinal direction of the substrate;

wherein the light distribution device is configured to connect to the light assembly in a connected position with the first face of the substrate facing the light source, with the linear prisms substantially parallel to the light source longitudinal axis and with and the substrate having a non-planar cross-sectional shape in a plane transverse to the longitudinal direction of the substrate such that at least a major portion of the substrate is concave relative to the light source;

wherein, when connected in the connected position, the light distribution device is configured to receive light from the light source and distribute the light emerging from the second face of the substrate in a batwing distribution pattern in a plane perpendicular to the light source longitudinal axis.

2. The light distribution device of claim 1 wherein the non-planar cross-sectional shape is an arc of a circle.

3. The light distribution device of claim 2 wherein a center of a circle including the arc of the circle is spaced-apart from the light source longitudinal axis.

4. The light distribution device of claim 1 wherein the non-planar cross-sectional shape is an arc of an ellipse.

5. The light distribution device of claim 4 wherein a center of an ellipse including the arc of the ellipse is spaced-apart from the light source longitudinal axis.

6. The light distribution device of claim 1 wherein the non-planar cross-sectional shape is a pointed arch.

7. The light distribution device of claim 1 further comprising first and second reflectors, the first reflector spanning from the light assembly to a first longitudinal edge of the substrate, the second reflector spanning from the light assembly to a second longitudinal edge of the substrate that is opposite the first longitudinal edge of the substrate.

8. The light distribution device of claim 7 wherein the first and second reflectors are specular reflectors.

9. The light distribution device of claim 7 wherein the first and second reflectors are diffuse reflectors.

10. The light distribution device of claim 7 wherein the first and second reflectors define a reflector angle at the light assembly that is at least about 60 degrees to distribute the light emerging from the second face in a wide batwing distribution pattern in a plane perpendicular to the light source longitudinal axis.

11. The light distribution device of claim 7 wherein the first and second reflectors define a reflector angle at the light assembly that is between about 30 and 60 degrees to distribute the light emerging from the second face in a narrow batwing distribution pattern in a plane perpendicular to the light source longitudinal axis.

12. The light distribution device of claim 7 wherein the first reflector spans from the light assembly past the first longitudinal edge of the substrate and the second reflector spans from the light source assembly past the second longitudinal edge of the substrate.

13. The light distribution device of claim 1 wherein the respective prism has an internal angle of about 90 degrees.

14. The light distribution device of claim 1 wherein the respective prism has an internal angle of about 60 degrees.

15. The light distribution device of claim 1 wherein the substrate has a refractive index of about 1.49 or less.

16. The light distribution device of claim 1 wherein the respective prism comprises a base at the second face of the substrate, and wherein substantially none of the prisms have a base that directly faces the light source.

17. The light distribution device of claim 1 wherein the non-planar cross-sectional shape comprises a raised central point with two outwardly-bending curves extending in opposite directions therefrom, and wherein the two outwardly-bending curves are concave relative to the light source.

18. The light distribution device of claim 17 wherein the substrate is a first substrate, the light distribution device further comprising:

a second substrate having first and second opposing faces with a plurality of substantially parallel linear prisms on the second face, the second substrate being concave relative to the light source, a first longitudinal edge of the second substrate positioned at a first longitudinal edge of the first substrate;

a third substrate having first and second opposing faces with a plurality of substantially parallel linear prisms on the second face, the third substrate being concave relative to the light source, a first longitudinal edge of the third substrate positioned at a second longitudinal edge of the first substrate that is opposite the first longitudinal edge of the first substrate;

a first reflector spanning from the light assembly to a second longitudinal edge of the second substrate that is opposite the first longitudinal edge of the second substrate; and a second reflector spanning from the light assembly to a second longitudinal edge of the third substrate that is opposite the first longitudinal edge of the third substrate.

19. The light distribution device of claim 1 wherein a first longitudinal edge of the substrate is connected to the light assembly on one side of the light source and a second longitudinal edge of the substrate that is opposite the first longitudinal edge of the substrate is connected to the light assembly on an opposite side of the light source.

20. The light distribution device of claim 1 further comprising first and second end caps, the first end cap at a first transverse edge of the substrate and the second end cap at a second transverse edge of the substrate that is opposite the first transverse edge of the substrate.

21. The light distribution device of claim 1 wherein the plurality of substantially parallel linear prisms are on a central longitudinal portion of the substrate, the light distribution device further comprising a first outer longitudinal light-blocking portion of the substrate and a second outer longitudinal light-blocking portion of the substrate that is opposite the first outer longitudinal light-blocking portion.

22. The light distribution device of claim 1 wherein the plurality of substantially parallel linear prisms are substantially uniformly distributed on the second face of the substrate.

23. The light distribution device of claim 1 wherein the substrate is a monolithic member.

24. The light distribution device of claim 1 wherein the substrate comprises a film comprising the plurality of substantially parallel linear prisms on a rigid or semi-rigid translucent or transparent member.

25. The light distribution device of claim 24 wherein the film has a thickness of about 0.2 mm or less.

26. The light distribution device of claim 1 wherein the respective prism has a pitch of about 100 microns or less.

27. The light distribution device of claim 1 further comprising a microstructure or holographic diffuser on the first face of the substrate.

28. The light distribution device of claim 1 further comprising at least one diffusion feature, the at least one diffusion feature comprising:

surface roughness on at least some of the prisms;

rounding of at least some of the peaks of the prisms;

rounding of at least some valleys that are between adjacent prisms;

a light scattering agent in at least some of the prisms and/or the substrate; and/or a diffusive coating on at least some of the prisms.

29. The light distribution device of claim 1 wherein the substrate is configured to be curved and/or bent to form the non-planar cross-sectional shape.

30. The light distribution device of claim 1 wherein the respective prism has an internal angle of between about 45 and 90 degrees.

31. The light distribution device of claim 1 in combination with the light assembly including the linear light source.

32. The combination of claim 31 wherein the linear light source comprises an array of spaced-apart LEDs.

33. The combination of claim 31 wherein the linear light source comprises a fluorescent lamp.

34. The light distribution device of claim 1 wherein the first face is smooth.

35. A light distribution device for use with first and second light assemblies, the first light assembly including a first linear light source having a first light source longitudinal axis, the second light assembly including a second linear light source having a second light source longitudinal axis, the light distribution device comprising:

a first light transmissive substrate having first and second opposing faces with a plurality of substantially parallel linear prisms on the second face that extend in a longitudinal direction of the first substrate;

a second light transmissive substrate having first and second opposing faces with a plurality of substantially parallel linear prisms on the second face that extend in a longitudinal direction of the second substrate, wherein the first light transmissive substrate is configured to connect to the first light assembly in a connected position with the first face of the first substrate facing the first light source, with the linear prisms substantially parallel to the first light source longitudinal axis and with the first substrate concave relative to the first light source;

wherein the second light transmissive substrate is configured to connect to the second light assembly in a connected position with the first face of the second substrate facing the second light source, with the linear prisms substantially parallel to the second light source longitudinal axis and with the second substrate concave relative to the second light source;

wherein, when connected in the connected position, the first light transmissive substrate is configured to receive light from the first light source and distribute the light emerging from the second face of the first substrate in a first one-sided distribution pattern in a plane perpendicular to the first light source longitudinal axis;

wherein, when connected in the connected position, the second light transmissive substrate is configured to receive light from the second light source and distribute the light emerging from the second face of the second substrate in a second one-sided distribution pattern in a plane perpendicular to the second light source longitudinal axis; and wherein the first and second one-sided distributions patterns combine to form a batwing distribution pattern in a plane perpendicular to the first and second light source longitudinal axes.

36. The light distribution device of claim 35 further comprising:

a first reflector spanning from the first light assembly to a first longitudinal edge of the first substrate;

a second reflector spanning from the first light assembly to a second longitudinal edge of the first substrate that is opposite the first longitudinal edge of the first substrate;

a third reflector spanning from the second light assembly to a first longitudinal edge of the second substrate; and a fourth reflector spanning from the second light assembly to a second longitudinal edge of the second substrate that is opposite the first longitudinal edge of the second substrate.

37. The light distribution device of claim 35 further comprising:

a first reflector spanning from the first light assembly to a first longitudinal edge of the first substrate;

a second reflector spanning from the second light assembly to a first longitudinal edge of the second substrate; and a third reflector spanning from the first light assembly to the second light assembly;

wherein the third reflector is positioned and configured such that the first light source does not directly illuminate the second substrate and such that the second light source does not directly illuminate the first substrate.

38. The light distribution device of claim 37 further comprising a diffuser spanning from a second longitudinal edge of the first substrate that is opposite the first longitudinal edge of the first substrate to a second longitudinal edge of the second substrate that is opposite the first longitudinal edge of the second substrate.

* * * * *